US006088674A

United States Patent [19]

Yamazaki

[11] Patent Number: 6,088,674

[45] Date of Patent: Jul. 11, 2000

[54] SYNTHESIZING A VOICE BY DEVELOPING METER PATTERNS IN THE DIRECTION OF A TIME AXIS ACCORDING TO VELOCITY AND PITCH OF A VOICE

[75] Inventor: Nobuhide Yamazaki, Kanagawa, Japan

[73] Assignee: Justsystem Corp., Tokushima, Japan

[21] Appl. No.: 08/821,078

[22] Filed: Mar. 20, 1997

[30] Foreign Application Priority Data

Dec. 4, 1996 [JP] Japan ..... 8-324457

[51] Int. Cl.[7] ..... G10L 7/02

[52] U.S. Cl. ..... 704/266; 704/270

[58] Field of Search ..... 704/258, 266, 704/269, 270

[56] References Cited

U.S. PATENT DOCUMENTS 5,633,984 5/1997 Aso et al. ..... 704/260

OTHER PUBLICATIONS

Yamazaki. Recent Text voice Synthesis and its Technology. vol. 27, No. 4, pp. 75–84, 1995.

Yamazaki. Recent Text Voice Synthesis and its Technolgy. vol. 27, No. 3, pp. 11–20, 1995.

Translation to Yamazaki (PTO 98–4166).

Translation to Yamazaki (PTO 98–4167).

*Primary Examiner*—David R. Hudspeth

*Assistant Examiner*—M. David Sofocleous

*Attorney, Agent, or Firm*—Sughrue, Mion, Zinn, Macpeak & Seas, PLLC

[57] ABSTRACT

Voice-generating information, comprising discrete voice data for velocity or pitch of a voice is made by dispensing the discrete data so that the voice data is not dependent on a time lag between phonemes and at the same time is present at a relative level against a reference thereof. The said information includes data on plural types of voice tone, and is stored in a voice-generating information storing section. Voice tone data indicating sound parameters for each voice element, such as phoneme for each voice tone type, is stored in a voice tone storing section. Voice data, corresponding to the type of voice tone in the voice-generating information stored in the voice-generating storing section, is selected from a plurality of voice type data stored in the voice tone storing section under control by a control section. Meter patterns, which occur successively in the direction of a time axis, are developed according to the voice-generating information. A voice waveform is synthesized according to the meter patterns and to the selected voice tone data with the voice outputted from a speaker.

143 Claims, 29 Drawing Sheets

FIG.2

41

| SELECTION No. | VOICE TONE DATA |
|---|---|
| 1 | VD1(PB1) |
| 2 | VD2(PB2) |
| • • • | • • • |

FIG. 4

5A

| CODE | CHAR-ACTER | CODE | CHAR-ACTER | CODE | CHAR-ACTER | CODE | CHAR-ACTER | CODE | CHAR-ACTER | CODE | CHAR-ACTER | CODE | CHAR-ACTER | CODE | CHAR-ACTER | CODE | CHAR-ACTER |
|---|---|---|---|---|---|---|---|---|---|---|---|---|---|---|---|---|---|
| 00h | , (COMMA) | 10h | GU | 20h | ZE | 30h | DO | 40h | PA | 50h | FI | 60h | GYO | 70h | CHE | 80h | MYU |
| 01h | . (PERIOD) | 11h | GE | 21h | ZO | 31h | NA | 41h | PI | 51h | FU | 61h | GUYA | 71h | CHO | 81h | MYO |
| 02h | TTSU | 12h | GO | 22h | TA | 32h | NI | 42h | PU | 52h | FE | 62h | GUYU | 72h | DYU | 82h | RYA |
| 03h | A | 13h | NGA | 23h | TI | 33h | NU | 43h | PE | 53h | FO | 63h | GUYO | 73h | NYA | 83h | RYU |
| 04h | I | 14h | NGI | 24h | TU | 34h | NE | 44h | PO | 54h | WA | 64h | SYA | 74h | NYU | 84h | RYO |
| 05h | U | 15h | NGU | 25h | TE | 35h | NO | 45h | MA | 55h | WI | 65h | SYU | 75h | NYO | | |
| 06h | E | 16h | NGE | 26h | TO | 36h | HA | 46h | MI | 56h | WE | 66h | SYE | 76h | HYA | | |
| 07h | O | 17h | NGO | 27h | TSA | 37h | HI | 47h | MU | 57h | WO | 67h | SYO | 77h | HYU | | |
| 08h | N | 18h | SA | 28h | TSI | 38h | HU | 48h | ME | 58h | YA | 68h | JA | 78h | HYO | | |
| 09h | KA | 19h | SI | 29h | TSU | 39h | HE | 49h | MO | 59h | YU | 69h | JI | 79h | BYA | | |
| 0Ah | KI | 1Ah | SU | 2Ah | TSE | 3Ah | HO | 4Ah | RA | 5Ah | YO | 6Ah | JU | 7Ah | BYU | | |
| 0Bh | KU | 1Bh | SE | 2Bh | TSO | 3Bh | BA | 4Bh | RI | 5Bh | KYA | 6Bh | JE | 7Bh | BYO | | |
| 0Ch | KE | 1Ch | SO | 2Ch | DA | 3Ch | BI | 4Ch | RU | 5Ch | KYU | 6Ch | JO | 7Ch | PYA | | |
| 0Dh | KO | 1Dh | ZA | 2Dh | DI | 3Dh | BU | 4Dh | RE | 5Dh | KYO | 6Dh | CHA | 7Dh | PYU | | |
| 0Eh | GA | 1Eh | ZI | 2Eh | DU | 3Eh | BE | 4Eh | RO | 5Eh | GYA | 6Eh | CHI | 7Eh | PYO | | |
| 0Fh | GI | 1Fh | ZU | 2Fh | DE | 3Fh | BO | 4Fh | FA | 5Fh | GYU | 6Fh | CHU | 7Fh | MYA | | |

FIG.5

5B

| CODE | CHARACTER | CODE | CHARACTER | CODE | CHARACTER | CODE | CHARACTER |
|---|---|---|---|---|---|---|---|
| A0h | U/KA | B0h | U/TSI | C0h | U/FU | D0h | U/HYU |
| A1h | U/KI | B1h | U/TSU | C1h | U/FE | D1h | U/HYO |
| A2h | U/KU | B2h | U/TSE | C2h | U/FO | D2h | U/PYA |
| A3h | U/KE | B3h | U/TSO | C3h | U/KYA | D3h | U/PYU |
| A4h | U/KO | B4h | U/HA | C4h | U/KYU | D4h | U/PYO |
| A5h | U/SA | B5h | U/HI | C5h | U/KYO | | |
| A6h | U/SHI | B6h | U/HU | C6h | U/SYA | | |
| A7h | U/SU | B7h | U/HE | C7h | U/SYU | | |
| A8h | U/SE | B8h | U/HO | C8h | U/SYE | | |
| A9h | U/SO | B9h | U/PA | C9h | U/SYO | | |
| AAh | U/TA | BAh | U/PI | CAh | U/CHA | | |
| ABh | U/TI | BBh | U/PU | CBh | U/CHI | | |
| ACh | U/TU | BCh | U/PE | CCh | U/CHU | | |
| ADh | U/TE | BDh | U/PO | CDh | U/CHE | | |
| AEh | U/TO | BEh | U/FA | CEh | U/CHO | | |
| AFh | U/TSA | BFh | U/FI | CFh | U/HYA | | |

FIG.7

6

| FILE NAME | VOICE-GENERATING INFORMATION | |
|---|---|---|
| A | HDRA | PRSA |
| B | HDRB | PRSB |
| C | HDRC | PRSC |
| ⋮ | ⋮ | ⋮ |

FIG.8

HDRA

| PHONEME GROUP | LANGUAGE | TIME RESOLUTION | VOICE TONE SPECIFYING DATA | PITCH REFERENCE | VOLUME REFERENCE |
|---|---|---|---|---|---|
| PG | LG | TD | VP | PB | VB |

FIG.11
| VL | VELOCITY |
|---|---|
| 0 | SILENCE |
| 1 | ppp |
| 2 | pp |
| 3 | mp |
| 4 | STANDARD |
| 5 | mf |
| 6 | ff |
| 7 | fff |
FIG.12A
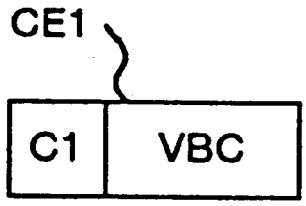
FIG.12B
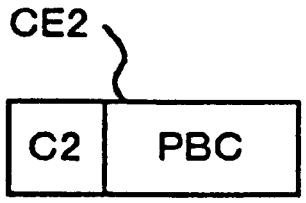

FIG.29

HDRX

| PHONEME GROUP | LANGUAGE | TIME RESOLUTION | VOICE TONE SPECIFYING DATA | PITCH REFERENCE | VOLUME REFERENCE | ATTRIBUTE OF VOICE TONE |
|---|---|---|---|---|---|---|
| PG | LG | TD | VP | PB | VB | AT |

FIG.30

AT

| SEX | AGE | PITCH REFERENCE | CLEARNESS | NATURALITY |
|---|---|---|---|---|
| SX | AG | PB | CL | NT |

FIG.31

43

| SELECTION No. | VOICE TONE DATA | ATTRIBUTE OF VOICE TONE |
|---|---|---|
| 1 | VD1 | AT1 |
| 2 | VD2 | AT2 |
| ⋮ | ⋮ | ⋮ |

FIG.32

AT1

| SEX | AGE | PITCH REFERENCE | CLEARNESS | NATURALITY |
|---|---|---|---|---|
| SX1 | AG1 | PB1 | CL1 | NT1 |

SYNTHESIZING A VOICE BY DEVELOPING METER PATTERNS IN THE DIRECTION OF A TIME AXIS ACCORDING TO VELOCITY AND PITCH OF A VOICE

FIELD OF THE INVENTION

The present invention relates to a regular voice synthesizing apparatus for reproducing a voice by making use of a regular voice synthesizing technology and a method for the same, a regular voice making/editing apparatus for making/editing data for reproducing a voice by making use of the regular voice synthesizing technology and a method for the same, a computer-readable medium and storing thereon a program having the computer execute a sequence for synthesizing a regular voice, and a computer-readable medium and storing thereon a program having the computer execute a regular voice making/editing sequence.

BACKGROUND OF THE INVENTION

In a case where voice data is stored by receiving a natural voice, generally a voice tone waveform is stored as it is as voice data.

However, a voice waveform necessitates a data rate, and as the number of files becomes larger, a larger memory space is required, and also a longer time is required for transferring the files.

For the circumstances as described above, in recent years, as disclosed in Japanese Patent Publication No. HEI 5-52520, there has been proposed an apparatus for synthesizing a voice waveform by decoding voice source data obtained by encoding (compressing) a voice waveform when a voice is synthesized and synthesizing a voice waveform using voice route data in a phoneme memory. In this publication, a voice is divided into several time zones, and voice source data for pitch and power (amplitude of a voice) are specified with an absolute amplitude level at every frame of the divided time zone. Namely, a plurality of frames of voice source data are correlated to each phoneme.

Also, as a technology analogous to that disclosed in the publication described above, there is the invention disclosed in Japanese Patent Laid-Open Publication No. SHO 60-216395. With the invention disclosed in this publication, a data form is employed in which one of representative voice source data is obtained from a plurality of frames each corresponding to each phoneme, and representative voice source data is correlated to each phoneme.

It is possible to reduce a data rate by coding data as disclosed in Japanese Patent Publication No. HEI 5-52520 described above, but as a plurality of frames can be correlated to a time zone for one phoneme, it is possible to obtain continuity in data in the direction of a time axis, but further reduction of data rate is required.

So for correlating representative voice source data to each phoneme as disclosed in Japanese Patent Laid-Open Publication No. SHO 60-216395, a data format more discrete as compared to continuity of voice source data according to Japanese Patent Publication No. HEI 5-52520 has been employed, and this method is effective for reducing a data rate.

However, such parameters as a local change pattern of amplitude in a shifting section from a consonant to a vowel or a ratio between levels of amplitude of each vowel are independent and substantially fixed for each voice route data.

For this reason, in the technology disclosed in Japanese Patent Laid-open Publication No. SHO 60-216395, there occurs no problems in reproducibility of voice tone so far as a narrator giving basic voice route data is the same person as a person giving the voice-generating data, and at the same time so far as voice conditions for making the voice route data are the same as those for making the voice source data. However, if the persons and the conditions are different, the original amplitude patterns of the voice route data are not reflected because the amplitude is specified as an absolute amplitude level and also because the voice pitch is specified as an absolute pitch frequency. Thus, there is the possibility that the voice is reproduced with an inappropriate voice tone.

In addition, as a voice pitch pattern is apt to be delayed as compared to a syllable, generally a position of a local maximum value or a minimum value of voice pitch is displaced from a separating position between phonemes. For this reason, there is the disadvantageous possibility that a voice pitch pattern can not be approximated well when a voice is synthesized. Also in this case, the voice may be reproduced with inappropriate voice tone.

As described above, in Japanese Patent Laid-open Publication No. SHO 60-216395, since voice source data depends on particular voice route data in a phoneme memory, voice route data for different voice tones can not be used.

SUMMARY OF THE INVENTION

It is an object of the present invention to obtain a regular voice synthesizing apparatus which can reproduce a voice with high quality and can solve the problems in the conventional technology, as described above.

Also it is another object of the present invention to obtain a regular voice making/editing apparatus which can easily make and edit data enabling reproduction of voice tone with high quality with the regular voice synthesizing apparatus.

Also it is another object of the present invention to obtain a regular voice synthesizing method which enables reproduction of voice with high quality.

It is another object of the present invention to obtain a regular voice editing method which makes it possible to easily make and edit data, thereby enabling reproduction of voice with high quality according to the regular voice synthesizing method described above.

It is another object of the present invention to obtain a storage medium that stores therein a program for having a computer execute a regular voice synthesizing sequence enabling reproduction of voice with high quality, and is readable by the computer.

It is another object of the present invention to obtain a storage medium that stores therein a program for having a computer execute a regular voice making/editing sequence which makes it possible to easily make and edit data enabling reproduction of voice with high quality, using the storage medium, and is readable by the computer.

With the present invention, meter patterns are developed successively in the direction of a time axis according to velocity and pitch of a voice not dependent on phonemes, and a voice waveform is generated according to the meter patterns as well as to voice tone data selected according to voice-generating information. Accordingly, the voice can be reproduced with a preferable type of voice tone without limiting the voice tone to any specific one, and a displacement in patterns for the pitch of a voice is not generated when the voice waveform is generated. As a result, it is possible to reproduce a voice with high quality.

With the present invention, meter patterns are developed successively in the direction of a time axis, according to the velocity and pitch of a voice, that are not dependent on phonemes, and a voice waveform is generated according to the meter patterns as well as to voice tone data selected according to information indicating types of voice tone included in voice-generating information. Accordingly, the voice can be reproduced with the most suitable type of voice tone specified directly from plural types of voice tone without limiting the voice tone to any specific one. Also, a displacement in patterns for the pitch of a voice is not generated when the voice waveform is generated. As a result, it is possible to reproduce a voice with high quality.

With the present invention, meter patterns are developed successively in the direction of a time axis, according to the velocity and pitch of a voice, that are not dependent on phonemes, and a voice waveform is generated according to the meter patterns as well as to voice tone data selected according to similarity based on information indicating an attribute of the voice tone included in voice-generating information. Accordingly, the voice can be reproduced with a type of voice tone having the highest similarity without using unsuitable types of voice tone. Also, the displacement in patterns for the pitch of a voice is not generated when the voice waveform is generated. As a result, it is possible to reproduce a voice with high quality.

With the present invention, meter patterns are developed successively in the direction of a time axis, according to the velocity and pitch of a voice, that are not dependent on phonemes, and a voice waveform is generated according to the meter patterns as well as to voice tone data selected according to information indicating a type and attribute of voice tone included in voice-generating information. Accordingly, the voice can be reproduced with a type of voice tone having the highest similarity without using an unsuitable type of voice tone, even though there is not a directly specified type of voice tone. Also displacement in patterns for the pitch of a voice is not generated when the voice waveform is generated. As a result, it is possible to reproduce a voice with high quality.

With the present invention, meter patterns are developed successively in the direction of a time axis, according to voice-generating information, and a voice waveform is generated according to the meter patterns as well as to voice tone data selected according to the voice-generating information. Accordingly, a voice can be reproduced with a preferable type of voice tone without limiting the voice tone to any specific one. Also, a displacement in patterns for pitch of a voice is not generated when the voice waveform is generated. As a result, it is possible to reproduce the voice with high quality.

With the present invention, meter patterns are developed successively in the direction of a time axis, according to voice-generating information, and a voice waveform is generated according to the meter patterns as well as to voice tone data selected according to information indicating the types of voice tone included in the voice-generating information. Accordingly, a voice can be reproduced with the most suitable type of voice tone as specified directly from a plurality types of voice tone without limiting voice tone to any specific one. Also a displacement in patterns for the pitch of a voice is not generated when the voice waveform is generated. As a result, it is possible to reproduce the voice with high quality.

With the present invention, meter patterns are developed successively in the direction of a time axis, according to voice-generating information, and a voice waveform is generated according to the meter patterns as well as to voice tone data selected according to a similarity based on information indicating the attribute of a voice tone included in the voice-generating information. Accordingly, a voice can be reproduced with a type of voice tone having the highest similarity without using unsuitable types of voice tone. Also, a displacement in patterns for the pitch of a voice is not generated when the voice waveform is generated. As a result, it is possible to reproduce the voice with high quality.

With the present invention, meter patterns are developed successively in the direction of a time axis, according to voice-generating information, and a voice waveform is generated according to the meter patterns as well as to voice tone data selected according to information indicating a type and attribute of voice tone included in the voice-generating information. Accordingly, a voice can be reproduced with a type of voice tone having highest similarity, without using an unsuitable type of voice tone, even though there is no directly specified type of the voice tone. Also, displacement in patterns for the pitch of a voice is not generated when the voice waveform is generated. As a result, it is possible to reproduce the voice with high quality.

With the present invention, a reference for the pitch of a voice in a voice-generating information storing means is shifted according to a reference for pitch of a voice in a voice tone data storing means when the voice is reproduced. Accordingly, the pitch of each voice relatively changes according to the shifted reference of voice pitch, regardless of a time zone for each phoneme. As a result, the reference for voice pitch becomes closer to that in a voice tone side, which makes it possible to further improve the quality of the voice.

With the present invention, when the voice is reproduced, a reference for voice pitch in a voice-generating information storing means is shifted according to a reference for pitch of a voice at an arbitrary point of time; whereby pitch of each voice relatively changes according to the shifted reference of voice pitch regardless of a time zone for each phoneme. As a result, it is possible to process a voice tone by, for instance, making it closer to the intended voice quality according to the extent of shift rate.

With the present invention, voice-generating information is made by dispersing voice data for at least one of velocity and pitch of a voice based on an inputted natural voice so that each voice data is not dependent on a time lag between phonemes and has a level relative to a reference, and the voice-generating information is stored in the voice-generating information storing means. Accordingly, it is possible to specify velocity and pitch of a voice at an arbitrary point of time not dependent on the time lag between phonemes.

With the present invention, voice data for at least one of velocity and pitch of a voice is output based on an inputted natural voice so that the voice data is not dependent on a time lag between phonemes and has a level relative to a reference. Also, voice-generating information is produced, including plural types of voice tone, and the voice-generating information is stored in a voice-generating information storing means. Accordingly, it is possible to specify the velocity or pitch of a voice at an arbitrary point of time, not dependent on a time lag between phonemes, as well as to specify a type of voice tone in the voice-generating information.

With the present invention, voice data for at least one of velocity and pitch of a voice is output based on an inputted natural voice so that the voice data is not dependent on a time lag between phonemes, and has a level relative to a reference. Also, voice-generating information is produced, including an attribute of voice tone, and the voice-generating information is stored in the voice-generating information storing means. Accordingly, it is possible to specify the velocity or pitch of a voice at an arbitrary point of time that is not dependent on the time lag between phonemes, and also to specify an attribute of voice tone in the voice-generating information.

With the present invention, voice data for at least one of velocity and pitch of a voice is output based on an inputted natural voice so that the voice data is not dependent on a time lag between phonemes and has a level relative to a reference. Also, voice-generating information is prduced, including a type and attribute of voice tone. Also, the voice-generating information is stored in a voice-generating information storing means. Accordingly, it is possible to specify the velocity or pitch of a voice at an arbitrary point of time that is not dependent on the time lags between phonemes, and also to specify a type or an attribute of voice tone in the voice-generating data.

With the present invention, voice-generating information is produced, including data on phoneme and meter, as information based on an inputted natural voice, and the voice-generating information is stored in a voice-generating information storing means. Accordingly, it is possible to generate a voice-generating information for selection of a type of voice tone.

With the present invention, voice-generating information is produced, including data on phoneme and meter, based on an inputted natural voice as well as a type of voice tone, and the voice-generating information is stored in a voice-generating information storing means. Accordingly, it is possible to specify a type of voice tone in the voice-generating information.

With the present invention, voice-generating information is produced, including data on phoneme and meter, based on an inputted natural voice as well as an attribute of voice tone, and the voice-generating information is stored in a voice-generating information storing means; whereby it is possible to specify an attribute of voice tone in the voice-generating information.

With the present invention, voice-generating information is produced, including data on phoneme and meter, based on an inputted natural voice as well as a type and an attribute of voice tone, and the voice-generating information is stored in a voice-generating information storing means; whereby it is possible to specify a type or an attribute of a voice, particularly a type and attribute of voice tone, in the voice-generating information.

With the present invention, a regular voice synthesizing method comprises the steps of developing meter patterns successively in the direction of a time axis according to the velocity and pitch of a voice, but not dependent on phonemes, and generating a voice waveform according to the meter patterns as well as to voice tone data selected according to voice-generating information. Accordingly, the voice can be reproduced with a proposed type of voice tone without limiting the voice tone to any specific tone. Also, a displacement in patterns for the pitch of a voice is not generated when the voice waveform is generated. As a result, it is possible to reproduce a voice with high quality.

With the present invention, a regular voice synthesizing method comprises the steps of developing meter patterns successively in the direction of a time axis according to the velocity and pitch of a voice, but not dependent on phonemes, and generating a voice waveform according to the meter patterns as well as to voice tone data selected according to information indicating the types of voice tone included in voice-generating information. Accordingly, a voice can be reproduced with a most suitable type of voice tone as specified directly from a plurality of types of voice tone without limiting the voice tone to any specific tone. Also, thr displacement in patterns for the pitch of a voice is not generated when the voice waveform is generated. As a result, it is possible to reproduce a voice with high quality.

With the present invention, a regular voice synthesizing method comprises the steps of developing meter patterns successively in the direction of a time axis according to the velocity and pitch of a voice but not dependent on phonemes, and generating a voice waveform according to the meter patterns as well as to voice tone data selected according to similarity based on information indicating the attribute of voice tone included in voice-generating information. Accordingly, the voice can be reproduced with a type of voice tone having the highest similarity without using unsuitable types of voice tone. Also, a displacement in the patterns for the pitch of a voice is not generated when the voice waveform is generated. As a result, it is possible to reproduce a voice with high quality.

With the present invention, a regular voice synthesizing method comprises the steps of developing meter patterns successively in the direction of a time axis according to the velocity and pitch of a voice not dependent on phonemes, and generating a voice waveform according to the meter patterns as well as to voice tone data selected according to information indicating a type and attribute of voice tone included in the voice-generating information. Accordingly, the voice can be reproduced with a type of voice tone having highest similarity without using an unsuitable type of voice tone, even though there is no directly specified type of voice tone. Also, a displacement in the patterns for the pitch of a voice is not generated when the voice waveform is generated. As a result, it is possible to reproduce a voice with high quality.

With the present invention, a regular voice synthesizing method comprises the steps of developing meter patterns successively in the direction of a time axis according to voice-generating information, and generating a voice waveform according to the meter patterns as well as to voice tone data selected according to the voice-generating information. Accordingly, a voice can be reproduced with a preferable type of voice tone without limiting the voice to any specific tone. Also, a displacement in patterns for pitch of a voice is not generated when the voice waveform is generated. As a result, it is possible to reproduce the voice with high quality.

With the present invention, a regular voice synthesizing method comprises the steps of developing meter patterns successively in the direction of a time axis according to voice-generating information, and generating a voice waveform according to the meter patterns as well as to voice tone data selected according to information indicating the types of voice tone that are included in the voice-generating information. Accordingly, a voice can be reproduced with a most suitable type of voice tone specified directly from a plurality types of voice tone without limiting the voice tone to any specific tone. Also, a displacement in the patterns for the pitch of a voice is not generated when the voice waveform is generated. As a result, it is possible to reproduce the voice with high quality.

With the present invention, a regular voice synthesizing method comprises the steps of developing meter patterns successively in the direction of a time axis according to voice-generating information, and generating a voice waveform according to the meter patterns as well as to voice tone data selected according to a similarity based on information indicating attribute of voice tone included in the voice-generating information. Accordingly, a voice can be reproduced with a type of voice tone having a highest similarity without using unsuitable types of voice tone. Also, a displacement in patterns for the pitch of a voice is not generated when the voice waveform is generated. As a result, it is possible to reproduce the voice with high quality.

With the present invention, a regular voice synthesizing method comprises the steps of developing meter patterns successively in the direction of a time axis according to voice-generating information, and generating a voice waveform according to the meter patterns as well as to voice tone data selected according to information indicating a type and attribute of a voice tone included in the voice-generating information. Accordingly, a voice can be reproduced with a type of voice tone having a highest similarity without using an unsuitable type of voice tone even though a voice tone directly specified is not available. Also, a displacement in patterns for the pitch of a voice is not generated when the voice waveform is generated. As a result, it is possible to reproduce the voice with high quality.

With the present invention, a regular voice synthesizing method comprises the step of shifting a reference for pitch of a voice in a voice-generating information storing means to a reference for pitch of a voice in a voice tone data storing means when the voice is reproduced; whereby pitch for each voice relatively changes according to the shifted reference of voice pitch, regardless of a time zone for a phoneme. As a result, the reference for voice pitch becomes closer to that for voice tone, which makes it possible to improve the quality of the voice.

With the present invention, a regular voice synthesizing method comprises a step of shifting a reference for pitch of a voice in a voice-generating information storing means according to a reference for any pitch of a voice when the voice is reproduced; whereby the pitch for each voice relatively changes according to the shifted reference of voice pitch regardless of a time zone for each phoneme. As a result, it is possible to process the voice tone by, for instance, making it closer to the intended voice quality according to the shift rate or other factor.

With the present invention,a regular voice making/editing method comprises the steps of making voice-generating information by providing voice data for at least one of velocity and pitch of a voice, based on an inputted natural voice, so that each voice data is not dependent on a time lag between phonemes and has a level relative to a reference, and filing the voice-generating information in the voice-generating information storing means. Accordingly, it is possible to specify the velocity and pitch of voice at an arbitrary point of time that is not dependent on the time lag between phonemes.

With the present invention, a regular voice making/editing method comprises the steps of providing voice data for at least one of velocity and pitch of a voice based on an inputted natural voice so that the voice data is not dependent on a time lag between phonemes and has a level relative to a reference, making voice-generating information including types of voice tone, and filing the voice-generating information in a voice-generating information storing means. Accordingly, it is possible to specify velocity and pitch of a voice at an arbitrary point of time that is not dependent on the time lag between phonemes and also to specify a type of voice tone in the voice-generating information.

With the present invention, a regular voice making/editing method comprises the steps of providing voice data for at least one of velocity and pitch of a voice based on an inputted natural voice so that the voice data is not dependent on a time lag between phonemes and has a level relative to a reference, making voice-generating information including an attribute of voice tone, and filing the voice-generating information in a voice-generating information storing means. Accordingly, it is possible to specify velocity and pitch of a voice at an arbitrary point of time that is not dependent on the time lag between phonemes and also to specify an attribute of voice tone in the voice-generating information.

With the present invention, a regular voice making/editing method comprises the steps of providing voice data for at least one of velocity and pitch of a voice based on an inputted natural voice so that the voice data is not dependent on a time lag between phonemes and has a level relative to a reference, making voice-generating information including a type and attribute of voice tone, and filing the voice-generating information in a voice-generating information storing means. Accordingly, it is possible to specify velocity and pitch of a voice at an arbitrary point of time not dependent on the time that is lag between phonemes and also to specify a type or an attribute of voice tone in the voice-generating information.

With the present invention, a regular voice making/editing method comprises the steps of making voice-generating information, including data on phoneme and meter, as information based on an inputted natural voice, and filing the voice-generating information in the voice-generating information storing means; whereby it is possible to make the voice-generating information for selection of voice tone.

With the present invention, a regular voice making/editing method comprises the steps of producing voice-generating information, including data on phoneme and meter, based on an inputted natural voice as well as a type of voice tone, and filing the voice-generating information in the voice-generating information storing means; whereby it is possible to specify velocity and pitch of a voice at an arbitrary point of time that is not dependent on the time lag between phonemes and also to specify a type of voice tone in the voice-generating information.

With the present invention, a regular voice making/editing method comprises the steps of producing voice-generating information, including data on phoneme and meter, based on an inputted natural voice as well as an attribute of voice tone, and filing the voice-generating information in the voice-generating information storing means; whereby it is possible to specify velocity and pitch of a voice at an arbitrary point of time that is not dependent on the time lag between phonemes and also to specify an attribute of voice tone in the voice-generating information.

With the present invention, a regular voice making/editing method comprises the steps of producing voice-generating information, including data on phoneme and meter, based on an inputted natural voice as well as a type and an attribute of voice tone, and filing the voice-generating information in the voice-generating information storing means; whereby it is possible to specify velocity and pitch of a voice at an arbitrary point of time that is not dependent on the time lag between phonemes and also to specify a type or an attribute of voice tone in the voice-generating information.

With the present invention, meter patterns arranged successively in the direction of a time axis are developed according to the velocity and pitch of a voice not dependent on phonemes, and a voice waveform is generated according to the meter patterns as well as to voice tone data selected according to voice-generating information; whereby the voice can be reproduced with a preferable type of voice tone without limiting the voice tone to any specific tone. Also, a displacement in patterns for the pitch of a voice that is not generated when the voice waveform is generated. As a result, it is possible to reproduce a voice with high quality.

With the present invention, meter patterns arranged successively in the direction of time axis are developed according to the velocity and pitch of a voice that is not dependent on phonemes, and a voice waveform is generated according to the meter patterns as well as to voice tone data selected according to information indicating the types of voice tone included in the voice-generating information; whereby the voice can be reproduced with a most suitable type of voice tone specified directly from a plurality types of voice tone without limiting the voice tone to any specific tone. Also, a displacement in patterns for the pitch of a voice is not generated when the voice waveform is generated. As a result, it is possible to reproduce a voice with high quality.

With the present invention, meter patterns arranged successively in the direction of a time axis are developed according to the velocity and pitch of a voice that is not dependent on phonemes, and a voice waveform is generated according to the meter patterns as well as to the voice tone data selected according to a similarity based on information indicating an attribute of voice tone included in voice-generating information. Accordingly, the voice can be reproduced with a type of voice tone having the highest similarity without using unsuitable types of voice tone. Also, a displacement in patterns for the pitch of a voice is not generated when the voice waveform is generated. As a result, it is possible to reproduce a voice with high quality.

With the present invention, meter patterns arranged successively in the direction of a time axis are developed according to the velocity and pitch of a voice that is not dependent on phonemes, and a voice waveform is generated according to the meter patterns as well as to the voice tone data selected according to information indicating a type and attribute of voice tone included in voice-generating information. Accordingly, the voice can be reproduced with a type of voice tone having a highest similarity without using an unsuitable type of voice tone even though there is no directly specified type of voice tone. Also, a displacement in patterns for the pitch of a voice is not generated when the voice waveform is generated. As a result, it is possible to reproduce a voice with high quality.

With the present invention, meter patterns arranged successively in the direction of a time axis are developed according to voice-generating information, and a voice waveform is generated according to the meter patterns as well as to the voice tone data selected according to the voice-generating information; whereby a voice can be reproduced with a preferable type of voice tone without limiting the voice tone to any specific tone. Also, a displacement in patterns for pitch of a voice is not generated when the voice waveform is generated. As a result, it is possible to reproduce the voice with high quality.

With the present invention, meter patterns arranged successively in the direction of time axis are developed according to voice-generating information, and a voice waveform is generated according to the meter patterns as well as to the voice tone data selected according to information indicating the types of voice tone that are included in the voice-generating information; whereby a voice can be reproduced with a most suitable type of voice tone specified directly from a plurality types of voice tone without limiting the voice tone to any specific tone. Also, a displacement in patterns for the pitch of a voice is not generated when the voice waveform is generated. As a result, it is possible to reproduce the voice with high quality.

With the present invention, meter patterns arranged successively in the direction of a time axis are developed accordingly to voice-generating information, and a voice waveform is generated according to the meter patterns as well as to the voice tone data selected according to similarity, based on information indicating an attribute of voice tone included in the voice-generating information. Accordingly, a voice can be reproduced with a type of voice tone having a highest similarity without using unsuitable types of voice tone. Also, a displacement in patterns for the pitch of a voice is not generated when the voice waveform is generated. As a result, it is possible to reproduce the voice with high quality.

With the present invention, meter patterns, arranged successively in the direction of a time axis according to the velocity and pitch of a voice, that are not dependent on phonemes are developed, and a voice waveform is generated according to the meter patterns as well as to the voice tone data selected according to a type and attribute of voice tone included in the voice-generating information. Accordingly, a voice can be reproduced with a type of voice tone having highest similarity without using an unsuitable type of voice tone even though there is not a directly specified type of voice tone. Also, a displacement in patterns for the pitch of a voice is not generated when the voice waveform is generated. As a result, it is possible to reproduce the voice with high quality.

With the present invention, a reference for pitch of a voice in a voice-generating information storing means is shifted according to a reference for pitch of a voice in a voice tone data storing means when the voice is reproduced; whereby pitch for each voice relatively changes according to the shifted reference of voice pitch regardless of a time zone for each phoneme. As a result, the reference for voice pitch becomes closer to that for voice tone, which makes it possible to improve quality of the voice.

With the present invention, a reference for pitch of a voice in a voice-generating information storing means is shifted according to a reference for arbitrary pitch of a voice when the voice is reproduced; whereby pitch for each voice relatively changes according to the shifted reference of voice pitch regardless of a time zone for each phoneme. As a result, it is possible to process the voice tone by making it closer to intended voice quality according to the shift rate or other factor.

With the present invention, voice-generating information is made by providing voice data for at least one of velocity and pitch of a voice based on an inputted natural voice so that each voice data is not dependent on a time lag between phonemes and has a level relative to a reference, and the voice-generating information is stored in a voice-generating information storing means; whereby it is possible to specify velocity and pitch of a voice at an arbitrary point of time not dependent on the time lag between phonemes.

With the present invention, voice data for at least one of velocity and pitch of a voice based on an inputted natural voice is dispersed so that the voice data is not dependent on a time lag between phonemes and has a level relative to a reference, voice-generating information including types of voice tone is made and filed in a voice-generating information storing means; whereby it is possible to specify velocity and pitch of a voice at an arbitrary point of time not dependent on the time lag between phonemes and also to specify a type of voice tone in the voice-generating information.

With the present invention, voice data for at least one of velocity and pitch of a voice based on an inputted natural voice is outputted so that the voice data is not dependent on a time lag between phonemes and has a level relative to a reference, voice-generating information including an attribute of voice tone is made and filed in a voice-generating information storing means; whereby it is possible to specify velocity and pitch of a voice at an arbitrary point of time not dependent on the time lag between phonemes and also to specify an attribute of voice tone in the voice-generating information.

With the present invention, voice data for at least one of velocity and pitch of a voice based on an inputted natural voice is dispersed so that the voice data is not dependent on a time lag between phonemes and has a level relative to a reference, voice-generating information including a type and attribute of voice tone is produced and stored in the voice-generating information storing means. Accordingly, it is possible to specify the velocity and pitch of a voice at an arbitrary point of time that is not dependent on the time lag between phonemes and also to specify a type or an attribute of voice tone in a voice-generating information.

With the present invention, voice-generating information, including data on phoneme and meter, as information based on an inputted natural voice is generated and stored in the voice-generating information storing means; whereby it is possible to make the voice-generating information for selection of a type of voice tone.

With the present invention, voice-generating information, including data on phoneme and meter, based on an inputted natural voice as well as a type of voice tone, is generated and stored in a voice-generating information storing means; whereby it is possible to specify velocity and pitch of a voice at an arbitrary point of time that is not dependent on the time lag between phonemes, and also to specify a type of voice tone in the voice-generating information.

With the present invention, voice-generating information, including data on phoneme and meter, based on an inputted natural voice as well as an attribute of voice tone is generated and stored in a voice-generating information storing means; whereby it is possible to specify the velocity and pitch of a voice at an arbitrary point of time not dependent on the time lag between phonemes, and also to specify an attribute of voice tones in the voice-generating information.

With the present invention, voice-generating information, including data on phoneme and meter, based on an inputted natural voice as well as a type and an attribute of voice tone is generated and stored in a voice-generating information storing means; whereby it is possible to specify the velocity and pitch of a voice at an arbitrary point of time that is not dependent on the time lag between phonemes, and also to specify a type or an attribute of voice tone in the voice-generating information.

Other objects and features of this invention will become understood from the following description with reference to the accompanying drawings.

BRIEF DESCRIPTION OF THE DRAWINGS

FIG. 2 is a view showing an example of a memory configuration of a voice tone section in a voice tone data storing section according to the invention;

FIG. 4 is a view showing an example of memory configuration in a phoneme table for vocalizing a voice in a Japanese language phoneme table;

FIG. 5 is a view showing an example of memory configuration in a phoneme table for devocalizing a voice in a Japanese language phoneme table;

FIG. 7 is a view showing an example of a memory configuration in a voice-generating information storing section according to an embodiment of the invention;

FIG. 8 is a view showing an example of header information included in voice-generating information according to an embodiment of the invention;

FIG. 11 is a view explaining the content of levels of voice velocity;

FIGS. 12A and 12B are views showing an example of a configuration of a control event included in voice-making information;

FIG. 29 is a view showing an example of configuration of header information according to Variant 3 of the invention;

FIG. 30 is a view showing an example of configuration of voice tone attribute included in the header information shown in FIG. 29;

FIG. 31 is a view showing an example of configuration of a voice tone section according to Variant 3 of the invention;

FIG. 32 is a view showing an example of configuration of an voice tone attribute included in the voice tone section shown in FIG. 31;

DESCRIPTION OF THE PREFERRED EMBODIMENTS

Detailed description is made hereinafter for preferred embodiments of the present invention with reference to the related drawings.

Figure 1:
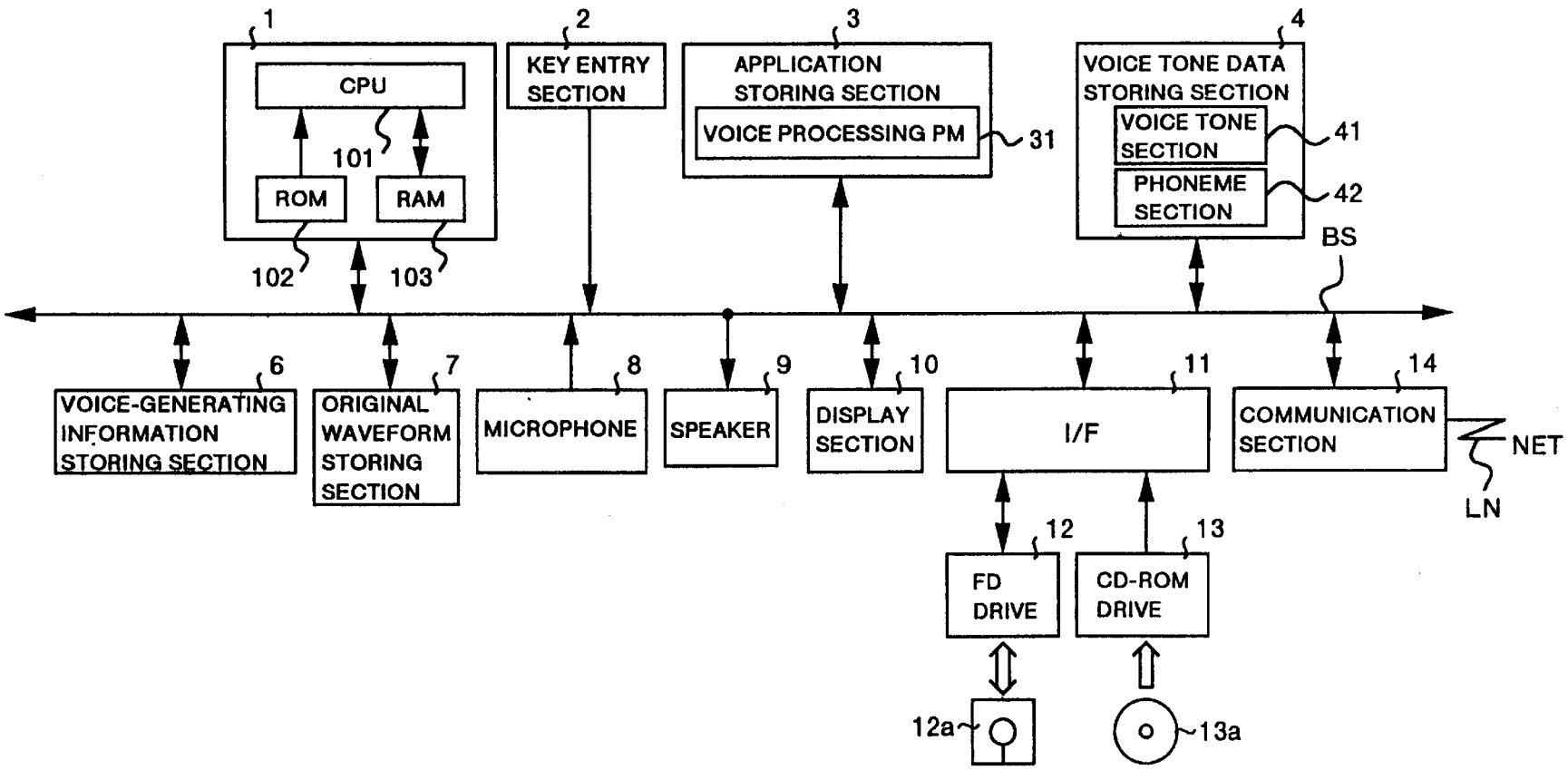
FIG. 1 is a block diagram showing a regular voice synthesizing apparatus according to one of the embodiments of the present invention.

At first, description is made for the entire configuration thereof. FIG. 1 is a block diagram showing a regular voice synthesizing apparatus according to one of the embodiments of the present invention.

The regular voice synthesizing apparatus comprises units such as a control section 1, a key entry section 2, an application storing section 3, a voice tone data storing section 4, a voice-generating information storing section 6, an original waveform storing section 7, a microphone 8, a speaker 9, a display section 10, an interface (I/F) 11, an FD drive 12, a CD-ROM drive 13, and a communication section 14 or the like.

The control section 1 is a central processing unit for controlling each of the units coupled to a bus BS. This control section 1 controls operations such as the detection of key operation in the key entry section 2, the execution of applications, the addition or deletion of information on voice tone, phoneme, and voice-generation, making and transaction of voice-generating information, storage of data on original waveforms, and forming various types of display screen or the like.

This control section 1 comprises a CPU 101, a ROM 102, and a RAM 103 or the like. The CPU 101 operates according to an OS program stored in the ROM 102 as well as to an application program (a voice processing PM (a program memory) 31 or the like) stored in the application storing section 3.

The ROM 102 is a storage medium storing therein the OS (operating system) program or the like, and the RAM 103 is a memory used for the various types of programs described above as a work area, and is also used when data for a transaction is temporarily stored therein.

The key entry section 2 comprises input devices such as various types of keys and a mouse so that the control section 1 can detect any instruction for file preparation, transaction, or filing on voice-generating information as well as for file transaction or filing or the like by the voice tone data storing section 4 each as a key signal.

The application storing section 3 is a storage medium storing therein application programs such as a voice processing PM 31 or the like. As for the application storing section 3, operations such as addition, change, or deletion of the program of this voice processing PM 31 can be executed through other storage medium such as a communication net NET, an FD (floppy disk), or a CD (compact disk)—ROM or the like.

Figure 14:
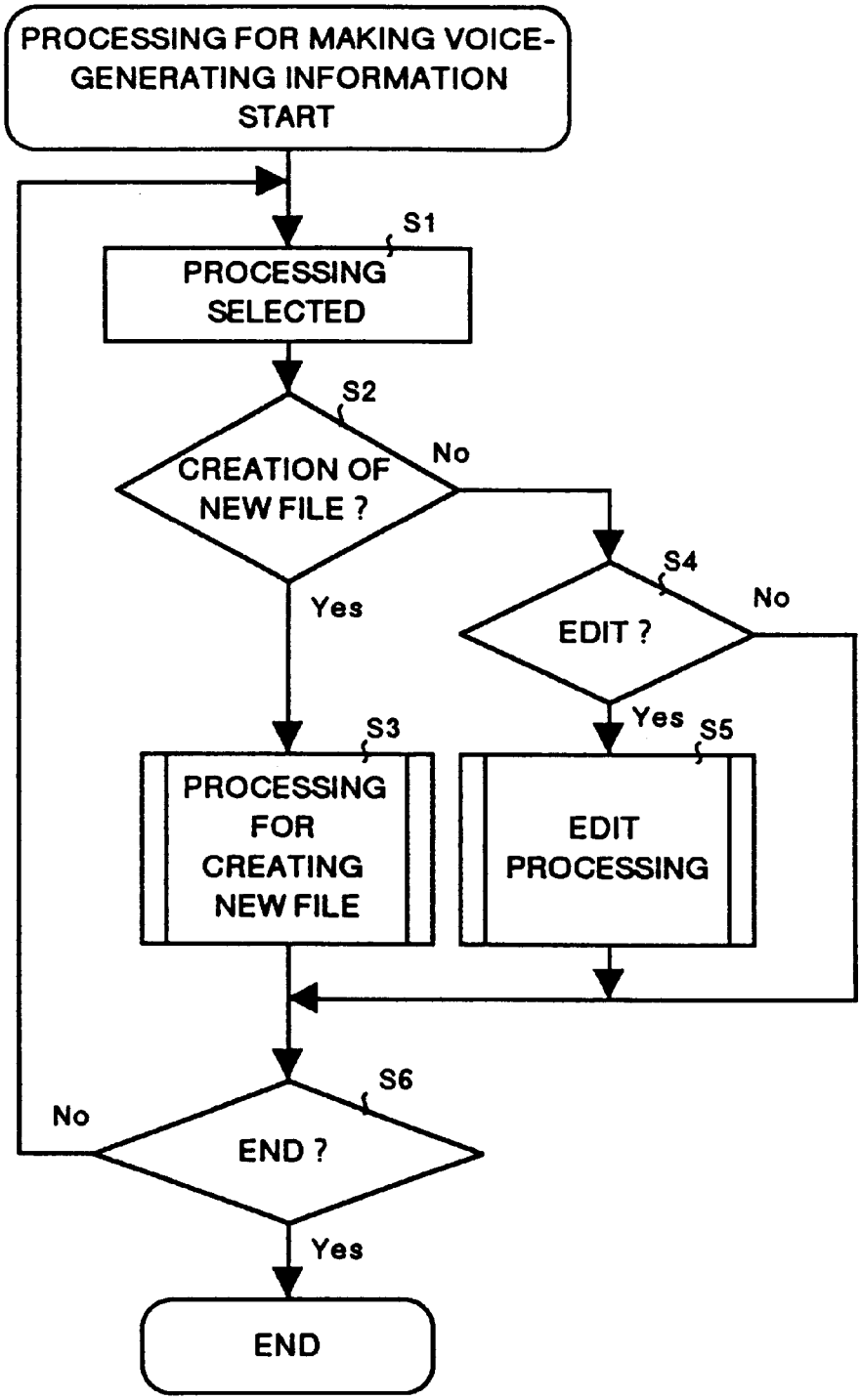
FIG. 14 is a flow chart explaining the voice-generating information making processing according to the invention.
Figure 15:
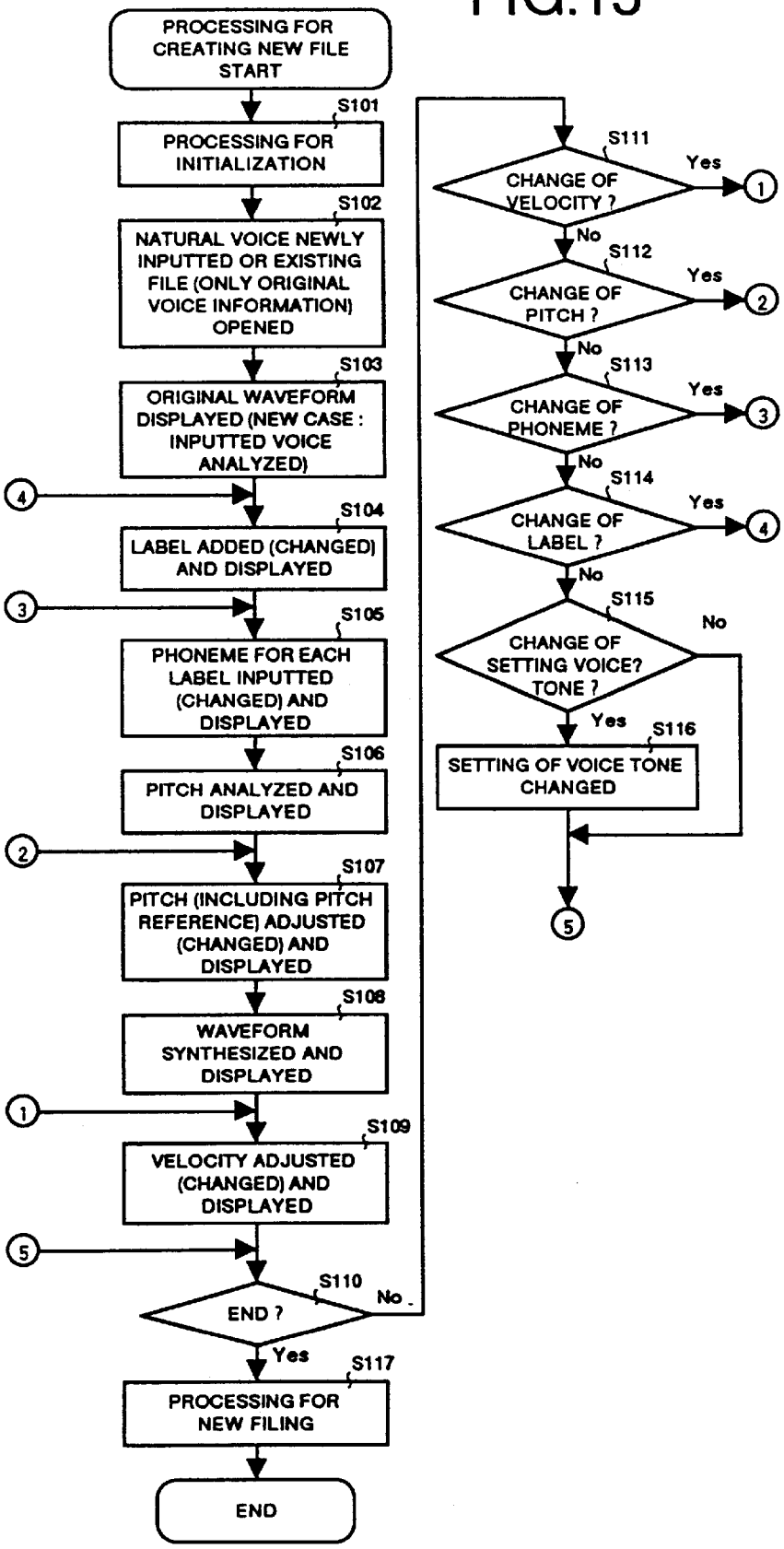
FIG. 15 is a flow chart explaining newly making processing according to the invention.
Figure 16:
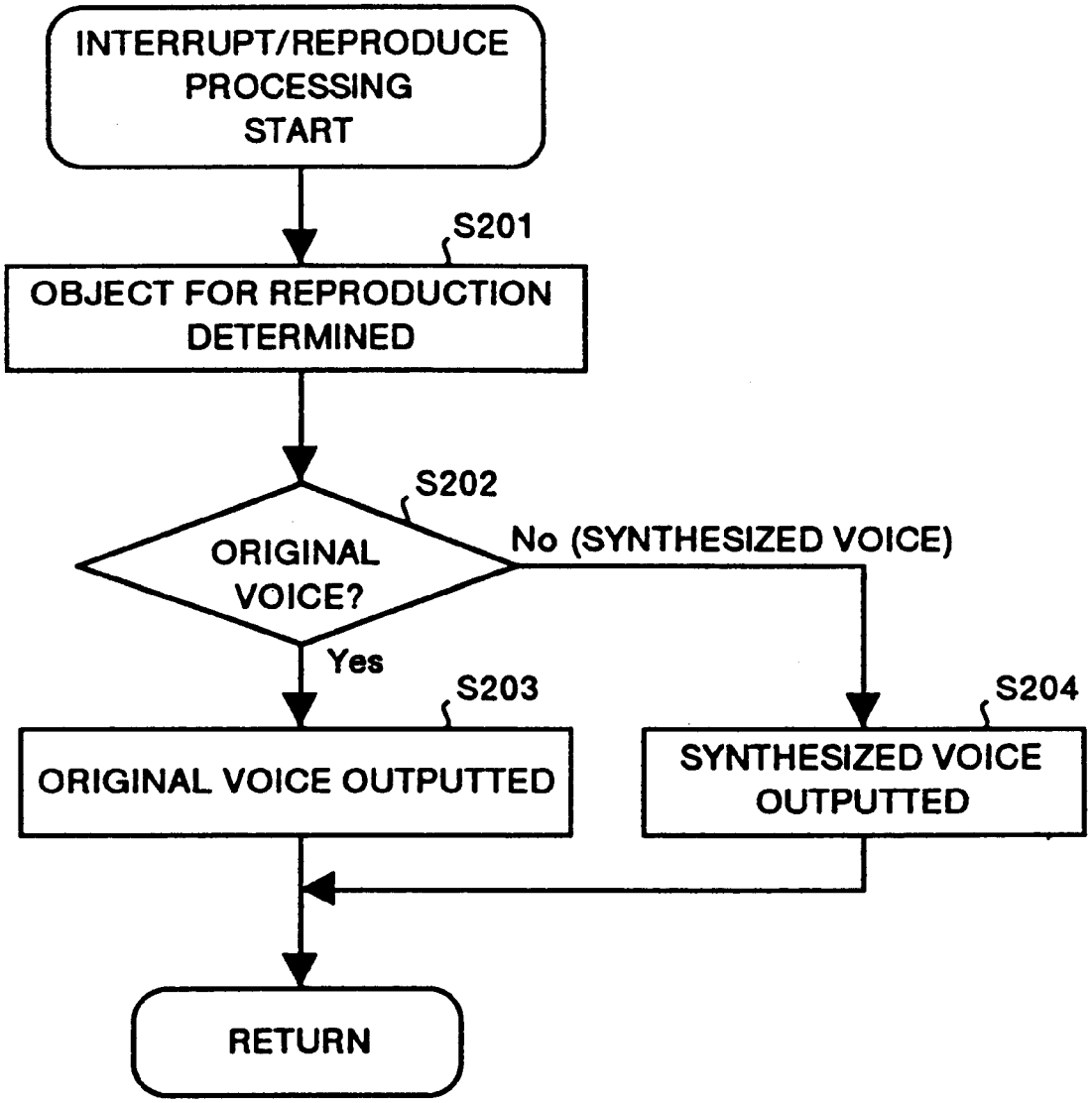
FIG. 16 is a flow chart explaining the interrupt/reproduce processing according to the invention.
Figure 25:
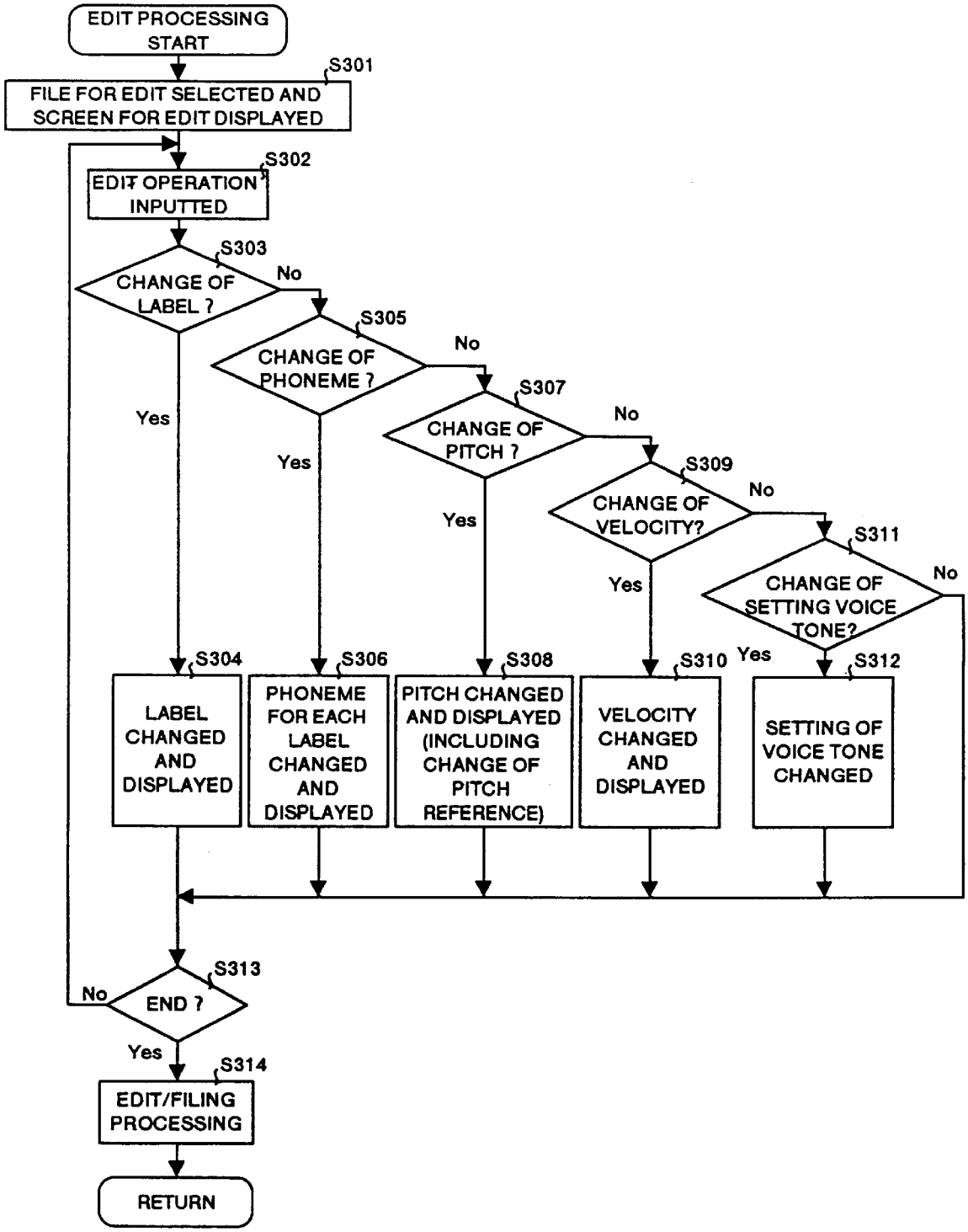
FIG. 25 is a flow chart explaining the editing processing according to the invention.
Figure 26:
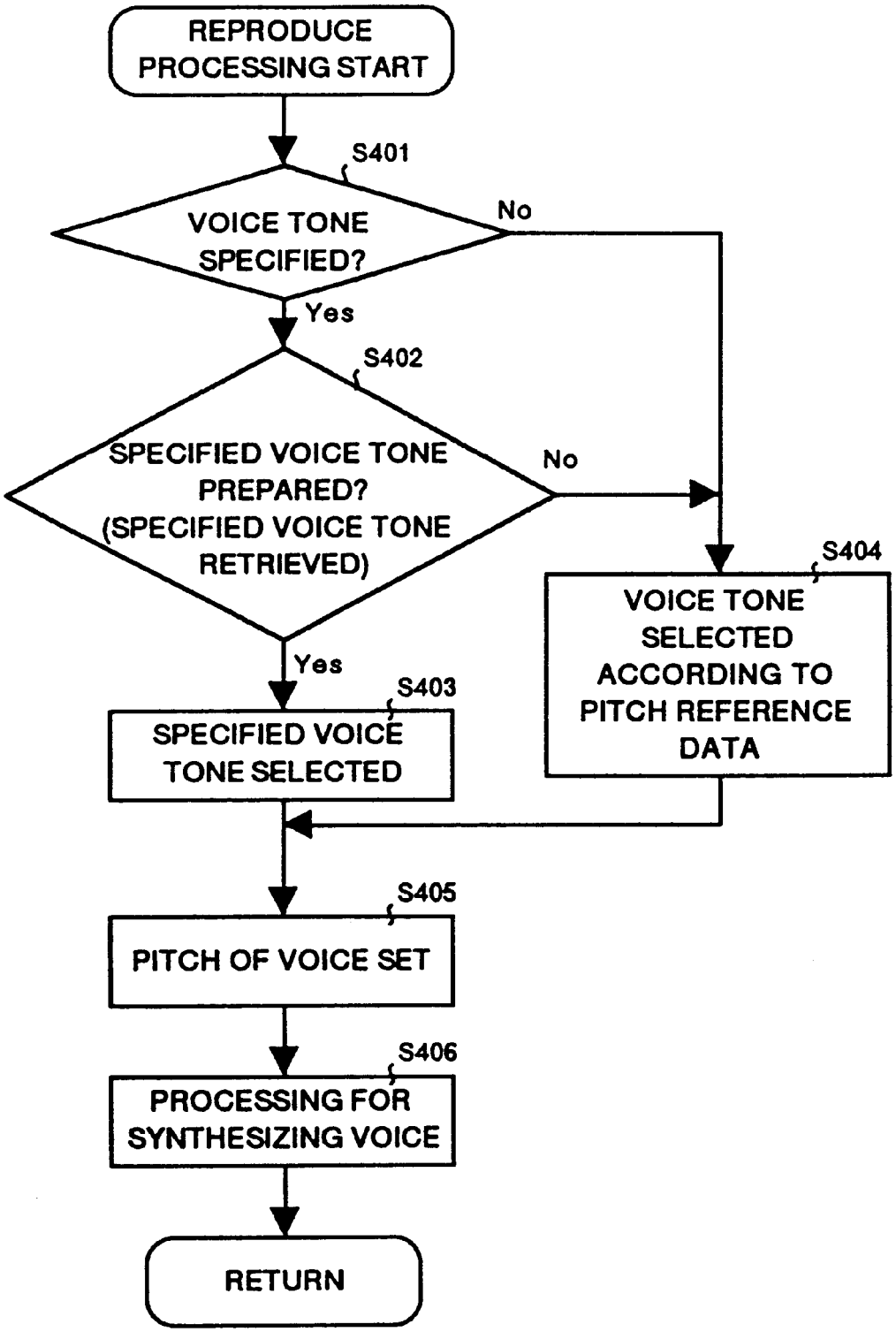
FIG. 26 is a flow chart explaining the reproducing processing according to the invention.

Stored in this voice processing PM 31 are programs for executing processing for making voice-generating information according to the flow chart shown in FIG. 14, creating a new file for voice-generating information according to the flow chart shown in FIG. 15, interrupt/reproduce according to the flow chart shown in FIG. 16, edit according to the flow chart shown in FIG. 25, and reproduce according to the flow chart shown in FIG. 26 or the like.

The processing for making voice-generating information shown in FIG. 14 includes such processing as new file creation, edit, and filing of voice-generating information (Refer to FIG. 7 to FIG. 12) which does not include voice tone data comprising spectrum information (e.g. cepstrum information) of a voice based on a natural voice.

The processing for creating a new file shown in FIG. 15 more specifically shows operations of creating a new file in the processing for making voice-generating information.

The interrupt/reproduce processing shown in FIG. 16 more specifically shows operations of reproducing a voice in a case where an operation of reproducing a voice is requested during the operation of creating a new file or editing data described above.

The editing processing shown in FIG. 25 more specifically shows editing operations in the processing for making voice-generating information, and an object for the edit is a file (voice-generating information) which has already been made.

The reproduction processing shown in FIG. 26 more specifically shows operations of reproducing a voice.

The voice tone data storing section 4 is a storage medium for storing therein voice tone data indicating various types of voice tone, and comprises a voice tone section 41 and a phoneme section 42. The voice tone section 41 selectably stores therein voice tone data indicating sound parameters of each raw voice element (such as a phoneme for each voice tone type, (Refer to FIG. 2), and the phoneme section 42 stores therein a phoneme table with a phoneme correlated to a phoneme code for each phoneme group to which each language belongs (Refer to FIG. 3 to FIG. 6).

In both the voice tone section 41 and phoneme section 42, it is possible to add thereto voice tone data or the content of the phoneme table or the like through the storage medium such as a communication line LN, an FD, a CD-ROM or the like, or delete any of those data therein through key operation in the key entry section 2.

The voice-generating information storing section 6 stores voice-generating information in units of file. This voice-generating information includes pronouncing information comprising a dispersed phoneme and dispersed meter information (phoneme groups, a time lag between vocalization or control over making voices, pitch of a voice, and velocity of a voice), and header information (languages, time resolution, specification of voice tone, a pitch reference indicating velocity of a voice as a reference, and a volume reference indicating volume as a reference) specifying the pronouncing information.

When a voice is to be reproduced, dispersed meters are developed into continuous meter patterns based on the voice-generating information, and voice tone data and a voice waveform indicating voice tone of a voice according to the header information are generated, whereby a voice can be reproduced.

The original waveform storing section 7 is a storage medium for storing therein a natural voice, in a state of waveform data, for preparing a file of voice-generating information. The microphone 8 is a voice input unit for inputting a natural voice required for the processing for preparing a file of voice-generating information or the like.

The speaker 9 is a voice output unit for outputting a voice of a synthesized voice or the like reproduced by the reproduction processing or the interrupt/reproduce processing.

The display section 10 is a display unit, such as an LCD, a CRT or the like, for forming a display on a screen that is related to the processing for preparing a file, transaction, and filing of voice-generating information.

The interface 11 is a unit for data transaction between a bus BS and the FD drive 12 or the CD-ROM drive 13. The FD drive 12 attaches thereto a detachable FD 12*a* (a storage medium) for executing operations of reading out data therefrom or writing it therein. The CD-ROM drive 13 attaches thereto a detachable CD-ROM 13*a* (a storage medium) for executing an operation of reading out data therefrom.

It should be noted that it is possible to update the contents stored in the voice tone data storing section 4 as well as in the application storing section 3 or the like if the information such as the voice tone data, phoneme table, and application program or the like is stored in the FD 12*a* or CD-ROM 13*a*.

The communication section 14 is connected to a communication line LN and executes communications with an external device through the communication line LN.

Next, a detailed description is made for the voice tone data storing section 4. FIG. 2 is a view showing an example of a memory configuration of the voice tone section 41 in the voice tone data storing section 4. The voice tone section 41 is a memory storing therein voice tone data VD1, VD2 . . . , as shown in FIG. 2, each corresponding to selection No. 1, 2 . . . respectively. For a type of voice tone, voice tone of men, women, children, adults, husky, or the like is employed. Pitch reference data PB1, PB2, . . . each indicating a reference of voice pitch are included in the voice tone data VD1, VD2, respectively.

Included in voice tone data are sound parameters of each synthesized unit (e.g. CVC or the like). As the sound parameters, LSP parameters, cepstrum, or one-pitch waveform data or the like are preferable.

Figure 3:
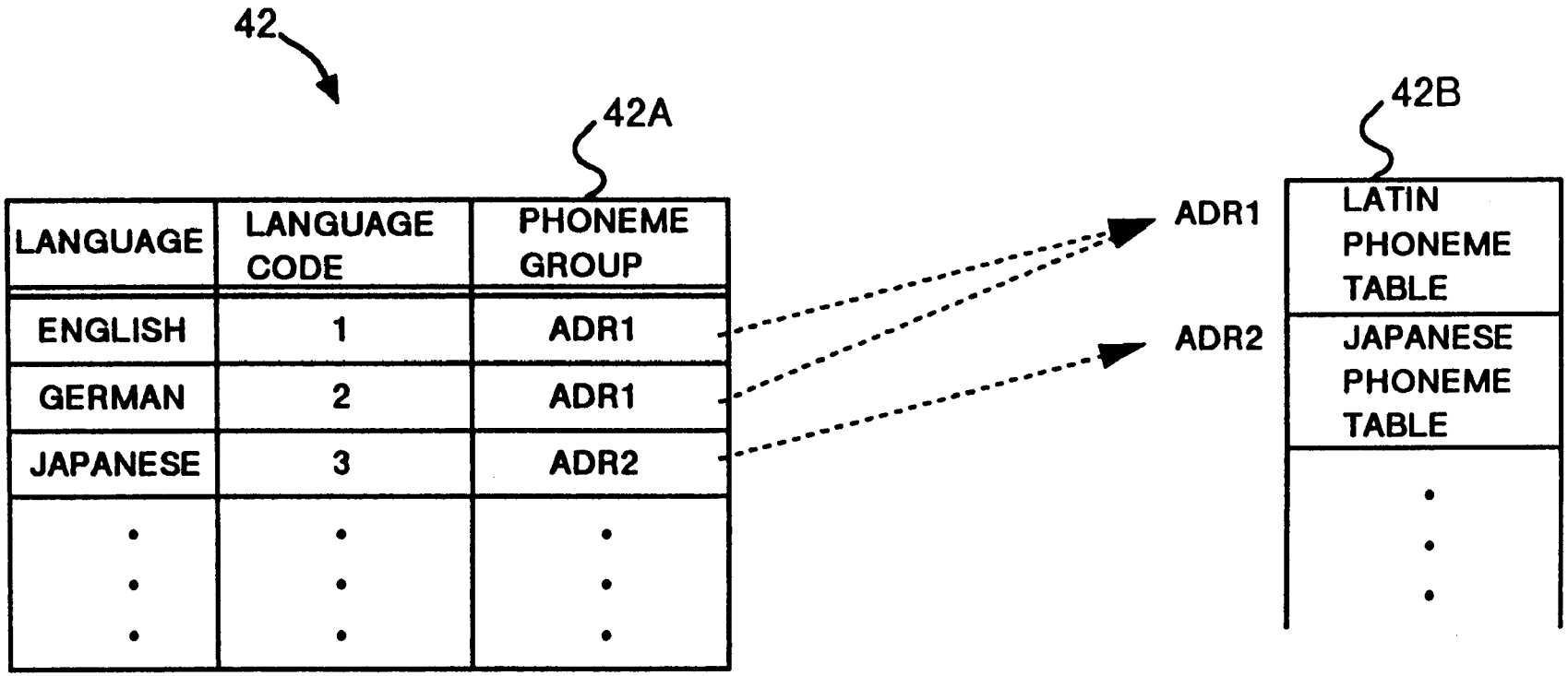
FIG. 3 is a view showing an example of a memory configuration in a phoneme section in a voice tone data storing section.
Figure 6:
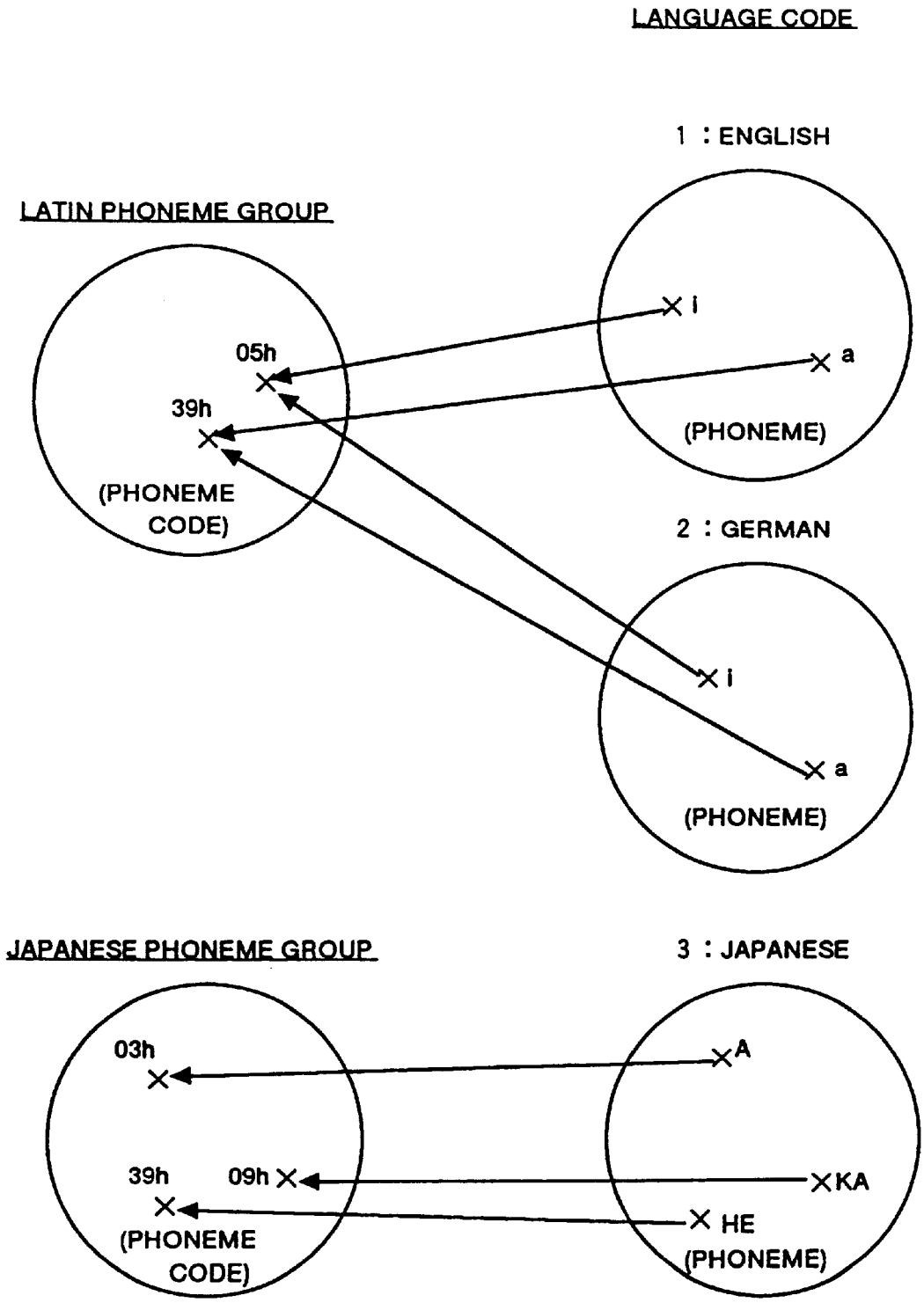
FIG. 6 is a view explaining the correlation between a phoneme and phoneme code for each language code in the phoneme data section.

Next description is made for the phoneme section 42. FIG. 3 is a view showing an example of memory configuration of the phoneme section 42 in the voice tone data storing section 4, FIG. 4 is a view showing an example of memory configuration of a vocalized phoneme table 5A of a Japanese phoneme table, FIG. 5 is a view showing an example of memory configuration of a devocalized phoneme table 5B of the Japanese phoneme table, and FIG. 6 is a view showing the correspondence between a phoneme and a phoneme code of each language code in the phoneme section 42.

The phoneme section 42 is a memory storing therein a phoneme table 42A correlating a phoneme group to each language code of any language such as English, German, or Japanese or the like and a phoneme table 42B indicating the correspondence between a phoneme and a phoneme code of each phoneme group.

A language code is added to each language, and there is a one-to-one correspondence between any language and a language code. For instance, the language code "1" is added to English, the language code "2" to German, and the language code "3" to Japanese respectively.

Any phoneme group specifies a phoneme table correlated to each language. For instance, in a case of English and German, the phoneme group thereof specifies address ADR1 in the phoneme table 42B, and in this case a Latin phoneme table is used. In a case of Japanese, the phoneme group thereof specifies address ADR2 in the phoneme table 42B, and in this case a Japanese phoneme table is used.

To be further more specific, a phoneme level is used as a unit of voice in Latin languages, for instance, in English and German. Namely, a set of one type of phoneme codes corresponds to characters of a plurality types of language. On the other hand, in a case of languages like Japanese, any one of phoneme codes and a character are in a substantially one-to-one correspondence.

Also, the phoneme table 42B is data in a table system showing correspondence between phoneme codes and phonemes. This phoneme table 42B is provided in each phoneme group, and for instance, the phoneme table (Latin phoneme table) for Latin languages (English, German) is stored in address ADR1 of the memory, and the phoneme table (Japanese phoneme table) for Japanese language is stored in address ADR2 thereof.

For instance, the phoneme table (the position of address ADR2) corresponding to the Japanese language comprises, as shown in FIG. 4 and FIG. 5, the vocalized phoneme table 5A and the devocalized phoneme table 5B.

In the vocalized phoneme table 5A shown in FIG. 4, phoneme codes for vocalization correspond to vocalized phonemes (character: expressed by a character code) respectively. A phoneme code for vocalization comprises one byte and, for instance, the phoneme code 03h (h: a hexadecimal digit) for vocalization corresponds to a character of "A" as one of the vocalized phonemes.

A phoneme in which a sign "○" is added to each of the characters in the Ka-line on the right above the character indicates a phonetic rule in which the character is pronounced as a nasally voiced sound. For instance, phonetic expression with a nasally voiced sound to the characters "Ka" to "Ko" corresponds to phoneme codes 13h to 17h of vocalized phonemes.

In the devocalized phoneme table 5B shown in FIG. 5, phoneme codes for devocalization correspond to devocalized phonemes (character: expressed by a character code) respectively. In this embodiment, a phoneme code for devocalization also comprises one byte and, for instance, the phoneme code A0h for devocalization corresponds to a character of "Ka" ("U/Ka") as one of the devocalized phonemes. A character of "U" is added to each of devocalized phonemes in front of each of the characters.

For instance, in a case where a language code is "3" which indicates Japanese language, the Japanese phoneme table in address ADR2 is used. With this operation, as one of the examples shown in FIG. 6, characters of "A", "Ka", "He" correspond to phoneme codes 03h, 09h, 39h respectively.

Also, in a case where the language is English or German, the Latin phoneme table in address ADR1 is used. With this operation, as one of the examples shown in FIG. 6, phonemes in English of "a", "i" correspond to phoneme codes 39h, 05h respectively, and phonemes in German of "a", "i" also correspond to the phoneme codes 39h, 05h respectively.

As described above, as one of the examples shown in FIG. 6, for instance, the common phoneme codes 39h, 05h are added to the phonemes of "a", "i" each in common between English and German respectively.

Figure 9:
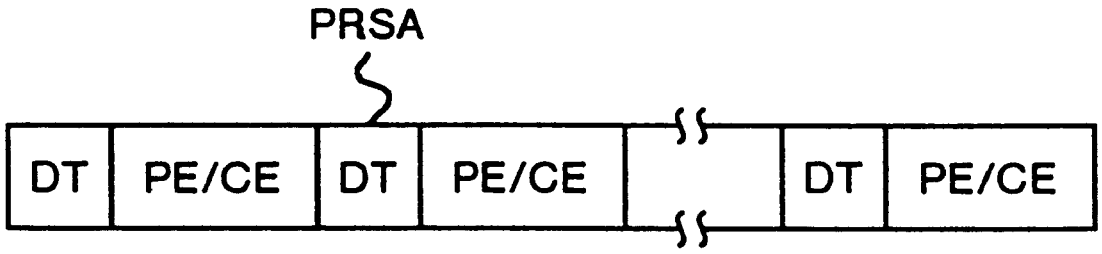
FIG. 9 is a view showing an example of a configuration of pronouncing information included in voice-generating information.
Figure 10A:
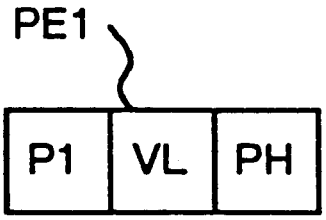
FIGS. 10A to 10C are views showing an example of a configuration of a pronouncing event included in voice-making information.
Figure 10B:
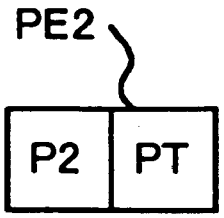
Figure 10C:
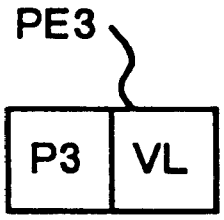

Next description is made for the voice-generating information storing section 6. FIG. 7 is a view showing an example of memory configuration of the voice-generating information storing section 6, FIG. 8 is a view showing an example of header information in voice-generating information, FIG. 9 is a view showing an example of pronouncing information in the voice-generating information, FIG. 10 is a view showing an example of a configuration of a pronouncing event in the pronouncing information, FIG. 11 is a view for explanation of the contents of levels of the velocity, and FIG. 12 is a view showing an example of a configuration of a control event in the pronouncing information.

The voice-generating information storing section 6 stores voice-generating information, as shown in FIG. 7, corresponding to files A, B, C. For instance, the section 6 stores the voice-generating information for the file A in which the header information HDRA and the pronouncing information PRSA are correlated to each other. Similarly, the section 6 stores the voice-generating information for the file B in which the header information HDRB and the pronouncing information PRSB are correlated to each other, and also stores the voice-generating information for the file C in which the header information HDRC and the pronouncing information PRSC are correlated to each other.

Herein, description is made for voice-generating information for the file A as an example. FIG. 8 shows the header information HDRA for the file A. This header information HDRA comprises an phoneme group PG, language codes LG, time resolution TD, voice tone data specifying data VP, pitch reference data PB, and volume reference data VB.

The phoneme group PG and the language code LG are data for specifying a phoneme group and a language code in the phoneme section 42 respectively, and a phoneme table to be used for synthesizing a voice is specified with this data.

Data for time resolution TD is data for specifying a basic unit time for a time lag between phonemes. Data for specifying voice tone VP is data for specifying (selecting) a file in the voice tone section 41 when a voice is synthesized, and a type of voice tone, namely voice tone data used for synthesizing a voice is specified with this data.

Data for a pitch reference PB is data for defining pitch of a voice (a pitch frequency) as a reference. It should be noted that an average pitch is employed as an example of a pitch reference, but other than the average pitch, a different reference such as a maximum frequency or a minimum frequency or the like of pitch may be employed. When a voice waveform is synthesized, pitch can be changed in a range between an octave in an upward direction and an octave in a downward direction with pitch, for instance, according to this data for pitch reference PB as a reference.

Data for a volume reference VB is data for specifying a reference of entire volume.

FIG. 9 shows voice-generating information PRSA for the file A. The voice-generating information PRSA has configuration in which each time lag data DT and each event data (pronouncing event PE or control event CE) are alternately correlated to each other, and are not dependent on a time lag between phonemes.

The time lag data DT is data for specifying a time lag between event data. A unit of a time lag indicated by this time lag data DT is specified by time resolution TD in the header information of the voice-generating information.

The pronouncing event PE in the event data is data comprising a phoneme for making a voice, pitch of a voice for relatively specifying voice pitch, and velocity for relatively specifying a voice strength or the like.

The control event CE in the event data is data specified for changing volume or the like during the operation as control over parameters other than those specified in the pronouncing event PE.

Next detailed description is made for the pronouncing event PE with reference to FIG. 10 and FIG. 11.

There are three types of pronouncing event PE, as shown in FIG. 10, a phoneme event PE1, pitch event PE2, and velocity event PE3.

The phoneme event PE1 has configuration in which identifying information P1, velocity of a voice, and a phoneme code PH are correlated to each other, and is an event for specifying a phoneme as well as velocity of a voice.

The identifying information P1 added to the header of the phoneme event PE1 indicates the fact that a type of event is phoneme event PE1 in the pronouncing event PE.

The voice strength VL is data for specifying volume of a voice (velocity), and specifies the volume as a sensuous voice strength.

This voice strength VL is divided, for instance, to each 8-value of three bits and a sign of a musical sound is correlated to each of the values, and then, as shown in FIG. 11, silence, pianissimo (ppp) . . . fortissimo (fff) are correlated to a value "0", a value "1" . . . a value "7" respectively.

A value of an actual voice strength VL and a physical voice strength are dependent on voice tone data in voice synthesis, so that, for instance, both of the values of each voice strength VL of a vowel "A" and a vowel "I" may be set to a standard value, and a physical voice strength of the vowel "A" can be larger than that of the vowel "I" by the voice tone data if the standard value is used. It should be noted that, generally, an average amplitude power of the vowel "A" becomes larger than that of the vowel "I".

The phoneme code PH is data for specifying any phoneme code in each phoneme table (Refer to FIG. 3, FIG. 4, and FIG. 5) described above. In this embodiment, the phoneme code is one byte data.

The pitch event PE2 has a configuration in which identifying information P2 and voice pitch PT are correlated to each other, and is an event for specifying voice pitch at an arbitrary point of time. This pitch event PE2 can specify voice pitch independently from a phoneme (not dependent on a time lag between phonemes), and also can specify voice pitch at an extremely short time interval in the time division of one phoneme. These specification and the operations are essential conditions required for generating a high-grade meter.

The identifying information P2 added to the header of the pitch event PE2 indicates the fact that a type of event is pitch event in the pronouncing event PE.

Voice pitch PT does not indicate an absolute voice pitch, and is data relatively specified according to a pitch reference as a reference (center) indicated by the pitch reference data PB in the header information.

In a case where this voice pitch PT is one-byte data, a value is specified in a range between one octave in the upward direction and one octave in the downward direction with the pitch reference as a reference indicated by levels of 0 to 255. If voice pitch PT is defined with a pitch frequency f [Hz], the following equation (1) is obtained.

Namely, $$f=PBV\cdot((PT/256)^2+0.5\cdot(PT/256)+0.5) \quad (1)$$

Wherein, PBV indicates a value (Hz) of a pitch reference specified by the pitch reference data PB.

Reversely, a value of a pitch reference PT can be obtained from a pitch frequency f according to the following equation (2). The equation (2) is described as follows.

Namely, $$PT = 64 \cdot \left(\sqrt{((16 \cdot f / PBV) - 7) - 1}\right) \quad (2)$$

The velocity event PE3 has configuration in which identifying information P3 and velocity VL are correlated to each other, and is an event for specifying velocity at an arbitrary point of time. This velocity event PE3 can specify velocity of a voice independently from a phoneme (not dependent on a time lag between phonemes), and also can specify velocity of a voice at an extremely short time interval in the time division of one phoneme. These specifications and the operations are essential conditions required for generating a high-grade meter.

Velocity of a voice VL is basically specified for each phoneme, but in a case where the velocity of a voice is changed in the middle of one phoneme while the phoneme is prolonged or the like, velocity event PE3 can be additionally specified, independently from the phoneme, at an arbitrary point of time as required.

Next detailed description is made for control event CE with reference to FIGS. 12A and 12B.

The control event CE is event for specifying volume event CE1 (Refer to FIG. 12A) as well as pitch reference event CE2 (Refer to FIG. 12B).

The volume event CE1 has configuration in which identifying information C1 volume data VBC are correlated to each other, and is event for specifying volume reference data VB specified by the header information HDRA so that the data VB can be changed during the operation.

Namely this event is used when the entire volume level is operated to be larger or smaller, and a volume reference is replaced from the volume reference data VB specified by the header information HDRA to specified volume data VBC until the volume is specified by the next volume event CE1 in the direction of the time axis.

The identifying information C1 added to the header of the volume event CE1 indicates the volume of a voice which is one of several types of control event.

The pitch reference event CE2 has a configuration in which identifying information C2 and pitch reference data PBC are correlated to each other, and is event specified in a case where voice pitch exceeds a range of the voice pitch which can be specified by the pitch reference data PB specified by the header information HDRA.

Namely, this event is used when the entire pitch reference is operated to be higher or lower, and a pitch reference is replaced from the pitch reference data PB specified by the header information HDRA to the specified pitch reference data PBC until a pitch reference is specified by the next pitch reference event CE2 in the direction of a time axis. After the operation and thereafter, the voice pitch will be changed in a range between one octave in the upward direction and one octave in the downward direction according to the pitch reference data PBC as a center.

Figure 13:
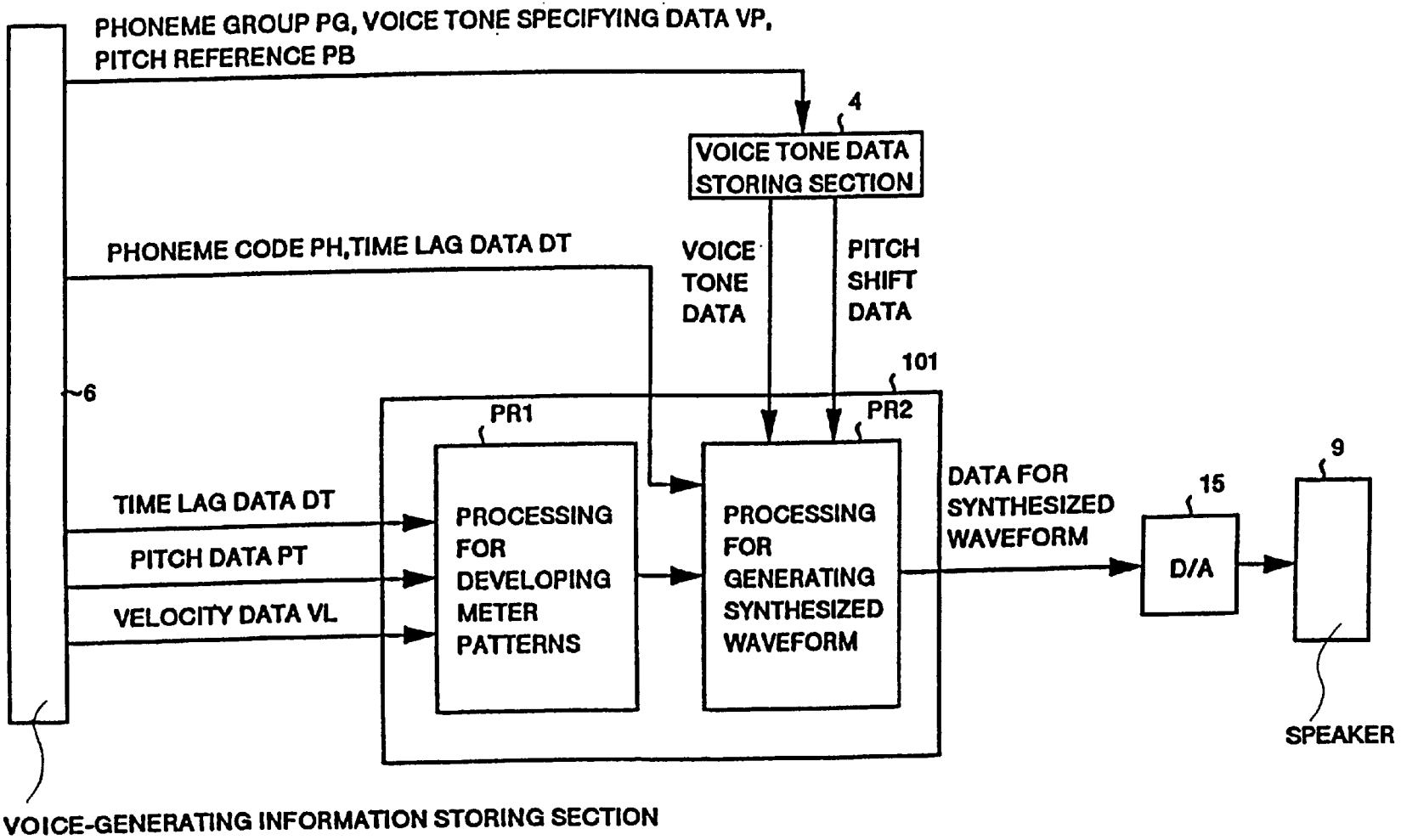
FIG. 13 is a block diagram conceptually explaining the voice reproducing processing according to the invention.

Next a description is made for voice synthesis. FIG. 13 is a block diagram for schematic explanation of voice reproducing processing according to the preferred embodiment.

The voice reproducing processing is an operation executed by the CPU 101 in the control section 1. Namely, the CPU 101 successively receives voice-generating information and generates data for a synthesized waveform through processing PR1 for developing meter patterns and processing PR2 for generating a synthesized waveform.

The processing PR1 for developing meter patterns is executed by receiving pronouncing information in the voice-generating information of the file stored in the voice-generating information storing section 6 and specifically read out, and developing meter patterns arranged successively in the direction of a time axis according to the data for the time lag DT, the voice pitch PT, and the velocity of a voice VL each in the pronouncing event PE. It should be noted that the pronouncing information PE has three types of event pattern as described above, so that pitch and velocity of a voice are specified in a time lag independent from the phoneme.

It should be noted that, in the voice tone data storing section 4, voice tone data is selected according to the phoneme group PG, voice tone specifying data VP, and pitch reference data PB each specified by the voice-generating information storing section 6, and pitch shift data for deciding a pitch value is supplied to the processing PR2 for generating a synthesized waveform. A time lag, pitch, and velocity are decided as relative values according to the time resolution TD, pitch reference data PB, and volume reference data VB as a reference respectively.

The processing PR2 for generating a synthesized waveform is executed by obtaining a series of each phoneme and a length of continuous time thereof according to the phoneme code PH as well as to the time lag data DT, and executing extendable processing for a length of a sound parameter as a corresponding synthesized unit selected from the voice tone data in the phoneme series.

Then, in the processing PR2 for generating a synthesized waveform, a voice is synthesized based on patterns of pitch and velocity arranged successively in time and obtained by the sound parameters and the processing PR1 for developing meter patterns to obtain data for a synthesized waveform.

It should be noted that an actual and physical pitch frequency is decided by the pattern and shift data each obtained by the processing PR1 for developing meter patterns.

The data for a synthesized waveform is converted from the digital data to analog data by a D/A converter 15 not shown in FIG. 1, and then a voice is outputted by the speaker 9.

Next description is made for operations.

At first, description is made for file processing of the regular voice synthesizing apparatus. FIG. 14 is a flow chart for explanation of the processing for making voice-generating information according to the preferred embodiment, FIG. 15 is a flow chart for explanation of the processing for creating a new file according to the embodiment, FIG. 16 is a flow chart for explanation of interrupt/reproduce processing according to the embodiment, FIG. 17 to FIG. 24 are views each showing how the state of the operation screen is changed when a new file is created, and FIG. 25 is a flow chart for explanation of edit processing according to the embodiment.

This file processing includes processing for making voice-generating information, interrupt/reproduce processing, and reproduce processing or the like. The processing for making voice-generating information includes processing for creating a new file and edit processing.

In the processing for making voice-generating information shown in FIG. 14, at first, the processing is selected according to the key operation of the key entry section 2 (step S1). Then the selected contents for processing is determined, and in a case where a result of the determination as creation of a new file is obtained (step S2), processing shifts to step S3 and the processing for creating a new file (Refer to FIG. 15) is executed therein. In a case where a result of the determination as an edit (step S4), processing shifts to step S5 and the edit processing (Refer to FIG. 20) is executed therein.

After any of the processing for creating a new file (step S3) and the edit processing (step S5) is ended, processing shifts to step S6 and a determination is made as to whether an instruction of an end is given or not. As a result, if it is determined that the instruction of an end is given, the processing is ended, and if it is determined that it is not given, processing returns to step S1 again.

Next a description is made of the processing used for creating a new file with reference to FIG. 17 to FIG. 24. In this processing for creating a new file, at first, header information and pronouncing information each constituting voice-generating information are initialized, and the screen for creation used for creating a file is also initialized (step S101).

Then, either by newly inputting a natural voice into the storing section with the microphone 8 or by opening the file of the original voice information (waveform data) already registered in the original waveform storing section 7 (step S102), the original waveform is displayed on the creation screen (step S103). It should be noted that, in a case a natural voice is newly inputted thereinto, the inputted natural voice is analyzed, is digitalized by the D/A converter 15, and then the waveform data is displayed on the display section 10.

Figure 17:
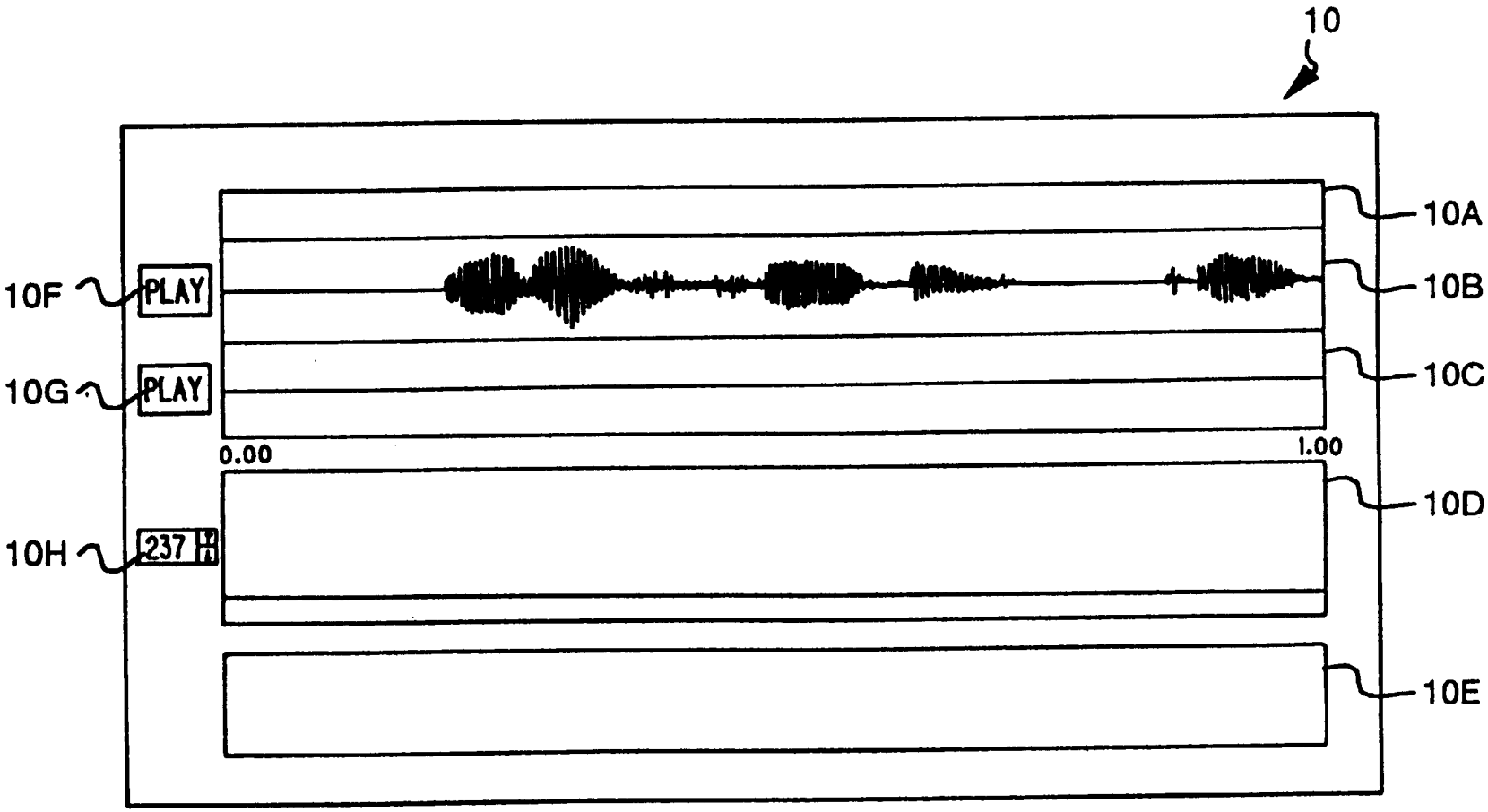
FIG. 17 is a view showing an example of state shifting of an operation screen according to the invention during the newly making processing.

A creation screen on the display section 10 comprises, as shown in FIG. 17, a phoneme display window 10A, an original waveform display window 10B, a synthesized waveform display window 10C, a pitch display window 10D, a velocity display window 10E, an original voice reproduce/stop button 10F, a synthesized voice-form reproduce/stop button 10G, and a scale 10H for setting a pitch reference.

The original waveform formed by inputting a voice or opening the file is displayed, as shown in FIG. 17, on the original waveform display window 10B of this creation screen.

Then in step S104, labels for time-dividing the phonemes are manually added to the original waveform displayed on the original waveform display window 10B in order to set a length of time for each phoneme. As for this operation, for instance, labels can be added to the waveform by moving the cursor on the display screen to the synthesized waveform display window 10C positioned below the original waveform display window 10B and specifying a label at a desired position according to operating the key entry section 2. In this case, any position for a label can easily be specified by using an input device such as a mouse or the like.

Figure 18:
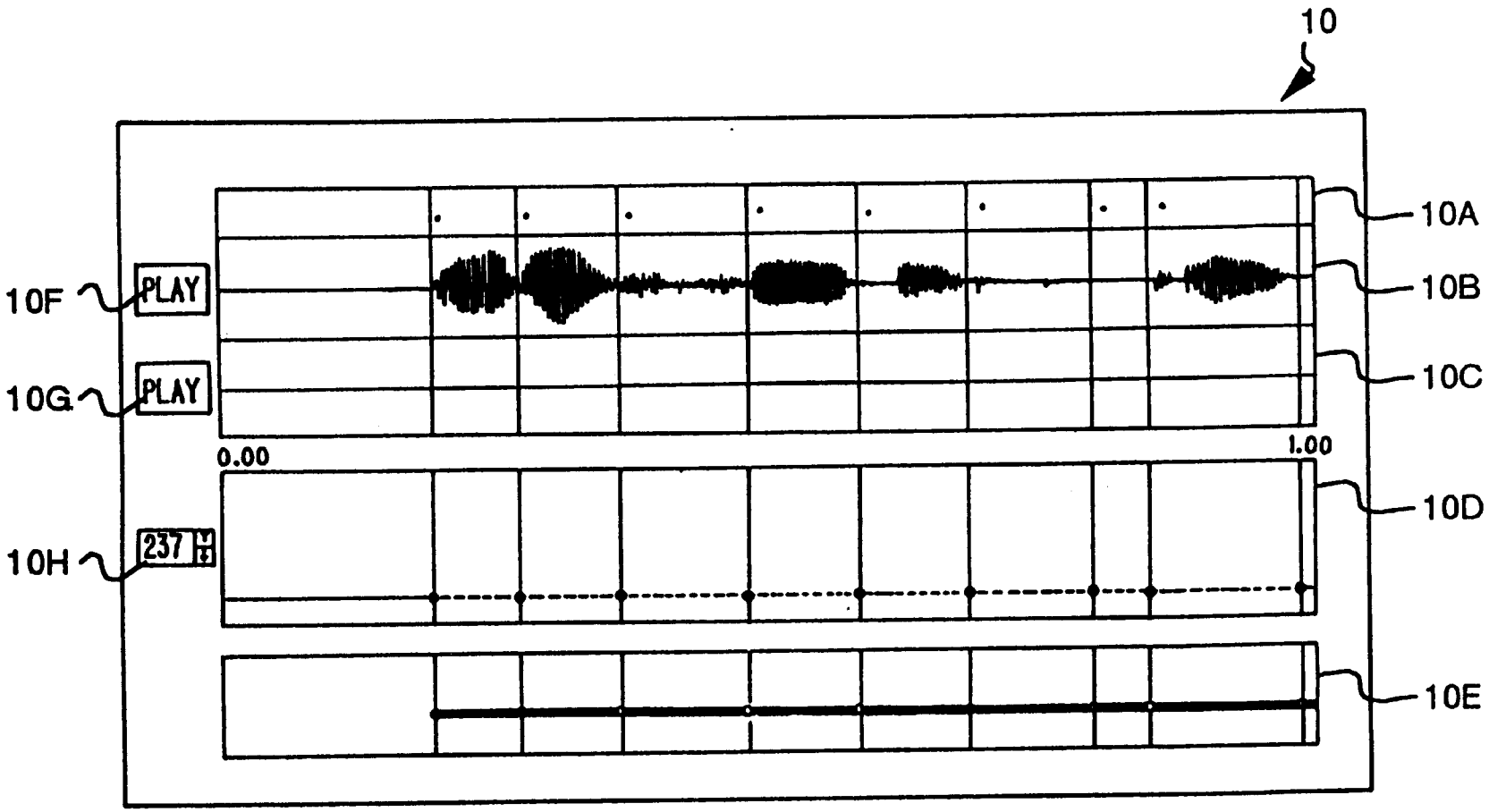
FIG. 18 is a view showing another example of state shifting of the operation screen according to the invention during the newly making processing.

FIG. 18 shows an example in which 11 pieces of label are added to the waveform in the synthesized waveform display window 10C. With this addition of the label thereto, each label is extended to the phoneme display window 10A, original waveform display window 10B, pitch display window 10D, and velocity display window 10E each positioned in a upper side or in a lower side of the synthesized waveform display window 10C, whereby parameters in the direction of time axis are correlated to each other.

In a case where the inputted natural voice is a Japanese language, in the next step S105, phonemes (characters) of the Japanese language are inputted to the phoneme display window 10A. In this case also, phonemes are inputted by manually operating the key entry section 2 like that in a case of addition of the labels, and each phoneme is set in each space partitioned by the labels in the phoneme display window 10A.

Figure 19:
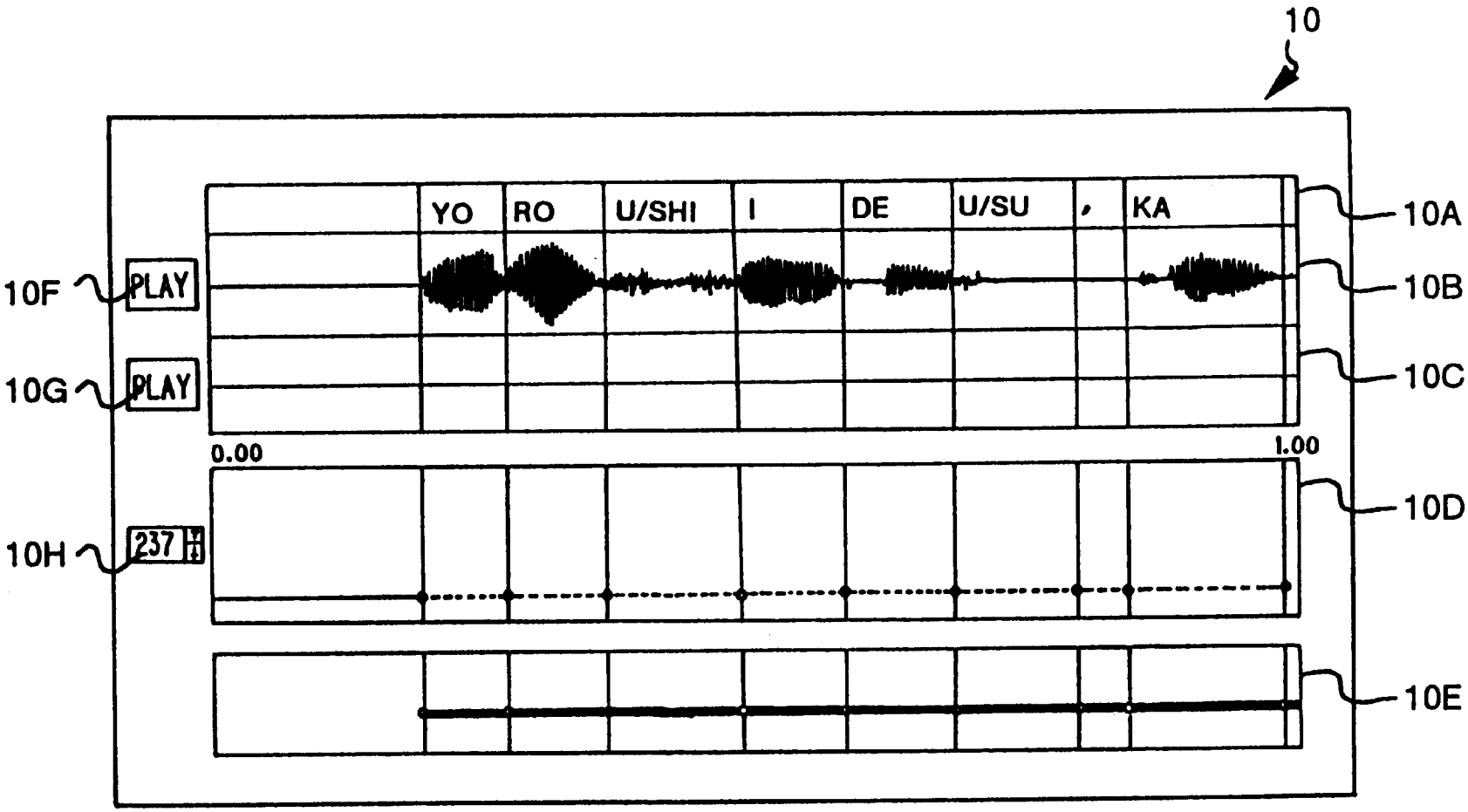
FIG. 19 is a view showing still another example of state shifting of the operation screen according to the invention during the newly making processing.

FIG. 19 shows an example in which phonemes are inputted in the order of "Yo", "Ro", "U/shi", "I", "De", "U/Su", ",", "Ka" from the beginning on the time axis. Among the inputted phonemes, "U/Shi" and "U/Su" indicate devocalized phonemes, and other phonemes indicate vocalized phonemes.

In step S106, pitches of the original waveform displayed on the original waveform display window 10B are analyzed.

Figure 20:
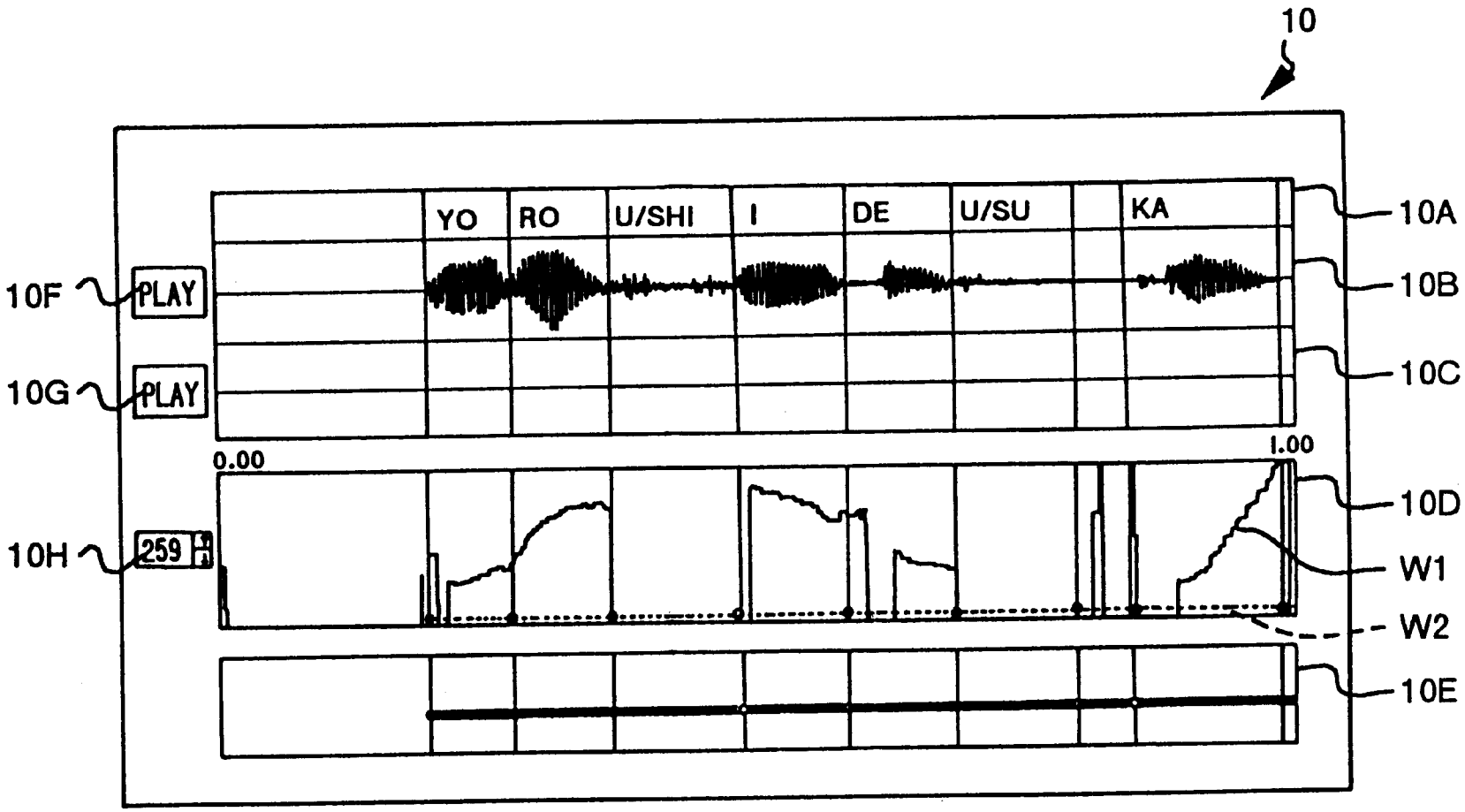
FIG. 20 is a view showing still another example of state shifting of the operation screen according to the invention during the newly making processing.

In FIG. 20, the pitch pattern W1 of the original waveform (a section indicated by the solid line in FIG. 20) displayed on the pitch display window 10D after the pitches are analyzed and the pitch pattern W2 of the synthesized waveform (a section indicated by the broken line with dots each at a position of each label connected to each other shown in FIG. 20) are displayed thereon, for instance, with different colors.

In step S107, pitch adjustment is executed. This pitch adjustment includes operations such as addition of a pitch value, movement thereof (in the direction of time axis or in the direction of the label), and deletion thereof in accordance with addition of a pitch label, movement thereof in the direction of time axis, and deletion thereof.

To be more specific, this pitch adjustment is executed by a user who visually refers to the pitch pattern of the original waveform and sets the pitch pattern W2 of a synthesized waveform thereon through manual operation, and when the operation is executed, the pitch pattern W1 of the original waveform is fixed. The pitch pattern W2 of the synthesized waveform is specified by each point pitch at positions of labels on time axis, and a space between labels each having a time lag not dependent on time division of each phoneme is interpolated with a straight line.

Figure 21:
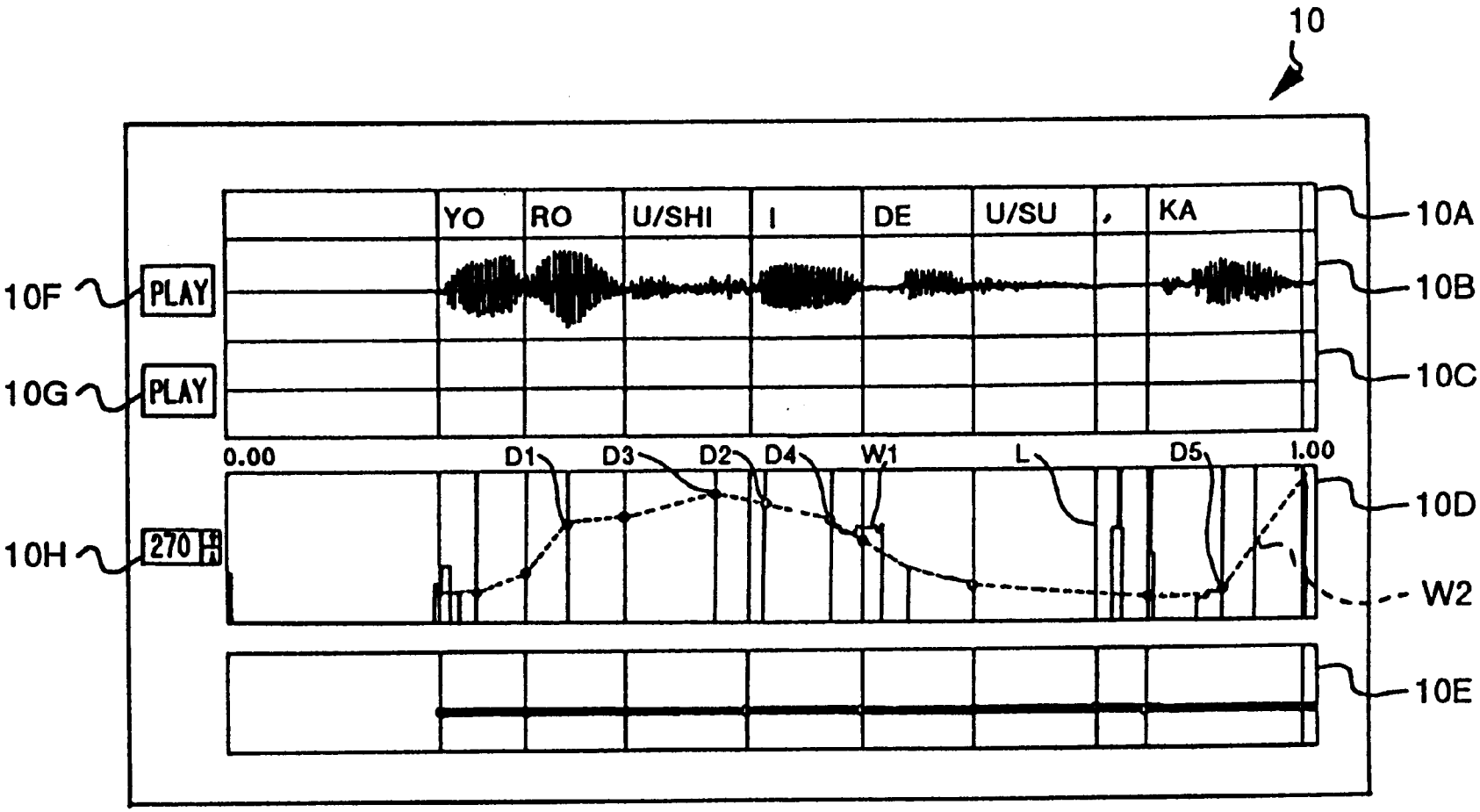
FIG. 21 is a view showing still another example of the operation screen during the newly making processing.

In the adjustment of each pitch label, as shown in FIG. 21, a label can further be added to a space between the labels used for partitioning each phoneme. The operation of this addition is executed only by specifying label positions as indicated by the reference numerals D1, D3, D4, D5 in the pitch display window 10D directly with a mouse or the like. The pitch newly added as described above is connected to the adjacent pitch with a straight line, so that a desired change of pitch can be given into one phoneme, and for this reason the meter can easily be processed to an ideal meter.

Also, in the operation of movement, a position for movement of a pitch label is just specified, as indicated by the reference numeral D2, in the pitch display window 10D directly with a mouse or the like. In the movement of this pitch label, the pitch is also connected to the adjacent pitch with a straight line, so that a desired change of pitch can be given into one phoneme, and for this reason the meter can easily be processed to an ideal meter.

It should be noted that, even if one of pitches is deleted from the pitch labels, pitch is also connected to the adjacent pitch exclusive of the deleted pitch, so that a desired change of pitch can be given into one phoneme, and for this reason the meter can easily be processed to an ideal meter.

In this case, pronouncing event PE1 is set therein.

Figure 22:
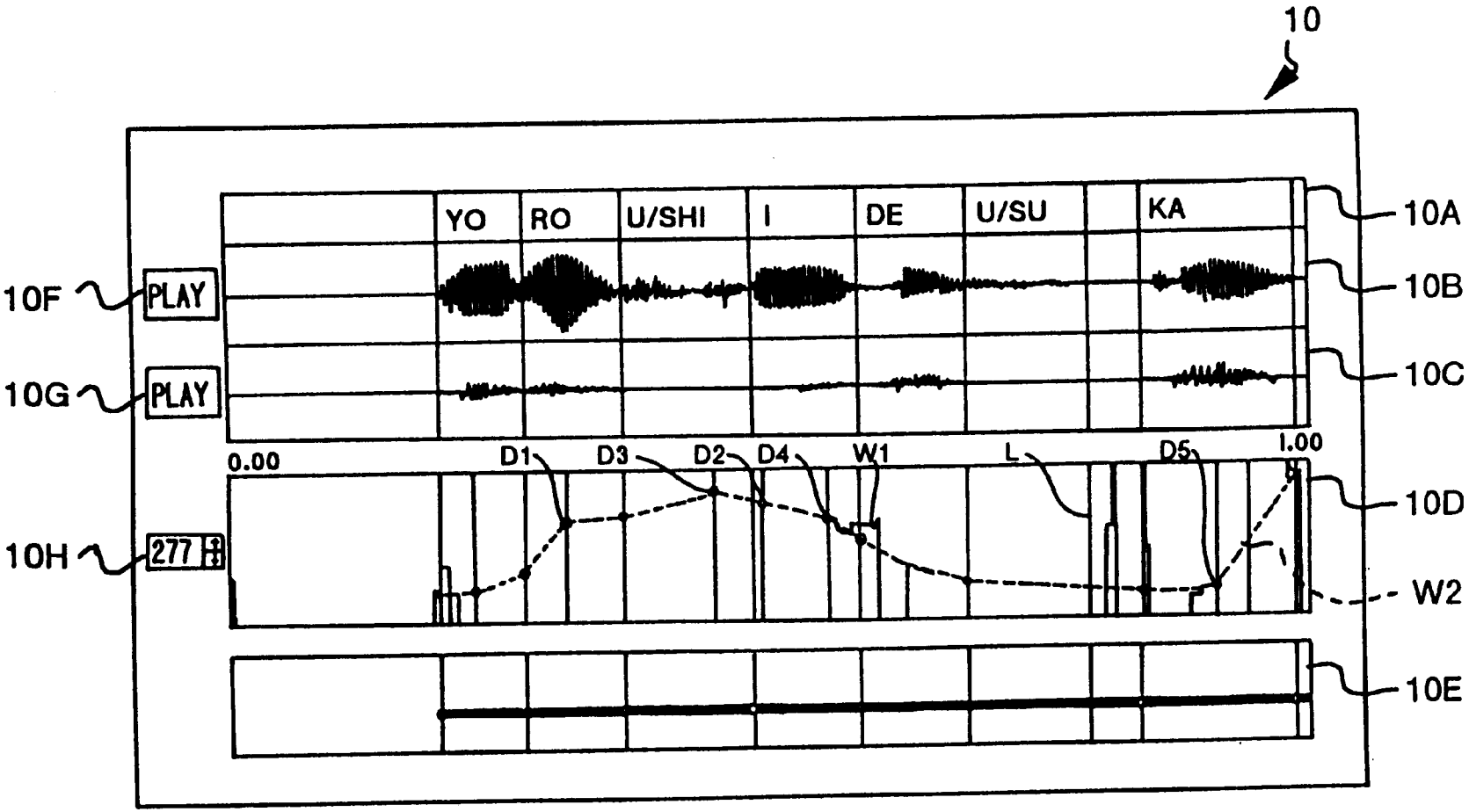
FIG. 22 is a view showing still another example of state shifting of the during the newly making processing.

In the next step S108, a synthesized waveform in a step in which the pitches are adjusted is generated, as shown, for instance, in FIG. 22, to be displayed on the synthesized waveform display window 10C. When it is displayed, velocity is not set herein, so that plane velocity is displayed on the velocity display window 10E as shown in FIG. 22.

It is also possible to compare the original voice to the synthesized voice as well as to reproduce them in the step in which the synthesized waveform is displayed in step S108. In this step, a type of the voice tone to be synthesized is set to the voice tone by default.

In a case where an original voice is to be reproduced, the original voice reproduce/stop button 10F is just operated, and in a case where the reproduction is to be stopped, the original voice reproduce/stop button 10F is just operated again. Also, in a case where a synthesized voice is to be reproduced, the synthesized voice reproduce/stop button 10G is just operated, and in a case where the reproduction is to be stopped, the synthesized voice reproduce/stop button 10G is just operated once more.

The reproduce processing described above is executed as interrupt/reproduce processing during the processing for creating a new file or edit processing which is described later. The detailed operations are shown in FIG. 16. Namely, in step S201, a determination is first made as to whether an object for reproduction is an original voice or a synthesized voice according to the operation with the original voice reproduce/stop button 10F or with the synthesized voice reproduce/stop button 10G.

Then, in a case where it is determined that an original voice is obtained (step S202), processing shifts to step S203, and the original voice is reproduced and outputted according to the original waveform. On the other hand, in a case where it is determined that a synthesized voice is obtained (step S202), processing shifts to step S204, and the synthesized voice is reproduced and outputted according to the synthesized waveform. Then, processing returns to the operation at a point of time when the processing for creating a new file was interrupted.

Now, the description is returned to the pressing for creating a new file, and in step S109, velocity indicating a volume of a phoneme is adjusted by an manual operation. This adjustment of the velocity is executed, as shown in FIG. 23, in a range of previously decided stages (e.g. 16 stages).

In this velocity adjustment also, velocity of a voice can be changed at an arbitrary point of time not dependent on time division between phonemes and at a further shorter time interval than a time lag of each phoneme on a time axis like the pitch adjustment described above.

Figure 23:
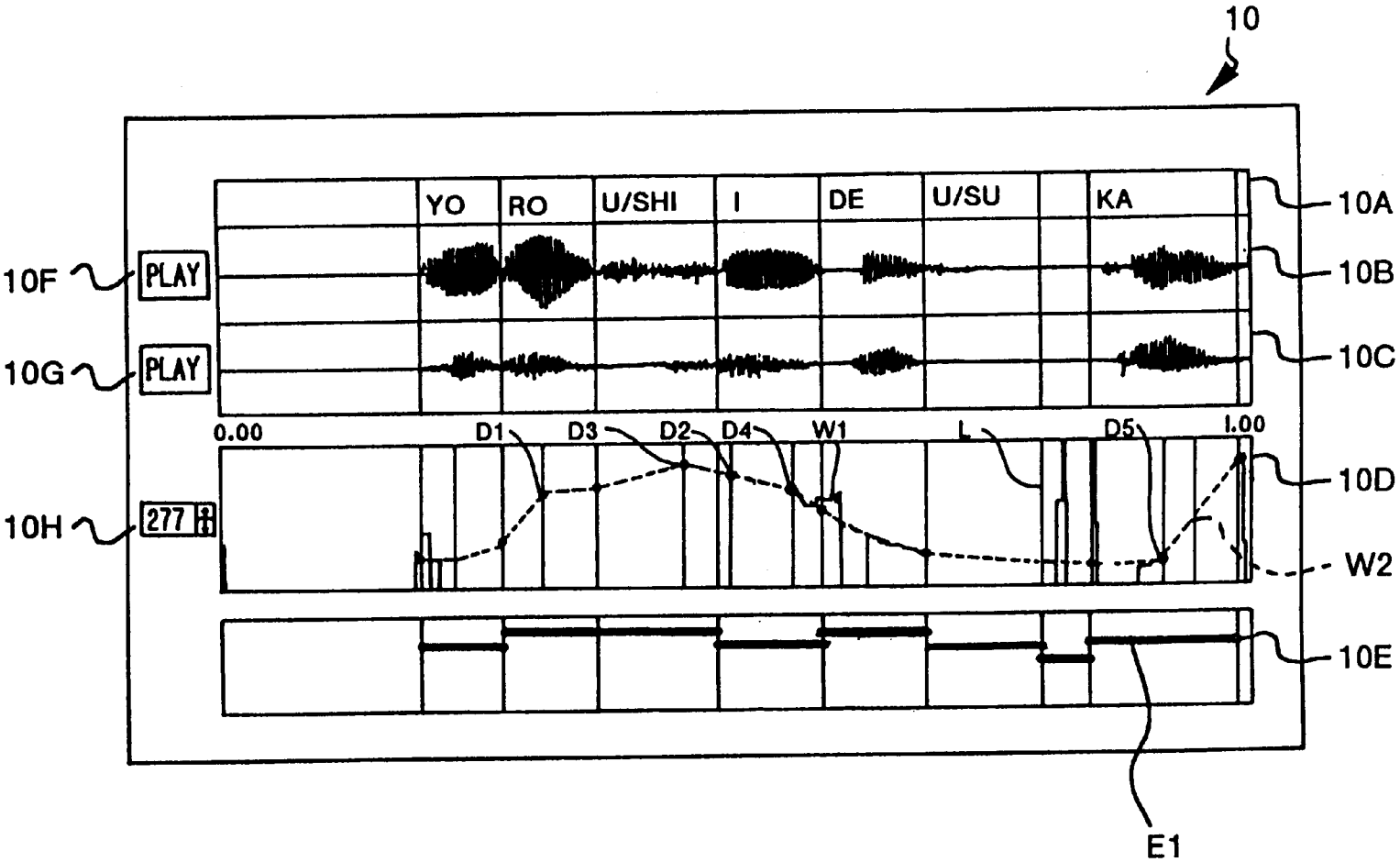
FIG. 23 is a view showing still another example of state shifting of the operation screen during the newly making processing.
Figure 24:
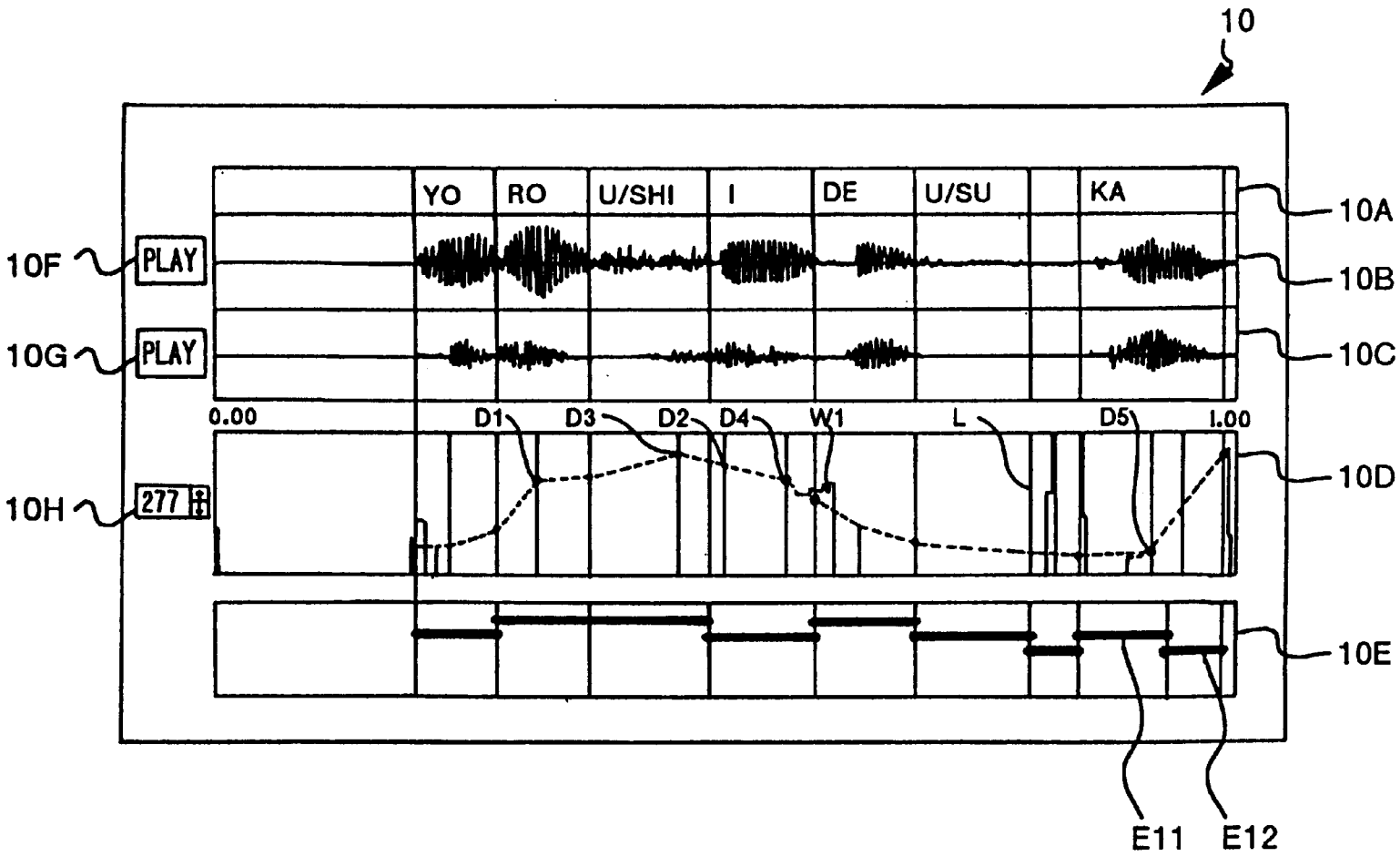
FIG. 24 is a view showing still another example of state shifting of the operation screen according to the invention during the newly making processing.

For instance, the velocity E1 in the time division of the phoneme of "Ka" in the velocity display window 10E shown in FIG. 23 can be subdivided into the velocity E11, E12 as shown in FIG. 24. This velocity adjustment is also set by the operation through the key entry section 2 to the velocity display window 10E like a case of the pitch adjustment.

When the reproduction of a synthesized voice is operated after this velocity is adjusted, velocity of a voice is changed in a time lag not dependent on the time lag between phonemes, whereby intonation can be added to the voice as compared to the plane state of the velocity. It should be noted that the time division of the velocity may be synchronized to the time division of the pitch label obtained by the pitch adjustment.

Then, it is determined that the processing for creating a new file is ended in step S110, and if an end operation is executed, processing shifts to step S117 and the processing for new filing is executed therein. In this processing for new filing, a file name is inputted, and a newly created file corresponding to the file name is stored in the voice-generating information storing section 6. If the file name is "A", the voice-generating information is stored in a form of the header information HDRA as well as of the pronouncing information PRSA as shown in FIG. 7.

Also, in step S110, the end operation is not executed, and when any of operations of changing velocity (step S111), changing pitch (step S112), changing a phoneme (step S113), changing a label (step S114), and changing setting of voice tone (step S115) is determined, processing shifts to the processing corresponding to each of the change requests.

Namely, if it is determined that a change is a change of velocity (step S111), processing returns to step S109 and the value of velocity is changed in units of phoneme according to the manual operation. If it is determined that a change is a change of pitch (step S112), processing returns to step S107 and the value of the pitch is changed (including addition and deletion) in units of label according to the manual operation.

Also, if it is determined that a change is a change of a phoneme (step S113), processing returns to step S105 and the phoneme is changed according to the manual operation. If it is determined that a change is a change of a label (step S114), processing returns to step S104 and the label is changed according to the manual operation. It should be noted that, in the change of a label as well as of pitch, the pitch pattern W2 of the synthesized waveform is changed according to the gap of pitch after the change.

Also, if it is determined that a change is a change of setting voice tone (step S115), processing shifts to step S116 and setting of the type of voice tone is changed to a desired type of voice tone according to the manual operation. When a synthesized voice is reproduced again by changing this setting of voice tone, a characteristic of the voice is changed, so that voice tone can be changed to woman's voice tone or the like according to a change of the voice tone even if a natural voice is man's voice tone.

It should be noted that the processing of returning from step S115 to step S110 again is repeatedly executed until the end operation is detected after the processing in step S109 and the change operation of parameters is also detected.

As for a change of each parameter, only a change of the parameter specified to be changed is executed. For instance, when the processing in step 104 is ended with the change of the label, the processing from the next step S105 to step S109 is passed therethrough, and the processing is restarted from step S110.

Next a description is made for the edit processing with reference to FIG. 25. This edit processing is processing for operating addition of a parameter, change thereof, and deletion thereof to the file already created, and basically the same processing as that in the step for changing the processing for creating a new file is executed.

Namely, in this edit processing, at first a file as an object for edits is selected with reference to the file list in the voice-generating information storing section 6 in step S301. Then, the same creation screen as that for the processing for creating a new file is displayed on the display section 10.

In this edit processing, an original synthesized waveform as an object for edits is handled this time as an original waveform, so that the original waveform is displayed on the original waveform display window 10B.

In the next step S302, edit operation is inputted. This input corresponds to the change operation of the processing for creating a new file described above.

When any of the operations of changing a label (step S303), changing a phoneme (step S304), changing pitch (step 307), changing velocity (step S309), and changing setting of voice tone (step S311) is determined, processing shifts to the processing corresponding to each of change requests.

Namely, if it is determined that a change is a change of a label (step S303), processing shifts to step S304 and the label is changed according to the manual operation. It should be noted that, in the change of a label as well as of pitch in the edit processing, the pitch pattern W2 of the synthesized waveform is changed according to the change.

Also, if it is determined that a change is a change of a phoneme (step S305), processing shifts to step S306 and the phoneme is changed according to the manual operation. If it is determined that a change is a change of pitch (step S307), processing shifts to step S308 and the value of the pitch is changed (including addition and deletion) in units of label according to the manual operation.

If it is determined that a change is a change of velocity (step S309), processing shifts to step S310 and the value of velocity is changed in units of phoneme according to the manual operation.

Also, if it is determined that a change is a change of setting voice tone (step S311), processing shifts to step S312 and setting of the type of voice tone is changed to a desired type of voice tone according to the manual operation.

In a case where an end operation is executed in the edit operation in step S302, processing shifts to step S313 and after an end of the operation is confirmed, processing further shifts to step S314. In this step S314, the edit/filing processing is executed, and while it is executed, registration as a new file and an overwrite to the existing file can arbitrarily be selected.

It should be noted that, after the change of each parameter, processing returns again to step S302, and the change operation of parameters can be continued.

Next description is made for the reproduce processing. FIG. 26 is a flow chart for explanation of the reproduce processing according to the embodiment.

In this reproduce processing, at first, in step S401, voice tone specifying data VP for the header information in the received voice-generating information is referred to, and determination is made as to whether specification of voice tone based on the voice tone specifying data VP is requested or not.

In a case where a result of the determination that the voice tone is specified is obtained, processing shifts to step S402, while in a case where a result of the determination that the voice tone is not specified is obtained, processing shifts to step S404.

In step S402, voice tone specified according to the voice tone specifying data VP is first retrieved from the voice tone section 41 in the voice tone data storing section 4, and determination is made as to whether the specified tone voice is prepared in the voice tone section 41 or not.

Then in a case where a result of the determination that the specified voice tone is prepared therein is obtained, processing shifts to step S403, while in a case where a result of the determination that the specified voice tone is not prepared therein is obtained, processing shifts to step S404.

In step S403, the voice tone prepared in the voice tone data storing section 4 is set as voice tone to be used for reproducing a voice. Then, processing shifts to step S405.

Also in step S404, information for specifying voice tone is not included in the header information, or the specified voice tone is not prepared in the voice tone section 41, so that a value close to the reference value is further determined from the pitch reference PB1, PB2, . . . based on the pitch reference data PB for the header information, and the voice tone corresponding to the current pitch reference is set as a voice tone used for reproducing a voice. Then, processing shifts to step S405.

In the next step S405, the processing for setting pitch of a voice when the voice is synthesized is executed by the key entry section 2. It should be noted that this setting is arbitrary, and when it is set, the set value is employed as a reference value in place of the pitch reference data in the voice tone data.

Then, processing shifts to step S406, and the processing for synthesizing a voice already described in FIG. 13 is executed.

In the processing described above, in a case where displacement in the pitch reference occurs between the voice-generating information and voice tone data when the voice is synthesized, pitch shift data indicating a shifted rate is supplied from the voice tone data storing section 4 to the synthesized waveform generating processing PR2. In the synthesized waveform generating processing PR2, a pitch reference is changed depending on this pitch shift data. For this reason, the pitch of a voice is changed so that the pitch will be matched to the pitch of a voice on the side of the voice tone.

Specific description is made for this pitch shift. For instance, in a case where, assuming that an average pitch frequency is used as a pitch reference, an average pitch frequency of voice-generating information is 200 [Hz] and an average pitch frequency of voice tone data is 230 [Hz], voice synthesis is executed by multiplying the entire pitch of a voice when the voice is synthesized by a factor of 230/200. With is operation, a voice with the pitch appropriate to the voice tone data can be synthesized, whereby voice quality is improved.

It should be noted that other expressions such as a cycle, in which a pitch reference is made with frequencies, may be used.

As described above, with the present embodiment, meter patterns which are successive along a time axis but are not dependent on phonemes are developed with velocity and pitch of a voice. Also, a voice waveform is generated based on the meter patterns as well as on the voice tone data selected by the information indicating types of voice tone in the voice-generating information. As a result, a voice can be reproduced with an optimal voice tone directly specified from a plurality types of voice tone without any specification to a particular voice tone, and any displacement does not occur in the pitch patterns of a voice when a voice waveform is generated. With this operation, it is possible to reproduce a voice with high quality.

Also, when a voice is reproduced, a reference of voice pitch of voice-generating information is shifted according to a reference of voice pitch of voice tone, so that each of the voice pitch is relatively changed according to the shifted voice pitch regardless of time division of phonemes. For this reason, the reference of voice pitch is close to the voice tone side, which makes it possible to further improve voice quality.

Also, when a voice is reproduced, a reference of voice pitch of voice-generating information is shifted according to a reference of arbitrary voice pitch, so that each of the voice pitch is relatively changed according to the shifted voice pitch regardless of time division of phonemes. For this reason, processing of voice tone, such that voice tone is made closer to intended voice quality according to a shifted rate or other process, can be made.

A reference of voice pitch is made to an average frequency, a maximum frequency or a minimum frequency of voice pitch, so that the reference of voice pitch can easily be made.

Also, voice tone data stored in the storage medium (FD 12*a*, CD-ROM 13*a*) is read out to be stored in the voice tone section 41, so that variation can be given to types of voice tone through the storage medium, which makes it possible to apply optimal voice tone to voice when it is reproduced.

Voice tone data is received from any external device through the communication line LN to be stored in the voice tone section 41, so that variation can be given to types of voice tone through the communication line LN, which makes it possible to apply optimal voice tone to voice when it is reproduced.

Voice-generating information stored in the storage medium (FD 12*a*, CD-ROM 13*a*) is read out to be stored in the voice-generating information storing section 6, so that desired voice-generating information can be prepared at any time through the storage medium.

Voice-generating information is received from any external device through the communication line LN to be stored in the voice-generating information storing means, so that desired voice-generating information can be prepared at any time through the communication line LN.

Voice-generating information including types of voice tone is prepared by providing each discrete data for either one of or both velocity and pitch of a voice based on an inputted natural voice so that each discrete data for either one of or both velocity and pitch of a voice is not dependent on a time lag between phonemes and at the same time is present at a level relative to a reference, and the voice-generating information is filed in the voice-generating information storing section 6, so that any velocity and pitch of a voice are given to arbitrary points of time each independent from a time lag between phonemes, and also any type of voice tone can be given to the voice-generating information.

When voice-generating information is to be prepared, the voice-generating information with a reference of voice pitch included therein is prepared, so that it is possible to give the reference of voice pitch into the voice-generating information.

Each information can be changed at any arbitrary point of time when it is prepared, so that it is possible to change the information for enhancing voice quality.

Next description is made of certain modifications of the preferred embodiment.

In Modification 1, the processing for creating a new file according to the embodiment of the present invention is modified, so that description is made hereinafter of the processing for creating a new file.

Figure 27:
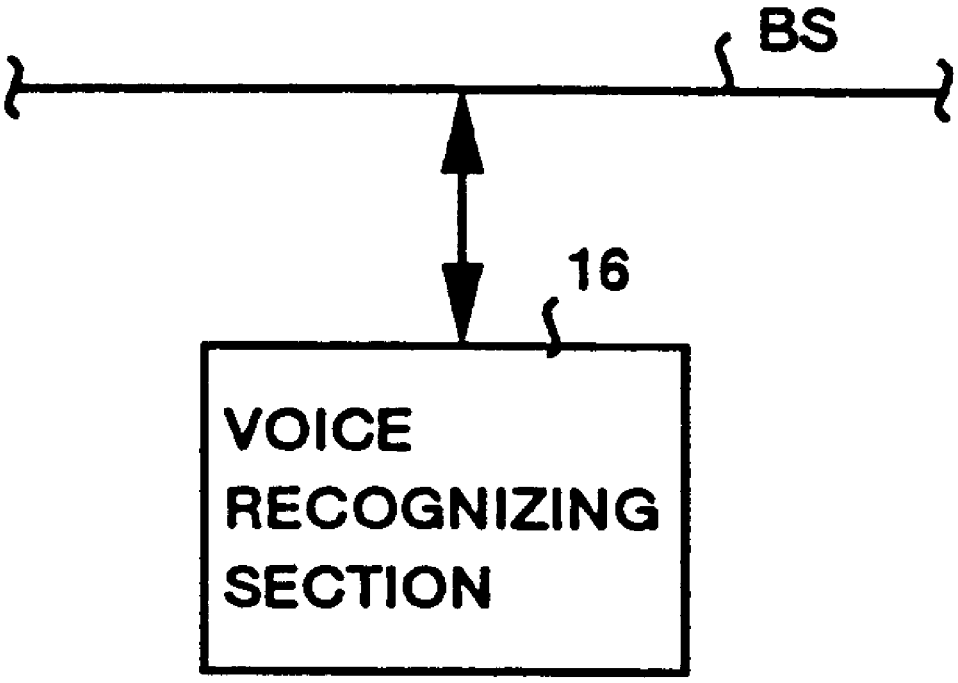
FIG. 27 is a flow chart showing a key section according to Variant 1 of the invention.

FIG. 27 is a block diagram showing a key section of an apparatus according to Modification 1 of the embodiment. The apparatus according to this modification has configuration in which a voice recognizing section 16 is added to the regular voice synthesizing apparatus (Refer to FIG. 1), and the voice recognizing section 16 is connected to the bus BS.

The voice recognizing section 16 executes voice recognition based on an inputted natural voice through the microphone 8, and supplies a result of the recognition to the control section 1. The control section 1 executes processing for converting the supplied result of the recognition to character codes (corresponding to the phoneme table described above).

Figure 28:
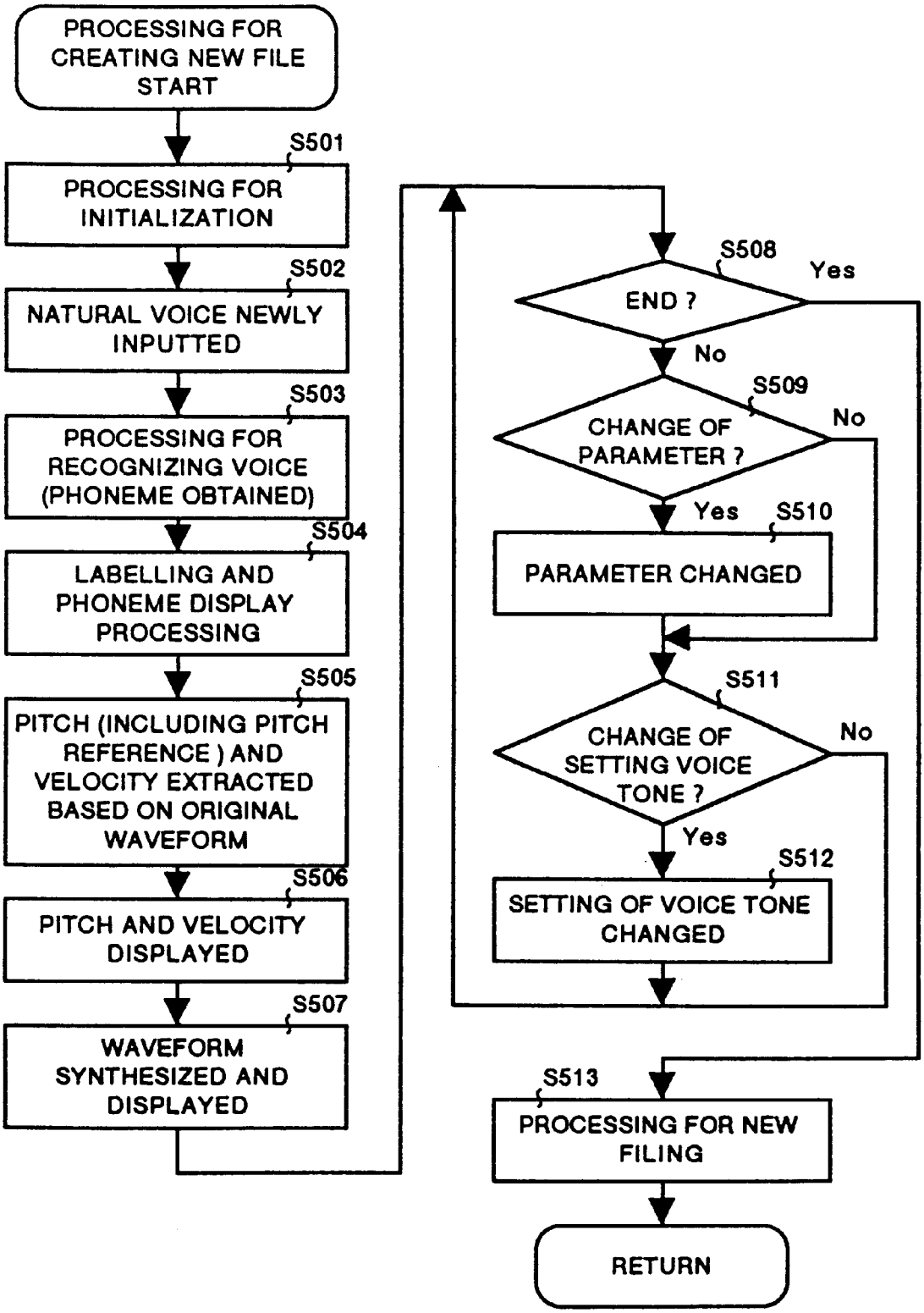
FIG. 28 is a flow chart explaining the newly making processing according to Variant 1 of the invention.

Next description is made for the main operations of the modification. FIG. 28 is a flow chart for explanation of the processing for creating a new file according to Modification 1.

In the processing for creating a new file according to Modification 1, as in step S101 (Refer to FIG. 15) described above, at first, header information and pronouncing information each constituting voice-generating information are initialized, and the screen for creation used for creating a file is also initialized (step S501).

Then, when a new natural voice is inputted into the storing section through the microphone 8 (step S502), the original waveform is displayed on the original waveform display window 10B of the creation screen (step S503).

It should be noted that, a creation screen on the display section 10 comprises, like the embodiment described above (Refer to FIG. 13), a phoneme display window 10A, an original waveform display window 10B, a synthesized waveform display window 10C, a pitch display window 10D, a velocity display window 10E, an original voice reproduce/stop button 10F, a synthesized voice-form reproduce/stop button 10G, and a scale 10H for setting a pitch reference.

In this modification, a voice through voice input is recognized by the voice recognizing section 16 based on the original waveform, and phonemes are obtained at one operation (step S503).

In the next step S504, the phonemes are automatically allocated to the phoneme display window 10A based on the obtained phonemes and the original waveforms, and when the operation is executed, labels are added to the phonemes. In this case, a phoneme name (a character) and a time interval which the phoneme has (an area on time axis) are obtained.

Further, in step S505, pitch (including a pitch reference) and velocity are extracted from the original waveform, and in the next step S506, the pitch and velocity extracted by corresponding to each phoneme are displayed on the pitch display window 10D as well as on the velocity display window 10E respectively. It should be noted that there is a method of setting a pitch reference, for instance, to as twice as much of the minimum value of the pitch frequency.

Then, a voice waveform is generated based on each parameters as well as on the voice tone data by default to be displayed on the synthesized waveform display window 10C (step S507).

After the operation described above, the end operation of the processing for creating a new file is detected in step S508, and in a case where it is determined that the end operation has been executed, processing shifts to step S513, and the processing for new filing is executed. In this processing for new filing, a file name is inputted, and the newly created file corresponding to the file name is stored in the voice-generating information storing section 6.

Also, when the end operation is not detected in step S508 and an operation for changing any parameter of velocity, pitch, phonemes, and labels is detected (step S509), processing shifts to step S510 and the processing for changing the parameters as an object for a change is executed therein.

In step S511, when a change for setting the voice tone is detected, processing shifts to step S512 and the setting of the voice tone is changed therein.

It should be noted that the end operation is not detected in step S508 and until the change operation for parameters is detected in step S511, the processing in step S508, S509, and S512 is repeatedly executed.

As described above on Modification 1, even if a synthesized waveform is automatically obtained once after a natural voice is inputted and then each parameter is changed, it is possible to realize practical voice synthesis which can maintain voice reproduction with high quality like that in the embodiment described above.

Also, as Modification 2, a voice is synthesized once, and then an amplitude pattern of the original waveform is compared to that of the synthesized waveform, whereby a velocity value may be optimized so that the amplitude of the synthesized waveform will match that of the original waveform, which makes it possible to further improve the voice quality.

Also, as Modification 3, in a case where the voice tone section does not have the voice tone data specified by voice-generating information, a voice may be synthesized by selecting the voice tone having the characteristics (attribute of the voice tone) similar to the characteristics (attribute of the voice tone) in the voice-generating information from the voice tone section.

Detailed description is made hereinafter for Modification 3. FIG. 29 is a view showing an example of configuration of the header information according to Modification 3, FIG. 30 is a view showing an example of configuration of the voice tone attribute in the header information shown in FIG. 29, FIG. 31 is a view showing an example of configuration of the voice tone section according to Modification 3, and FIG. 32 is a view showing an example of configuration of the voice tone attribute in the voice tone section shown in FIG. 31.

In Modification 3, as shown in FIG. 29 and FIG. 31, each information for attribute of voice tone with a common format is prepared in the header information as well as in the voice tone section 43 of the voice-generating information.

Added to the header information HDRX in the voice-generating information is information AT for attribute of voice tone as a new parameter, different from the header information applied to the embodiment described above.

This information AT for attribute of voice tone has configuration, as shown in FIG. 30, in which data on sex SX, data on age AG, a reference for pitch PB, clearness CL, and naturality NT are correlated to each other.

Similarly, added to the voice tone section 43 is information ATn for attribute of voice tone (n: a natural numeral) correlated to the voice tone data as a new parameter, different from the voice tone section 41 applied to the embodiment described above.

This information ATn for attribute of voice tone has configuration, as shown in FIG. 32, in which data on sex SXn, data on age AGn, a reference for pitch PBn, clearness CLn, and naturality NTn are correlated to each other.

Each item for attribute of voice tone is shared with the information AT for attribute of voice tone and information ATn for attribute of voice tone, and is specified as follows:

Sex: −1/1 (male/female)

Age: 0–N

Pitch reference (an average pitch): 100–300 [Hz]

Clearness: 1–10 (clearness is up in accordance with a higher degree thereof).

Naturality: 1–10 (naturality is up in accordance with a higher degree thereof)

It should be noted that, the clearness and the naturality indicate a sensuous level.

Figure 33:
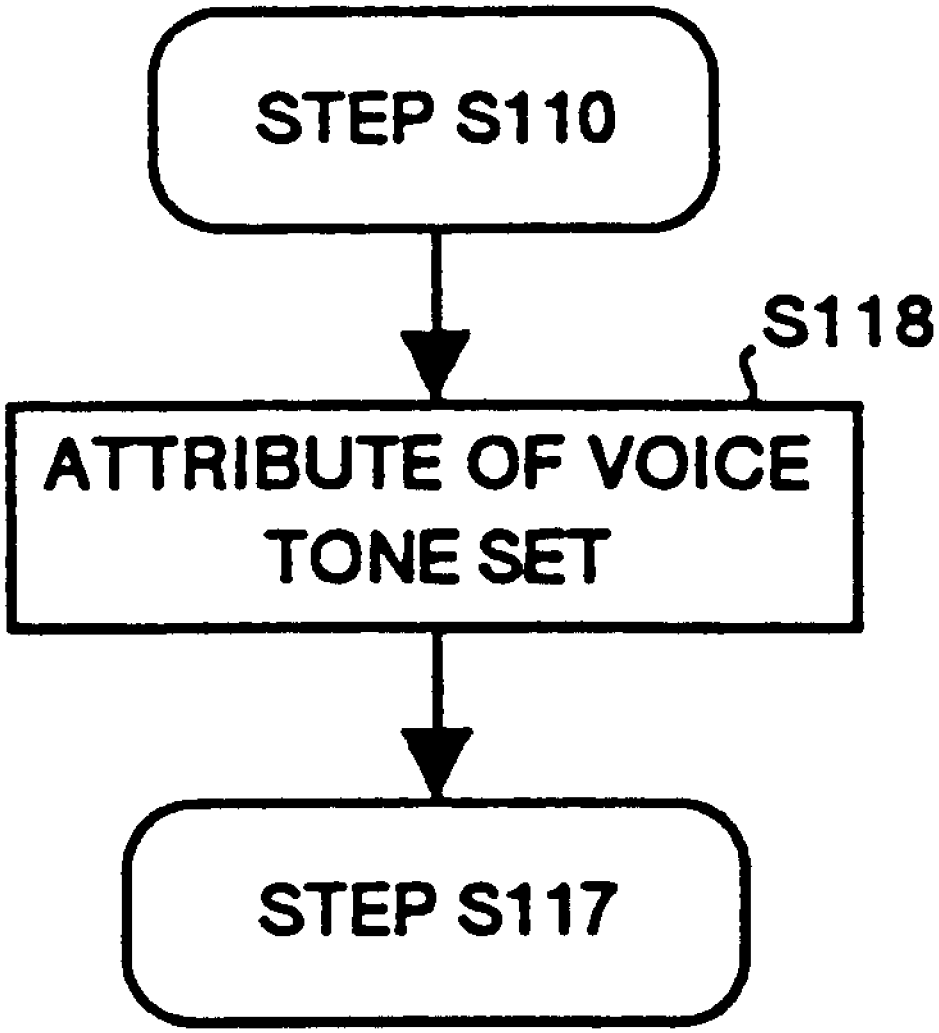
FIG. 33 is a flow chart explaining main portions of the newly making processing according to Variant 3 of the invention.
Figure 34:
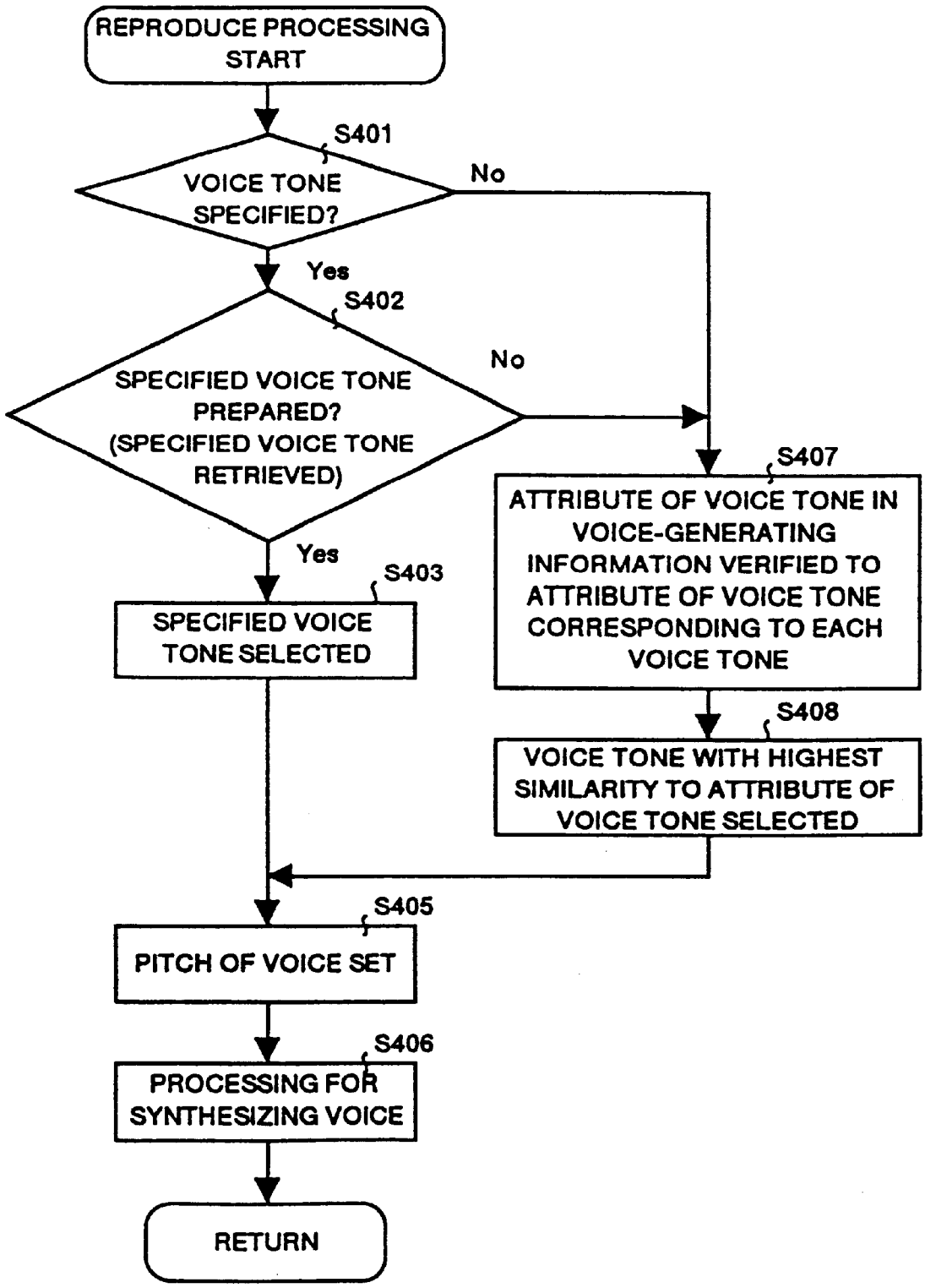
FIG. 34 is a flow chart explaining the reproducing processing according to Variant 3 of the invention.

Next description is made for the main operations of the apparatus according to Modification 3. FIG. 33 is a flow chart for explanation of the main processing in the processing for creating a new file according to Modification 3, and FIG. 34 is a flow chart for explanation of the reproduce processing according to Modification 3.

An entire flow of the processing for creating a new file thereof is the same as that according to the embodiment (Refer to FIG. 15), so that only different portions therefrom are described herein.

In the processing flow shown in FIG. 15, when a new file has been created, processing shifts from step S110 to step S117, however, in Modification 3, processing shifts to step S118, as shown in FIG. 33, and setting for attribute of voice tone is executed therein. Then, the processing for filing is executed in step S117.

In step S118, the information AT for attribute of voice tone is prepared, and is added to the header information HDRX. Herein, as one of examples, it is assumed that the following items are set in the information AT for attribute of voice tone:

Sex: 1 (female)

Age: 25 (years old)

Pitch reference (an average pitch): 200 [Hz]

Clearness: 5 (normal degree)

Naturality: 5 (normal degree)

Next description is made for the reproduce processing. Before the description is made, there is shown one of examples of the contents in each item of the information ATn for attribute of voice tone for the voice tone section 43.

In a case of information AT1 for attribute of voice tone, the following contents are assumed as one of examples:

Sex: −1 (female)

Age: 35 (years old)

Pitch reference (an average pitch): 140 [Hz]

Clearness: 7 (slightly higher degree)

Naturality: 5 (normal degree)

Also, in a case of information AT2 for attribute of voice tone, the following contents are assumed as one of examples:

Sex: 1 (female)

Age: 20 (years old)

Pitch reference (an average pitch): 200 [Hz]

Clearness: 5 (normal degree)

Naturality: 5 (normal degree)

In the reproduce processing as shown in FIG. 34, the entire flow thereof is common to that in the reproduce processing according to the embodiment described above, so that only different portions therefrom are described herein.

In a case where a result of the determination that the specified voice tone is not prepared is obtained in step S402, processing shifts to step S407. In step S407, the processing for verifying the information AT for attribute of voice tone in the voice-generating information to the information ATn for attribute of voice tone stored in the voice tone section 43 is executed.

As for this verification, there are a method of taking a difference between values in each item as an object for verification, assigning weights to each item with the square, and adding a result of each item to the information (Euclidean distance), and a method of adding weights of an absolute value to each item or the like.

Description is made for a case, for instance, where a method of calculating Euclidean distance (DSn) is applied. It is assumed that weights used for the operation executed above are as follows:

Sex: 20

Age: 1

Pitch reference (an average pitch): 1

Clearness: 5

Naturality: 5

Then, in the verification of the information AT for attribute of voice tone to that AT1, the following expression is obtained:

$$DS1=(-1-1)*20)^2+((35-25)*1)^2+((140-200)*1)^2+((7-5)*5)^2+((5-5)*3)^2=720$$

and, in the verification of the information AT for attribute of voice tone to that AT2, the following expression is obtained:

$$DS2=((1-1)*20)^2+((20-25)*1)^2+((230-200)*1)^2+((4-5)*5)^2+((7-5)*3)^2=986$$

For this reason, in step S408, a relation between DS1 and DS2 becomes DS1<DS2, the voice tone data VD1 to be stored by corresponding to the information AT1 for attribute of voice tone which has a short distance is selected as a type of voice tone with highest similarity to the attribute of voice tone.

It should be noted that, in Modification 3, voice tone is selected with attribute of voice tone after a type of voice tone is directly specified, however, voice tone data may be selected from the similarity using only attribute of voice tone without direct specification of a type of voice tone.

With Modification 3, meter patterns successive on time axis are developed with velocity and pitch of a voice not dependent on phonemes, and a voice waveform is generated based on the meter patterns and the voice tone data selected according to the similarity with information indicating attribute of voice tone in voice-generating information, so that a voice can be reproduced with the voice tone having the highest similarity without using inappropriate voice tone, and also displacement in pitch patterns does not occur when a voice waveform is generated, whereby it is possible to reproduce a voice with high quality.

Also, meter patterns successive on time axis are developed with velocity and pitch of a voice not dependent on phonemes, and a voice waveform is generated based on the meter patterns and the voice tone data selected with information indicating a type of and attribute of voice tone in voice-generating information, so that a voice can be reproduced with the voice tone having the highest similarity without using inappropriate voice tone even if directly specified voice tone is not prepared therein, and also displacement in pitch patterns does not occur when a voice waveform is generated, whereby it is possible to reproduce a voice with high quality.

In the embodiment and each of the modifications, voice tone data is selected by specifying pitch and velocity of a voice not dependent on phonemes, however, as far as only the selection of voice tone data is concerned, even if the pitch and velocity of a voice are not dependent on phonemes, the voice tone data optimal to voice-generating information required for synthesizing a voice can be selected in the voice tone section 41 (voice tone section 43). It is possible to reproduce a voice with high quality in this level.

As explained above, with a regular voice synthesizing apparatus according to the present invention, meter patterns are developed successively in the direction of time axis according to velocity and pitch of a voice not dependent on phonemes, and a voice waveform is generated according to the meter patterns as well as to voice tone data selected according to voice-generating information; whereby the voice can be reproduced with a preferable type of voice tone without limiting voice tone to any particular one, also displacement in patterns for the pitch of a voice is not generated when the voice waveform is generated. As a result, there is provided the advantage that it is possible to obtain a regular voice synthesizing apparatus enabling reproduction of a voice with high quality.

With a regular voice synthesizing apparatus according to the present invention, meter patterns are developed successively in the direction of time axis according to velocity and pitch of a voice not dependent on phonemes, and a voice waveform is generated according to the meter patterns as well as to voice tone data selected according to information indicating types of voice tone included in voice-generating information; whereby the voice can be reproduced with a most suitable type of voice tone specified directly from a plurality of types of voice tone without setting limit to a specified voice tone. Also, a displacement in patterns for the pitch of a voice is not generated when the voice waveform is generated. As a result, there is provided the advantage that it is possible to obtain a regular voice synthesizing apparatus enabling reproduction of a voice with high quality.

With a regular voice synthesizing apparatus according to the present invention, meter patterns are developed successively in the direction of time axis according to velocity and pitch of a voice not dependent on phonemes, and a voice waveform is generated according to the meter patterns as well as to voice tone data selected according to similarity based on information indicating an attribute of voice tone included in voice-generating information; whereby the voice can be reproduced with a type of voice tone having highest similarity without using unsuitable types of voice tone, also displacement in patterns for the pitch of a voice is not generated when the voice waveform is generated. As a result, there is provided the advantage that it is possible to obtain a regular voice synthesizing apparatus enabling reproduction of a voice with high quality.

With the a regular voice synthesizing apparatus according to the present invention, meter patterns are developed successively in the direction of time axis according to velocity and pitch of a voice not dependent on phonemes, and a voice waveform is generated according to the meter patterns as well as to voice tone data selected according to information indicating a type and attribute of voice tone included in voice-generating information; whereby the voice can be reproduced with a type of voice tone having highest similarity without using an unsuitable type of voice tone even though there is not a directly specified type of the voice tone, also displacement in patterns for the pitch of a voice is not generated when the voice waveform is generated. As a result, there is provided the advantage that it is possible to obtain a regular voice synthesizing apparatus enabling reproduction of a voice with high quality.

With a regular voice synthesizing apparatus according to the present invention, meter patterns are developed successively in the direction of time axis according to voice-generating information, and a voice waveform is generated according to the meter patterns as well as to voice tone data selected according to the voice-generating information; whereby a voice can be reproduced with a preferable type of voice tone without setting limit to specified voice tone, also displacement in patterns for pitch of a voice is not generated when the voice waveform is generated. As a result, there is provided the advantage that it is possible to obtain a regular voice synthesizing apparatus enabling reproduction of a voice with high quality.

With a regular voice synthesizing apparatus according to the present invention, meter patterns are developed successively in the direction of time axis according to voice-generating information, and a voice waveform is generated according to the meter patterns as well as to voice tone data selected according to information indicating types of voice tone included in the voice-generating information; whereby a voice can be reproduced with a most suitable type of voice tone specified directly from a plurality types of voice tone without setting limit to specified voice tone, also displacement in patterns for the pitch of a voice is not generated when the voice waveform is generated. As a result, there is provided the advantage that it is possible to obtain a regular voice synthesizing apparatus enabling reproduction of a voice with high quality.

With a regular voice synthesizing apparatus according to the present invention, meter patterns are developed successively in the direction of time axis according to voice-generating information, and a voice waveform is generated according to the meter patterns as well as to voice tone data selected according to similarity based on information indicating attribute of voice tone included in the voice-generating information; whereby a voice can be reproduced with a type of voice tone having highest similarity without using unsuitable types of voice tone, also displacement in patterns for the pitch of a voice is not generated when the voice waveform is generated. As a result, there is provided the advantage that it is possible to obtain a regular voice synthesizing apparatus enabling reproduction of a voice with high quality.

With a regular voice synthesizing apparatus according to the present invention, meter patterns are developed successively in the direction of time axis according to voice-generating information, and a voice waveform is generated according to the meter patterns as well as to voice tone data selected according to information indicating a type and attribute of voice tone included in the voice-generating information; whereby a voice can be reproduced with a type of voice tone having highest similarity without using an unsuitable type of voice tone even though there is not a directly specified type of the voice tone, also displacement in patterns for the pitch of a voice is not generated when the voice waveform is generated. As a result, there is provided the advantage that it is possible to obtain a regular voice synthesizing apparatus enabling reproduction of a voice with high quality.

With a regular voice synthesizing apparatus according to the present invention, the information indicating an attribute is any one of data on sex, age, a reference for voice pitch, clearness, and naturality, or a combination of two or more types of data described above; whereby an object for verifying an attribute of a voice-generating information storing means to an attribute of a voice tone data storing means is parameterized. As a result, there is provided the advantage that it is possible to obtain a regular voice synthesizing apparatus making it easier to select a type of voice tone.

With a regular voice synthesizing apparatus according to the present invention, a reference for pitch of a voice in a voice-generating information storing means is shifted to a reference for pitch of a voice in a voice tone data storing means when the voice is reproduced; whereby pitch for each voice relatively changes according to the shifted reference of voice pitch regardless of time period for phonemes. As a result, the reference for voice pitch becomes closer to that for voice tone, which makes it possible to obtain a regular voice synthesizing apparatus enabling improvement of voice quality.

With a regular voice synthesizing apparatus according to the present invention, when the voice is reproduced, a reference for voice pitch in a voice-generating information storing means is shifted according to a reference for pitch of a voice at an arbitrary point of time; whereby pitch for each voice relatively changes according to the shifted reference of voice pitch regardless of time period for phonemes. As a result, there is provided the advantage that it is possible to obtain a regular voice synthesizing apparatus enabling process voice tone by, for instance, making it closer to an intended voice quality according to a shift rate.

With a regular voice synthesizing apparatus according to the present invention, the references for voice pitch based on first and second information are an average frequency, a maximum frequency, or a minimum frequency of voice pitch, which makes it possible to obtain a regular voice synthesizing apparatus enabling easier determination of a reference for voice pitch.

With a regular voice synthesizing apparatus according to the present invention, voice tone data stored in a storage medium is read out to be stored in the voice tone data storing means; whereby it is possible to give variation to types of voice tone through the storage medium. As a result, there is provided the advantage that it is possible to obtain a regular voice synthesizing apparatus enabling application of a most suitable type of voice tone when the voice is reproduced.

With a regular voice synthesizing apparatus according to the present invention, voice tone data is received from an external device through a communication line, and the voice tone data is stored in the voce tone data storing means; whereby it is possible to give variation to types of voice tone through the communication line, and as a result there is provided the advantage that it is possible to obtain a regular voice synthesizing apparatus enabling application of a most suitable type of voice tone when the voice is reproduced.

With a regular voice synthesizing apparatus according to the present invention, voice-generating information stored in a storage medium is read out to be stored in the voce tone data storing means; whereby it is possible to obtain a regular voice synthesizing apparatus enabling preparation of required voice-generating information through the storage medium at any time.

With a regular voice synthesizing apparatus according to the present invention, voice-generating information is received from an external device through a communication line, and the voice-generating information is stored in a voice-generating information storing means; whereby it is possible to obtain a regular voice synthesizing apparatus enabling preparation of required voice-generating information through the communication line at any time.

With a regular voice making/editing apparatus according to the present invention, voice-generating information is made by providing voice data for either one of or both velocity and pitch of a voice based on an inputted natural voice so that each voice data is not dependent on a time lag between phonemes and has a level relative against the reference, and the voice-generating information is filed in the voice-generating information storing means; whereby it is possible to obtain a regular voice making/editing apparatus which can give velocity and pitch of a voice at an arbitrary point of time not dependent on the time lag between phonemes.

With a regular voice making/editing apparatus according to the present invention, voice data for either one of or both velocity and pitch of a voice is dispersed based on an inputted natural voice so that the voice data is not dependent on a time lag between phonemes and has a level relative against the reference; voice-generating information is made including types of voice tone; and the voice-generating information is filed in the voice-generating information storing means; whereby it is possible to obtain a regular voice making/editing apparatus which can give velocity and pitch of a voice at an arbitrary point of time not dependent on the time lag between phonemes and also makes it possible to specify a type of voice tone in the voice-generating information.

With a regular voice making/editing apparatus according to the present invention, voice data for either one of or both velocity and pitch of a voice is dispersed based on an inputted natural voice so that the voice data is not dependent on a time lag between phonemes and has a level relative against the reference; voice-generating information is made including an attribute of voice tone; and the voice-generating information is filed in the voice-generating information storing means; whereby it is possible to obtain a regular voice making/editing apparatus which can give velocity and pitch of a voice at an arbitrary point of time not dependent on the time lag between phonemes and also makes it possible to specify an attribute of voice tone in the voice-generating information.

With a regular voice making/editing apparatus according to the present invention, voice data for either one of or both velocity and pitch of a voice is dispersed based on an inputted natural voice so that the voice data is not dependent on a time lag between phonemes and has a level relative against the reference; voice-generating information is made including a type and attribute of voice tone; and the voice-generating information is filed in the voice-generating information storing means; whereby it is possible to obtain a regular voice making/editing apparatus which can give velocity and pitch of a voice at an arbitrary point of time not dependent on the time lag between phonemes and also makes it possible to specify a type or an attribute of voice tone in the voice-generating information.

With a regular voice making/editing apparatus according to the present invention, voice-generating information is made including data on phoneme and meter as information based on an inputted natural voice, and the voice-generating information is filed in the voice-generating information storing means; whereby it is possible to obtain a regular voice making/editing apparatus enabling preparation of voice-generating information for selection of a type of voice tone.

With a regular voice making/editing apparatus according to the present invention, voice-generating information is made including data on phoneme and meter based on an inputted natural voice as well as a type of voice tone, and the voice-generating information is filed in the voice-generating information storing means; whereby it is possible to obtain a regular voice making/editing apparatus making it possible to specify data on the type of voice tone in the voice-generating information.

With a regular voice making/editing apparatus according to the present invention, voice-generating information is made including data on phoneme and meter based on an inputted natural voice as well as an attribute of voice tone, and the voice-generating information is filed in the voice-generating information storing means; whereby it is possible to obtain a regular voice making/editing apparatus making it possible to specify data on the attribute of voice tone in the voice-generating information.

With a regular voice making/editing apparatus according to the present invention, voice-generating information is made including data on phoneme and meter based on an inputted natural voice as well as a type and an attribute of voice tone, and the voice-generating information is filed in the voice-generating information storing means; whereby it is possible to obtain a regular voice making/editing apparatus making it possible to specify data on the type and attribute of voice tone in the voice-generating information.

With a regular voice making/editing apparatus according to the present invention, for making and editing voice-generating information used in the regular voice synthesizing apparatus, a making means makes first information indicating a reference for voice pitch in a state where the first information is included in the voice-generating information; whereby it is possible to obtain a regular voice making/editing apparatus making it possible to specify a reference for voice pitch in the voice-generating information.

With the invention, each of the information is changed arbitrarily by a changing means in the making means; whereby it is possible to obtain a regular voice making/editing apparatus enabling change of information for improvement of quality of a voice.

With a regular voice synthesizing method according to the present invention, a regular voice synthesizing method comprises steps of developing meter patterns successive in the direction of time axis according to velocity and pitch of a voice not dependent on phonemes, and generating a voice waveform according to the meter patterns as well as to voice tone data selected according to voice-generating information; whereby the voice can be reproduced with a preferable type of voice tone without limiting the voice tone to any particular one, also displacement in patterns for the pitch of a voice is not generated when the voice waveform is generated. As a result, it is possible to obtain a regular voice synthesizing method enabling reproduction of a voice with high quality.

With a regular voice synthesizing method according to the present invention, a regular voice synthesizing method developing meter patterns successive in the direction of time axis according to velocity and pitch of a voice not dependent on phonemes, and generating a voice waveform according to the meter patterns as well as to voice tone data selected according to information indicating types of voice tone included in voice-generating information; whereby the voice can be reproduced with a most suitable type of voice tone specified directly from a plurality types of voice tone without limiting voice tone to any particular one, also displacement in patterns for the pitch of a voice is not generated when the voice waveform is generated. As a result, it is possible to obtain a regular voice synthesizing method enabling reproduction of a voice with high quality.

With a regular voice synthesizing method according to the present invention, a regular voice synthesizing method comprises steps of developing meter patterns successive in the direction of time axis according to velocity and pitch of a voice not dependent on phonemes, and generating a voice waveform according to the meter patterns as well as to voice tone data selected according to similarity based on information indicating attribute of voice tone included in voice-generating information; whereby the voice can be reproduced with a type of voice tone having highest similarity without using unsuitable types of voice tone, also displacement in patterns for the pitch of a voice is not generated when the voice waveform is generated. As a result, it is possible to obtain a regular voice synthesizing method enabling reproduction of a voice with high quality.

With a regular voice synthesizing method according to the present invention, a regular voice synthesizing method comprises steps of developing meter patterns successive in the direction of time axis according to velocity and pitch of a voice not dependent on phonemes, and generating a voice waveform according to the meter patterns as well as to voice tone data selected according to information indicating a type and attribute of voice tone included in voice-generating information; whereby the voice can be reproduced with a type of voice tone having highest similarity without using an unsuitable type of voice tone even though there is not a directly specified type of the voice tone, also displacement in patterns for the pitch of a voice is not generated when the voice waveform is generated. As a result, it is possible to obtain a regular voice synthesizing method enabling reproduction of a voice with high quality.

With a regular voice synthesizing method according to the present invention, a regular voice synthesizing method comprises steps of developing meter patterns successive in the direction of time axis according to voice-generating information, and generating a voice waveform according to the meter patterns as well as to voice tone data selected according to the voice-generating information; whereby a voice can be reproduced with a preferable type of voice tone without setting limit to specified voice tone, also displacement in patterns for pitch of a voice is not generated when the voice waveform is generated. As a result, it is possible to obtain a regular voice synthesizing method enabling reproduction of a voice with high quality.

With a regular voice synthesizing method according to the present invention, a regular voice synthesizing method comprises steps of developing meter patterns successive in the direction of time axis according to voice-generating information, and generating a voice waveform according to the meter patterns as well as to voice tone data selected according to information indicating types of voice tone included in the voice-generating information; whereby a voice can be reproduced with a most suitable type of voice tone specified directly from a plurality types of voice tone without setting limit to specified voice tone, also displacement in patterns for the pitch of a voice is not generated when the voice waveform is generated. As a result, it is possible to obtain a regular voice synthesizing method enabling reproduction of a voice with high quality.

With a regular voice synthesizing method according to the present invention, a regular voice synthesizing method comprises steps of developing meter patterns successive in the direction of time axis according to voice-generating information, and generating a voice waveform according to the meter patterns as well as to voice tone data selected according to similarity based on information indicating attribute of voice tone included in the voice-generating information; whereby a voice can be reproduced with a type of voice tone having highest similarity without using unsuitable types of voice tone, also displacement in patterns for the pitch of a voice is not generated when the voice waveform is generated. As a result, it is possible to obtain a regular voice synthesizing method enabling reproduction of a voice with high quality.

With a regular voice synthesizing method according to the present invention, a regular voice synthesizing method comprises steps of developing meter patterns successive in the direction of time axis according to voice-generating information, and generating a voice waveform according to the meter patterns as well as to voice tone data selected according to information indicating a type and attribute of voice tone included in the voice-generating information; whereby a voice can be reproduced with a type of voice tone having highest similarity without using an unsuitable type of voice tone even though there is not a directly specified type of the voice tone, also displacement in patterns for the pitch of a voice is not generated when the voice waveform is generated. As a result, it is possible to obtain a regular voice synthesizing method enabling reproduction of a voice with high quality.

With a regular voice synthesizing method according to the present invention, a regular voice synthesizing method comprises a step of shifting a reference for pitch of a voice in a voice-generating information storing means to a reference for pitch of a voice in a voice tone data storing means when the voice is reproduced; whereby pitch for each voice relatively changes according to the shifted reference of voice pitch regardless of time period for phonemes. As a result, the reference for voice pitch becomes closer to that for voice tone, makes it possible to obtain a regular voice synthesizing method enabling improvement of voice quality.

With a regular voice synthesizing method according to the present invention, a regular voice synthesizing method comprises a step of shifting a reference for pitch of a voice in a voice-generating information storing means according to a reference for arbitrary pitch of a voice when the voice is reproduced; whereby pitch for each voice relatively changes according to the shifted reference of voice pitch regardless of time period for phonemes. As a result, it is possible to obtain a regular voice synthesizing method making it possible to process voice tone by, for instance, making it closer to intended voice quality according to the shift rate or the like.

With a regular voice making/editing method according to the present invention, a regular voice making/editing method comprises steps of making voice-generating information by providing voice data for either one of or both velocity and pitch of a voice based on an inputted natural voice so that each voice data is not dependent on a time lag between phonemes and has a level relative against the reference, and filing the voice-generating information in the voice-generating information storing means; whereby it is possible to obtain a regular voice making/editing method enabling to give velocity and pitch of a voice at an arbitrary point of time not dependent on a time lag between phonemes at an arbitrary point of time.

With regular voice making/editing method according to the present invention, a regular voice making/editing method comprises steps of providing voice data for either one of or both velocity and pitch of a voice based on an inputted natural voice so that the voice data is not dependent on a time lag between phonemes and has a level relative against the reference, making voice-generating information including types of voice tone, and filing the voice-generating information in the voice-generating information storing means; whereby it is possible to obtain a regular voice making/editing method making it possible to give velocity and pitch of a voice at an arbitrary point of time not dependent on a time lag between phonemes and also to specify a type of voice tone in the voice-generating information.

With regular voice making/editing method according to the present invention, a regular voice making/editing method comprises steps of dispersing voice data for either one of or both velocity and pitch of a voice based on an inputted natural voice so that the voice data is not dependent on a time lag between phonemes and has a level relative against the reference, making voice-generating information including an attribute of voice tone, and filing the voice-generating information in the voice-generating information storing means; whereby it is possible to obtain a regular voice making/editing method making it possible to give velocity and pitch of a voice at an arbitrary point of time not dependent on a time lag between phonemes and also specify an attribute of voice tone in the voice-generating information.

With regular voice making/editing method according to the present invention, a regular voice making/editing method comprises steps of dispersing voice data for either one of or both velocity and pitch of a voice based on an inputted natural voice so that the voice data is not dependent on a time lag between phonemes and has a level relative against the reference, making voice-generating information including a type and attribute of voice tone, and filing the voice-generating information in the voice-generating information storing means; whereby it is possible to obtain a regular voice making/editing method enabling to give velocity and pitch of a voice at an arbitrary point of time not dependent on a time lag between phonemes and also to specify a type or an attribute of voice tone in the voice-generating information.

With regular voice making/editing method according to the present invention, a regular voice making/editing method comprises steps of making voice-generating information including data on phoneme and meter as information based on an inputted natural voice, and filing the voice-generating information in the voice-generating information storing means; whereby it is possible to obtain a regular voice making/editing method making it possible to make the voice-generating information for selection of a type of voice tone.

With regular voice making/editing method according to the present invention, a regular voice making/editing method comprises steps of making voice-generating information including data on phoneme and meter based on an inputted natural voice as well as a type of voice tone, and filing the voice-generating information in the voice-generating information storing means; whereby it is possible to obtain a regular voice making/editing method making it possible to give velocity and pitch of a voice at an arbitrary point of time not dependent on a time lag between phonemes and also to specify a type of voice tone in the voice-generating information.

With regular voice making/editing method according to the present invention, a regular voice making/editing method comprises steps of making voice-generating information including data on phoneme and meter based on an inputted natural voice as well as an attribute of voice tone, and filing the voice-generating information in the voice-generating information storing means; whereby it is possible to obtain a regular voice making/editing method making it possible to give velocity and pitch of a voice at an arbitrary point of time not dependent on a time lag between phonemes and also to specify an attribute of voice tone in the voice-generating information.

With regular voice making/editing method according to the present invention, a regular voice making/editing method comprises steps of making voice-generating information including data on phoneme and meter based on an inputted natural voice as well as a type and an attribute of voice tone, and filing the voice-generating information in the voice-generating information storing means; whereby it is possible to obtain a regular voice making/editing method making it possible to give velocity and pitch of a voice at an arbitrary point of time not dependent on a time lag between phonemes and also to specify a type or an attribute of voice tone.

With regular voice making/editing method according to the present invention, there is provided a regular voice making/editing method for making and editing voice-generating information used in a regular voice synthesizing method according to the above invention, said method comprising a making step makes first information indicating a reference for voice pitch in a state where the first information is included in the voice-generating information; whereby it is possible to obtain a regular voice making/editing method making it possible to specify a reference for voice pitch in the voice-generating information.

With regular voice making/editing method according to the present invention, there is provided a regular voice making/editing method comprising a changing step included in the making step which changes each of the information arbitrarily; whereby it is possible to obtain a regular voice making/editing method making it possible to change information for improvement of voice quality.

With a computer-readable medium according to the present invention, there are provided the steps of developing meter patterns successive in the direction of time axis according to velocity and pitch of a voice not dependent on phonemes, and generating a voice waveform according to the meter patterns as well as to voice tone data selected according to voice-generating information; whereby the voice can be reproduced with a preferable type of voice tone without limiting voice tone to any particular one, also displacement in patterns for the pitch of a voice is not generated when the voice waveform is generated. As a result, it is possible to obtain a storage medium from which a computer can read out a program making it possible for the computer to execute regular voice synthesizing processing enabling reproduction of a voice with high quality.

With a computer-readable medium according to the present invention, there are provided the steps of developing meter patterns successive in the direction of time axis according to velocity and pitch of a voice not dependent on phonemes, and generating a voice waveform according to the meter patterns as well as to voice tone data selected according to information indicating types of voice tone included in voice-generating information; whereby the voice can be reproduced with a most suitable type of voice tone specified directly from a plurality types of voice tone without limiting voice tone to any particular one, also displacement in patterns for the pitch of a voice is not generated when the voice waveform is generated. As a result, it is possible to obtain a storage medium from which a computer can read out a program making it possible for the computer to execute regular voice synthesizing processing enabling reproduction of a voice with high quality.

With a computer-readable medium according to the present invention, there are provided the steps of developing meter patterns successive in the direction of time axis according to velocity and pitch of a voice not dependent on phonemes, and generating a voice waveform according to the meter patterns as well as to voice tone data selected according to similarity based on information indicating attribute of voice tone included in voice-generating information; whereby the voice can be reproduced with a type of voice tone having highest similarity without using unsuitable types of voice tone, also displacement in patterns for the pitch of a voice is not generated when the voice waveform is generated. As a result, it is possible to obtain a storage medium from which a computer can read out a program making it possible for the computer to execute regular voice synthesizing processing enabling reproduction of a voice with high quality.

With a computer-readable medium according to the present invention, there are provided the steps of developing meter patterns successive in the direction of time axis according to velocity and pitch of a voice not dependent on phonemes, and generating a voice waveform according to the meter patterns as well as to voice tone data selected according to information indicating a type and attribute of voice tone included in voice-generating information; whereby the voice can be reproduced with a type of voice tone having highest similarity without using an unsuitable type of voice tone even though there is not a directly specified type of the voice tone, also displacement in patterns for the pitch of a voice is not generated when the voice waveform is generated. As a result, it is possible to obtain a storage medium from which a computer can read out a program making it possible for the computer to execute regular voice synthesizing processing enabling reproduction of a voice with high quality.

With a computer-readable medium according to the present invention, there are provided the steps of developing meter patterns successive in the direction of time axis according to voice-generating information, and generating a voice waveform according to the meter patterns as well as to voice tone data selected according to the voice-generating information; whereby a voice can be reproduced with a preferable type of voice tone without limiting voice tone to any particular one, also displacement in patterns for pitch of a voice is not generated when the voice waveform is generated. As a result, it is possible to obtain a storage medium from which a computer can read out a program making it possible for the computer to execute regular voice synthesizing processing enabling reproduction of a voice with high quality.

With a computer-readable medium according to the present invention, there are provided the steps of developing meter patterns successive in the direction of time axis according to voice-generating information, and generating a voice waveform according to the meter patterns as well as to voice tone data selected according to information indicating types of voice tone included in the voice-generating information; whereby a voice can be reproduced with a most suitable type of voice tone specified directly from a plurality types of voice tone without limiting voice tone to any particular one, also displacement in patterns for the pitch of a voice is not generated when the voice waveform is generated. As a result, it is possible to obtain a storage medium from which a computer can read out a program making it possible for the computer to execute regular voice synthesizing processing enabling reproduction of a voice with high quality.

With a computer-readable medium according to the present invention, there are provided the steps of developing meter patterns successive in the direction of time axis according to voice-generating information, and generating a voice waveform according to the meter patterns as well as to voice tone data selected according to similarity based on information indicating attribute of voice tone included in the voice-generating information; whereby a voice can be reproduced with a type of voice tone having highest similarity without using unsuitable types of voice tone, also displacement in patterns for the pitch of a voice is not generated when the voice waveform is generated. As a result, it is possible to obtain a storage medium from which a computer can read out a program making it possible for the computer to execute regular voice synthesizing processing enabling reproduction of a voice with high quality.

With a computer-readable medium according to the present invention, there are provided the steps of developing meter patterns successive in the direction of time axis according to voice-generating information, and generating a voice waveform according to the meter patterns as well as to voice tone data selected according to a type and attribute of voice tone included in the voice-generating information; whereby a voice can be reproduced with a type of voice tone having highest similarity without using an unsuitable type of voice tone even though there is not a directly specified type of the voice tone, also displacement in patterns for the pitch of a voice is not generated when the voice waveform is generated. As a result, it is possible to obtain a storage medium from which a computer can read out a program making it possible for the computer to execute regular voice synthesizing processing enabling reproduction of a voice with high quality.

With a computer-readable medium according to the present invention, there is provided a step of shifting a reference for pitch of a voice in a voice-generating information storing means according to a reference for pitch of a voice in a voice tone data storing means when the voice is reproduced; whereby pitch for each voice relatively changes according to the shifted reference of voice pitch regardless of time period for phonemes. As a result, the reference for voice pitch becomes closer to that for voice tone. As a result, it is possible to obtain a storage medium from which a computer can read out a program making it possible for the computer to execute regular voice synthesizing processing enabling improvement of voice quality.

With a computer-readable medium according to the present invention, there is provided a step of shifting a reference for pitch of a voice in a voice-generating information storing means according to a reference for arbitrary pitch of a voice when the voice is reproduced; whereby pitch for each voice relatively changes according to the shifted reference of voice pitch regardless of time period for phonemes. As a result, it is possible to obtain a storage medium from which a computer can read out a program making it possible for the computer to execute regular voice synthesizing processing enabling processing of voice tone by, for instance, making it closer to an intended voice quality according to a shift rate.

With a computer-readable medium according to the present invention, there are provided the steps of making voice-generating information by dispersing voice data for either one of or both velocity and pitch of a voice based on an inputted natural voice so that each voice data is not dependent on a time lag between phonemes and has a level relative against the reference, and filing the voice-generating information in the voice-generating information storing means; whereby it is possible to obtain a storage medium from which a computer can read out a program for execution of regular voice making/editing processing making it possible to give velocity and pitch of a voice at an arbitrary point of time not dependent on the time lag between phonemes.

With a computer-readable medium according to the present invention, there are provided the steps of dispersing voice data for either one of or both velocity and pitch of a voice based on an inputted natural voice so that the voice data is not dependent on a time lag between phonemes and has a level relative against the reference, making voice-generating information including types of voice tone, and filing the voice-generating information in the voice-generating information storing means; whereby it is possible to obtain a storage medium from which a computer can read out a program for execution of regular voice making/editing processing making it possible to give velocity and pitch of a voice at an arbitrary point of time not dependent on the time lag between phonemes and also to specify a type of voice tone in the voice-generating information.

With a computer-readable medium according to the present invention, there are provided the steps of dispersing voice data for either one of or both velocity and pitch of a voice based on an inputted natural voice so that the voice data is not dependent on a time lag between phonemes and has a level relative against the reference, making voice-generating information including an attribute of voice tone, and filing the voice-generating information in the voice-generating information storing means; whereby it is possible to obtain a storage medium from which a computer can read out a program for execution of regular voice making/editing processing making it possible to give velocity and pitch of a voice at an arbitrary point of time not dependent on the time lag between phonemes and also to specify an attribute of voice tone in the voice-generating information.

With a computer-readable medium according to the present invention, there are provided the steps of dispersing voice data for either one of or both velocity and pitch of a voice based on an inputted natural voice so that the voice data is not dependent on a time lag between phonemes and has a level relative against the reference, making voice-generating information including a type and attribute of voice tone, and filing the voice-generating information in the voice-generating information storing means; whereby it is possible to obtain a storage medium from which a computer can read out a program for execution of regular voice making/editing processing making it possible to give velocity and pitch of a voice at an arbitrary point of time not dependent on the time lag between phonemes and also to specify a type or an attribute of voice tone in the voice-generating information.

With a computer-readable medium according to the present invention, there are provided the steps of making voice-generating information including data on phoneme and meter as information based on an inputted natural voice, and filing the voice-generating information in the voice-generating information storing means; whereby it is possible to obtain a storage medium from which a computer can read out a program for execution of regular voice making/editing processing making it possible to make the voice-generating information for selection of a type of voice tone.

With a computer-readable medium according to the present invention, there are provided the steps of making voice-generating information including data on phoneme and meter based on an inputted natural voice as well as a type of voice tone, and filing the voice-generating information in the voice-generating information storing means; whereby it is possible to obtain a storage medium from which a computer can read out a program for execution of regular voice making/editing processing making it possible to give velocity and pitch of a voice at an arbitrary point of time not dependent on the time lag between phonemes and also to specify a type of voice tone in the voice-generating information.

With a computer-readable medium according to the present invention, there are provided the steps of making voice-generating information including data on phoneme and meter based on an inputted natural voice as well as an attribute of voice tone, and filing the voice-generating information in the voice-generating information storing means; whereby it is possible to obtain a storage medium from which a computer can read out a program for execution of regular voice making/editing processing making it possible to give velocity and pitch of a voice at an arbitrary point of time not dependent on the time lag between phonemes and also to specify an attribute of voice tone in the voice-generating information.

With a computer-readable medium according to the present invention, there are provided the steps of making voice-generating information including data on phoneme and meter based on an inputted natural voice as well as a type and an attribute of voice tone, and filing the voice-generating information in the voice-generating information storing means; whereby it is possible to obtain a storage medium from which a computer can read out a program for execution of regular voice making/editing processing making it possible to give velocity and pitch of a voice at an arbitrary point of time not dependent on the time lag between phonemes and also to specify a type or an attribute of voice tone in the voice-generating information.

With a computer-readable medium according to the present invention, there is provided a regular voice making/editing method for making and editing voice-generating information used in a regular voice synthesizing method according to claim 55 or claim 56, said method comprising a step of making first information included in the voice-generating information and indicating a reference for voice pitch; whereby it is possible to obtain a storage medium from which a computer can read out a program for execution of regular voice making/editing processing making it possible to specify a reference for voice pitch in the voice-generating information.

With a computer-readable medium according to the present invention, there is provided a step of changing each of the information arbitrarily according to the changing step in the making step; whereby it is possible to obtain a storage medium from which a computer can read out a program for execution of regular voice making/editing processing making it possible to change information for improvement of voice quality.

This application is based on Japanese patent application No. HEI 8-324457 filed in the Japanese Patent Office on Dec. 4, 1996, the entire contents of which are hereby incorporated by reference.

It should be recognized that the sequence of steps, that comprise the processing for generating synthesized speech or creating and or/editing data otherwise related thereto, as illustrated in flow chars or otherwise described in the specification, may be stored, in whole or in part, for any finite duration in whole or in part, within computer-readable media. Such media may comprise, for example, but without limitation, a RAM, hard disc, floppy disc, ROM, including CD ROM, and memory of various types as now known or hereinafter developed. Such media also may comprise buffers, registers and transmission media, alone or as part of an entire communication network, such as the Internet.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A regular voice synthesizing apparatus comprising:

a voice-generating information storing means for storing therein voice-generating information comprising discrete voice data for at least one of velocity and pitch of a voice correlated to a time lag between each said discrete voice data, and made by dispensing each discrete data for at least one of velocity and pitch of a voice so that the voice data is not dependent on a time lag between phonemes and at the same time present at a level relative to a reference;

a voice tone data storing means for storing therein a plurality of types of voice tone data indicating sound parameters of each raw voice element for each tone type;

a selecting means for selecting one type of voice tone data from said plurality of types of voice tone data stored in said voice tone data storing means according to voice-generating information stored in said voice-generating information storing means;

a developing means for developing meter patterns successively in the direction of a time axis according to at least one of velocity and pitch of a voice included in the voice-generating information stored in said voice-generating information storing means as well as to the time lag; and a voice reproducing means for generating a voice waveform according to the meter patterns developed by said developing means as well as to the voice tone data selected by said selecting means.

2. A regular voice synthesizing apparatus according to claim 1, wherein said voice-generating information storing means stores first information indicating a reference for pitch of a voice in a state where the first information is included in the voice-generating information, said voice tone data storing means stores second information indicating a reference for pitch of a voice in a state where the second information is included in said voice tone data, and said voice reproducing means decides a reference for pitch of a voice when the voice is reproduced by shifting the reference for voice pitch based on the first information to the reference for voice pitch based on the second information.

3. A regular voice synthesizing apparatus according to claim 2, wherein the references for voice pitch based on the first and second information are at least one an average frequency, a maximum frequency, or a minimum frequency of voice pitch.

4. A regular voice synthesizing apparatus according to claim 1, wherein said voice-generating information storing means stores first information indicating a reference for pitch of a voice in a state where the first information is included in the voice-generating information, said voice reproducing means has an input means for inputting the second information indicating a reference for voice pitch at an arbitrary point of time, and decides a reference for voice pitch when the voice is reproduced by shifting the reference for voice pitch based on the first information to the reference for voice pitch based on the second information.

5. A regular voice synthesizing apparatus according to claim 4, wherein the references for voice pitch based on the first and second information are at least one of an average frequency, a maximum frequency, or a minimum frequency of voice pitch.

6. A regular voice synthesizing apparatus according to claim 1, wherein said regular voice synthesizing apparatus further comprises a detachable storage medium with voice tone data stored therein, reads out voice tone data from said storage medium and stores the voice tone data in said voice tone data storing means.

7. A regular voice synthesizing apparatus according to claim 1, wherein said regular voice synthesizing apparatus receives voice tone data through a communication line from an external device and stores the voice tone data in said voice tone data storing means.

8. A regular voice synthesizing apparatus according to claim 1 wherein said regular voice synthesizing apparatus further comprises a detachable storage medium for storing therein voice-generating information, reads out voice-generating information from said storage medium and stores the voice-generating information in said voice-generating information storing medium.

9. A regular voice synthesizing apparatus according to claim 1, wherein said regular voice synthesizing apparatus receives voice-generating information through a communication line from an external device and stores the voice-generating information in said voice-generating information storing means.

10. A regular voice synthesizing apparatus comprising:

a voice-generating information storing means for storing therein voice-generating information comprising discrete voice data for at least one of velocity or pitch of a voice correlated to a time lag and data for a type of voice tone inserted between each said discrete voice data, and made by dispensing each discrete data for at least one of velocity and pitch of a voice so that the voice data is not dependent on a time lag between phonemes and at the same time present at a level relative to a reference;

a voice tone data storing means for a plurality of types of storing therein voice tone data indicating sound parameters for each raw voice element for each type of voice tone;

a selecting means for selecting a type of voice tone data corresponding to each type of voice tone in the voice-generating information stored in said voice-generating information storing means from said plurality of types of voice tone data stored in said voice tone data storing means;

a developing means for developing meter patterns successively in the direction of a time axis according to voice data for at least one of velocity and pitch of a voice included in the voice-generating information stored in said voice-generating information storing means as well as to the time lag; and a voice reproducing means for generating a voice waveform according to the meter patterns developed by said developing means as well as to the voice tone data selected by said selecting means.

11. A regular voice synthesizing apparatus according to claim 10, wherein said voice-generating information storing means stores first information indicating a reference for pitch of a voice in a state where the first information is included in the voice-generating information, said voice tone data storing means stores second information indicating a reference for pitch of a voice in a state where the second information is included in said voice tone data, and said voice reproducing means decides a reference for pitch of a voice when the voice is reproduced by shifting the reference for voice pitch based on the first information to the reference for voice pitch based on the second information.

12. A regular voice synthesizing apparatus according to claim 11, wherein the references for voice pitch based on the first and second information are at least one of an average frequency, a maximum frequency, or a minimum frequency of voice pitch.

13. A regular voice synthesizing apparatus according to claim 12, wherein said voice-generating information storing means stores first information indicating a reference for pitch of a voice in a state where the first information is included in the voice-generating information, said voice reproducing means has an input means for inputting the second information indicating a reference for voice pitch at an arbitrary point of time, and decides a reference for voice pitch when the voice is reproduced by shifting the reference for voice pitch based on the first information to the reference for voice pitch based on the second information.

14. A regular voice synthesizing apparatus according to claim 13 wherein the references for voice pitch based on the first and second information are at least one of an average frequency, a maximum frequency, or a minimum frequency of voice pitch.

15. A regular voice synthesizing apparatus according to claim 10, wherein said regular voice synthesizing apparatus further comprises a detachable storage medium with voice tone data stored therein, reads out voice tone data from said storage medium and stores the voice tone data in said voice tone data storing means.

16. A regular voice synthesizing apparatus according to claim 10, wherein said regular voice synthesizing apparatus receives voice tone data through a communication line from an external device and stores the voice tone data in said voice tone data storing means.

17. A regular voice synthesizing apparatus according to claim 10, wherein said regular voice synthesizing apparatus further comprises a detachable storage medium for storing therein voice-generating information, reads out voice-generating information from said storage medium and stores the voice-generating information in said voice-generating information storing medium.

18. A regular voice synthesizing apparatus according to claim 10, wherein said regular voice synthesizing apparatus receives voice-generating information through a communication line from an external device and stores the voice-generating information in said voice-generating information storing means.

19. A regular voice synthesizing apparatus comprising:

a voice-generating information storing means for storing therein voice-generating information comprising discrete voice data for at least one of velocity and pitch of a voice correlated to a time lag between each said discrete voice data and data for attribute of the voice tone inserted between each discrete voice data, and made by dispensing said discrete voice data for at least one of velocity and pitch of a voice so that the voice data is not dependent on a time lag between phonemes and at the same time present at a level relative to a reference;

a voice tone data storing means for storing therein a plurality of types of voice tone data indicating sound parameters for each raw voice element with information indicating an attribute of the voice tone correlated thereto for each type of voice tone;

a verifying means for verifying information indicating attributes of a voice tone included in voice-generating information stored in said voice-generating information storing means to information indicating attributes of each type of voice tone stored in said voice tone data storing means to obtain similarity of the voice tone;

a selecting means for selecting voice tone data having the highest similarity from said plurality types of voice tone data stored in said voice tone data storing means according to the similarity obtained by said verifying means;

a developing means for developing meter patterns successively in the direction of a time axis according to voice data for at least one of velocity and pitch of a voice included in the voice-generating information stored in said voice-generating information storing means as well as to the time lag; and a voice reproducing means for generating a voice waveform according to the meter patterns developed by said developing means as well as to the voice tone data selected by said selecting means.

20. A regular voice synthesizing apparatus according to claim 19, wherein said voice-generating information storing means stores first information indicating a reference for pitch of a voice in a state where the first information is included in the voice-generating information, said voice tone data storing means stores second information indicating a reference for pitch of a voice in a state where the second information is included in said voice tone data, and said voice reproducing means decides a reference for pitch of a voice when the voice is reproduced by shifting the reference for voice pitch based on the first information to the reference for voice pitch based on the second information.

21. A regular voice synthesizing apparatus according to claim 20, wherein the references for voice pitch based on the first and second information are at least one of an average frequency, a maximum frequency, or a minimum frequency of voice pitch.

22. A regular voice synthesizing apparatus according to claim 19, wherein said voice-generating information storing means stores first information indicating a reference for pitch of a voice in a state where the first information is included in the voice-generating information, said voice reproducing means has an input means for inputting the second information indicating a reference for voice pitch at an arbitrary point of time, and decides a reference for voice pitch when the voice is reproduced by shifting the reference for voice pitch based on the first information to the reference for voice pitch based on the second information.

23. A regular voice synthesizing apparatus according to claim 22, wherein the references for voice pitch based on the first and second information are at least one of an average frequency, a maximum frequency, or a minimum frequency of voice pitch.

24. A regular voice synthesizing apparatus according to claim 19, wherein said information indicating an attribute is any one of data based on sex, age, a reference for voice pitch, clearness, and naturality, or a combination of two or more types of such data.

25. A regular voice synthesizing apparatus according to claim 19, wherein said regular voice synthesizing apparatus further comprises a detachable storage medium with voice tone data stored therein, reads out voice tone data from said storage medium and stores the voice tone data in said voice tone data storing means.

26. A regular voice synthesizing apparatus according to claim 19, wherein said regular voice synthesizing apparatus receives voice tone data through a communication line from an external device and stores the voice tone data in said voice tone data storing means.

27. A regular voice synthesizing apparatus according to claim 19, wherein said regular voice synthesizing apparatus further comprises a detachable storage medium for storing therein voice-generating information, reads out voice-generating information from said storage medium and stores the voice-generating information in said voice-generating information storing medium.

28. A regular voice synthesizing apparatus according to claim 19, wherein said regular voice synthesizing apparatus receives voice-generating information through a communication line from an external device and stores the voice-generating information in said voice-generating information storing means.

29. A regular voice synthesizing apparatus comprising:

a voice-generating information storing means for storing therein voice-generating information comprising discrete voice data for at least one of velocity and pitch of a voice correlated to a time lag between each discrete voice data, data on a type of the voice tone, and an attribute of the voice tone, and made by dispensing said discrete voice data for at least one of velocity and pitch of a voice so that the voice data is not dependent on a time lag between phonemes and at the same time is present at a level relative to a reference;

a voice tone data storing means for storing therein a plurality of types of voice tone data indicating sound parameters for each raw voice element correlated to information indicating an attribute of the voice tone for each type of voice tone;

a retrieving means for retrieving a type of voice tone in the voice-generating information stored in said voice-generating information storing means from said plurality of types of voice tone stored in said voice tone data storing means;

a first selecting means for selecting, in a case where a type of voice tone in the voice-generating information was obtained through retrieval by said retrieving means, voice tone data corresponding to the retrieved type of voice tone from said plurality of types of voice tone data stored in said voice tone data storing means;

a verifying means for verifying, in a case where a type of voice tone in the voice-generating information was not obtained through retrieval by said retrieving means, information indicating an attribute of the voice tone in the voice-generating information stored in said voice-generating information storing means to information indicating attributes of various types of voice tone stored in said voice tone data storing means to obtain similarity of the voice tone;

a second selecting means for selecting voice tone data with the highest similarity from a plurality of types of voice tone data stored in said voice tone data storing means according to the similarity obtained by said verifying means;

a developing means for developing meter patterns successively in the direction of a time axis according to voice data for at least one of velocity and pitch of a voice included in the voice-generating information stored in said voice-generating information storing means as well as to a time lag between each discrete voice data; and a voice reproducing means for generating a voice waveform according to the meter patterns developed by said developing means as well as to the voice tone data selected by said first or second selecting means.

30. A regular voice synthesizing apparatus according to claim 29, wherein said voice-generating information storing means stores first information indicating a reference for pitch of a voice in a state where the first information is included in the voice-generating information, said voice tone data storing means stores second information indicating a reference for pitch of a voice in a state where the second information is included in said voice tone data, and said voice reproducing means determines a reference for pitch of a voice when the voice is reproduced by shifting the reference for voice pitch based on the first information to the reference for voice pitch based on the second information.

31. A regular voice synthesizing apparatus according to claim 30, wherein the references for voice pitch based on the first and second information are at least one of an average frequency, a maximum frequency, or a minimum frequency of voice pitch.

32. A regular voice synthesizing apparatus according to claim 29, wherein said voice-generating information storing means stores first information indicating a reference for pitch of a voice in the state where the first information is included in the voice-generating information, said voice reproducing means has an input means for inputting the second information indicating a reference for voice pitch at an arbitrary point of time, and decides a reference for voice pitch when the voice is reproduced by shifting the reference for voice pitch based on the first information to the reference for voice pitch based on the second information.

33. A regular voice synthesizing apparatus according to claim 32, wherein the references for voice pitch based on the first and second information are an average frequency, a maximum frequency, or a minimum frequency of voice pitch.

34. A regular voice synthesizing apparatus according to claim 29, wherein said information indicating an attribute is any one of data on sex, age, a reference for voice pitch, clearness, and naturality, or a combination of two or more types of such data.

35. A regular voice synthesizing apparatus according to claim 29, wherein said regular voice synthesizing apparatus further comprises a detachable storage medium with voice tone data stored therein, reads out voice tone data from said storage medium and stores the voice tone data in said voice tone data storing means.

36. A regular voice synthesizing apparatus according to claim 29, wherein said regular voice synthesizing apparatus receives voice tone data through a communication line from an external device and stores the voice tone data in said voice tone data storing means.

37. A regular voice synthesizing apparatus according to claim 29, wherein said regular voice synthesizing apparatus further comprises a detachable storage medium for storing therein voice-generating information, reads out voice-generating information from said storage medium and stores the voice-generating information in said voice-generating information storing medium.

38. A regular voice synthesizing apparatus according to claim 29 wherein said regular voice synthesizing apparatus receives voice-generating information through a communication line from an external device and stores the voice-generating information in said voice-generating information storing means.

39. A regular voice synthesizing apparatus comprising:

a voice-generating information storing means for storing therein voice-generating information including data for phoneme and meter as information;

a voice tone data storing means for storing therein voice tone data indicating sound parameters for each raw voice element such as phoneme for each of a plurality of types of voice tone;

a selecting means for selecting one type of voice tone data from said plurality of types of voice tone data stored in said voice tone data storing means according to the voice-generating information stored in said voice-generating information storing means;

a developing means for developing meter patterns successively in the direction of a time axis according to the voice-generating information stored in said voice-generating information storing means; and a voice tone reproducing means for generating a voice waveform according to the meter patterns developed by said developing means as well as to the voice tone data selected by said selecting means.

40. A regular voice synthesizing apparatus according to claim 39, wherein said voice-generating information storing means stores first information indicating a reference for pitch of a voice in a state where the first information is included in the voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

41. A regular voice synthesizing apparatus according to claim 40, wherein the references for voice pitch based on the first and second information are at least one of an average frequency, a maximum frequency, or a minimum frequency of voice pitch.

42. A regular voice synthesizing apparatus according to claim 39, wherein said voice-generating information storing means stores first information indicating a reference for pitch of a voice in the state where the first information is included in the voice-generating information, said voice reproducing means has an input means for inputting the second information indicating a reference for voice pitch at an arbitrary point of time, and decides a reference for voice pitch when the voice is reproduced by shifting the reference for voice pitch based on the first information to the reference for voice pitch based on the second information.

43. A regular voice synthesizing apparatus according to claim 42, wherein the references for voice pitch based on the first and second information are at least one of an average frequency, a maximum frequency, or a minimum frequency of voice pitch.

44. A regular voice synthesizing apparatus according to claim 39, wherein said regular voice synthesizing apparatus further comprises a detachable storage medium with voice tone data stored therein, reads out voice tone data from said storage medium and stores the voice tone data in said voice tone data storing means.

45. A regular voice synthesizing apparatus according to claim 39, wherein said regular voice synthesizing apparatus receives voice tone data through a communication line from an external device and stores the voice tone data in said voice tone data storing means.

46. A regular voice synthesizing apparatus according to claim 39, wherein said regular voice synthesizing apparatus further comprises a detachable storage medium for storing therein voice-generating information, reads out voice-generating information from said storage medium and stores the voice-generating information in said voice-generating information storing medium.

47. A regular voice synthesizing apparatus according to claim 39, wherein said regular voice synthesizing apparatus receives voice-generating information through a communication line from an external device and stores the voice-generating information in said voice-generating information storing means.

48. A regular voice synthesizing apparatus comprising:

a voice-generating information storing means for storing therein voice-generating information including data for phonemes, meters, and a type of voice tone as information;

a voice tone data storing means for storing therein a plurality of types of voice tone data indicating sound parameters for each raw voice element for each type of voice tone;

a selecting means for selecting voice tone data corresponding to a type of voice tone in the voice-generating information stored in said voice-generating information storing means from said plurality types of voice tone data stored in said voice tone data storing means;

a developing means for developing meter patterns successively in the direction of a time axis according to voice-generating information stored in said voice-generating information storing means; and a voice reproducing means for generating a voice waveform according to the meter patterns developed by said developing means as well as to the voice tone data selected by said selecting means.

49. A regular voice synthesizing apparatus according to claim 48, wherein said voice-generating information storing means stores first information indicating a reference for pitch of a voice in a state where the first information is included in the voice-generating information, said voice tone data storing means stores second information indicating a reference for pitch of a voice in the state where second information is included in said voice tone data, and said voice reproducing means determines a reference for pitch of a voice when the voice is reproduced by shifting a reference for voice pitch based on the first information to the reference for voice pitch based on the second information.

50. A regular voice synthesizing apparatus according to claim 49, wherein the references for voice pitch based on the first and second information are at least one of an average frequency, a maximum frequency, or a minimum frequency of voice pitch.

51. A regular voice synthesizing apparatus according to claim 48, wherein said voice-generating information storing means stores first information indicating a reference for pitch of a voice in the state where the first information is included in the voice-generating information, said voice reproducing means has an input means for inputting second information indicating a reference for voice pitch at an arbitrary point of time, and decides a reference for voice pitch when the voice is reproduced by shifting the reference for voice pitch based on the first information to the reference for voice pitch based on the second information.

52. A regular voice synthesizing apparatus according to claim 51, wherein the references for voice pitch based on the first and second information are at least one of an average frequency, a maximum frequency, or a minimum frequency of voice pitch.

53. A regular voice synthesizing apparatus according to claim 48, wherein said regular voice synthesizing apparatus further comprises a detachable storage medium with voice tone data stored therein, reads out voice tone data from said storage medium and stores the voice tone data in said voice tone data storing means.

54. A regular voice synthesizing apparatus according to claim 48, wherein said regular voice synthesizing apparatus receives voice tone data through a communication line from an external device and stores the voice tone data in said voice tone data storing means.

55. A regular voice synthesizing apparatus according to claim 48, wherein said regular voice synthesizing apparatus further comprises a detachable storage medium for storing therein voice-generating information, reads out voice-generating information from said storage medium and stores the voice-generating information in said voice-generating information storing medium.

56. A regular voice synthesizing apparatus according to claim 48, wherein said regular voice synthesizing apparatus receives voice-generating information through a communication line from an external device and stores the voice-generating information in said voice-generating information storing means.

57. A regular voice synthesizing apparatus comprising:

a voice-generating information storing means for storing therein voice-generating information including data for phoneme, meter, and attribute of a voice as information;

a voice tone data storing means for storing therein a plurality of types of voice tone data indicating sound parameters for each raw voice element for each type of voice tone correlated to information indicating an attribute of the voice tone;

a verifying means for verifying information indicating an attribute of a voice tone in the voice-generating information stored in said voice-generating information storing means to the information indicating attributes of various types of voice tone stored in said voice tone data storing means to obtain a similarity of the voice tone;

a selecting means for selecting voice tone data having the high similarity from said plurality types of voice tone data stored in said voice tone data storing means according to the similarity obtained by said verifying means;

a developing means for developing meter patterns successively in the direction of a time axis according to the voice-generating information stored in said voice-generating information storing means; and a voice reproducing means for generating a voice waveform according to the meter patterns developed by said developing means as well as to the voice tone data selected by said selecting means.

58. A regular voice synthesizing apparatus according to claim 57, wherein said voice-generating information storing means stores first information indicating a reference for pitch of a voice in a state where the first information is included in the voice-generating information, said voice tone data storing means stores second information indicating a reference for pitch of a voice in the state where second information is included in said voice tone data, and said voice reproducing means decides a reference for pitch of a voice when the voice is reproduced by shifting the reference for voice pitch based on the first information to the reference for voice pitch based on the second information.

59. A regular voice synthesizing apparatus according to claim 58 wherein the references for voice pitch based on the first and second information are at least one of an average frequency, a maximum frequency, or a minimum frequency of voice pitch.

60. A regular voice synthesizing apparatus according to claim 57, wherein said voice-generating information storing means stores first information indicating a reference for pitch of a voice in the state where the first information is included in the voice-generating information, said voice reproducing means has an input means for inputting second information indicating a reference for voice pitch at an arbitrary point of time, and decides a reference for voice pitch when the voice is reproduced by shifting the reference for voice pitch based on the first information to the reference for voice pitch based on the second information.

61. A regular voice synthesizing apparatus according to claim 60, wherein the references for voice pitch based on the first and second information are at least one of an average frequency, a maximum frequency, or a minimum frequency of voice pitch.

62. A regular voice synthesizing apparatus according to claim 57, wherein said information indicating an attribute is any at least one of data on sex, age, a reference for voice pitch, clearness, and naturality.

63. A regular voice synthesizing apparatus according to claim 57, wherein said regular voice synthesizing apparatus further comprises a detachable storage medium with voice tone data stored therein, reads out voice tone data from said storage medium and stores the voice tone data in said voice tone data storing means.

64. A regular voice synthesizing apparatus according to claim 57, wherein said regular voice synthesizing apparatus receives voice tone data through a communication line from an external device and stores the voice tone data in said voice tone data storing means.

65. A regular voice synthesizing apparatus according to claim 57, wherein said regular voice synthesizing apparatus further comprises a detachable storage medium for storing therein voice-generating information, reads out voice-generating information from said storage medium and stores the voice-generating information in said voice-generating information storing medium.

66. A regular voice synthesizing apparatus according to claim 57, wherein said regular voice synthesizing apparatus receives voice-generating information through a communication line from an external device and stores the voice-generating information in said voice-generating information storing means.

67. A regular voice synthesizing apparatus comprising:

a voice-generating information storing means for storing therein voice-generating information including data for phoneme, meter, a type of voice tone, and an attribute of voice tone as information;

a voice tone storing means for storing therein various types of voice tone data indicating sound parameters for each raw voice element for each type of voice tone correlated to the information indicating an attribute of the voice tone;

a retrieving means for retrieving a type of voice tone included in the voice-generating information stored in said voice-generating information storing means from said various types of voice tone stored in said voice tone data storing means;

a first selecting means for selecting, in a case where a type of voice tone including in said voice-generating information was obtained through retrieval by said retrieving means, voice tone data corresponding to the retrieved voice tone from said various types of voice tone data stored in said voice tone data storing means;

a verifying means for verifying, in a case where a type of voice tone in the voice-generating information could not be obtained through retrieval by said retrieving means, the information indicating an attribute of voice tone in the voice-generating information stored in said voice-generating information storing means to the information indicating attributes of said various types of voice tone stored in said voice tone data storing means to obtain a similarity of the voice tone;

a second selecting means for selecting voice tone data having the highest similarity from a plurality types of voice tone data stored in said voice tone data storing means according to the similarity obtained by said verifying means;

a developing means for developing meter patterns successively in the direction of a time axis according to the voice-generating information stored in said voice-generating information storing means; and a voice reproducing means for generating a voice waveform according to the meter patterns developed by said developing means as well as to the voice tone data selected by said first or second selecting means.

68. A regular voice synthesizing apparatus according to claim 67, wherein said voice-generating information storing means stores first information indicating a reference for pitch of a voice in a state where the first information is included in the voice-generating information, said voice tone data storing means stores second information indicating a reference for pitch of a voice in a state where the second information is included in said voice tone data, and said voice reproducing means decides a reference for pitch of a voice when the voice is reproduced by shifting the reference for voice pitch based on the first information to the reference for voice pitch based on the second information.

69. A regular voice synthesizing apparatus according to claim 68, wherein the references for voice pitch based on the first and second information are at least one of an average frequency, a maximum frequency, or a minimum frequency of voice pitch.

70. A regular voice synthesizing apparatus according to claim 68, wherein said voice-generating information storing means stores first information indicating a reference for pitch of a voice in the state where the first information is included in the voice-generating information, said voice reproducing means has an input means for inputting the second information indicating a reference for voice pitch at an arbitrary point of time, and decides a reference for voice pitch when the voice is reproduced by shifting the reference for voice pitch based on the first information to the reference for voice pitch based on the second information.

71. A regular voice synthesizing apparatus according to claim 70, wherein the references for voice pitch based on the first and second information are an average frequency, a maximum frequency, or a minimum frequency of voice pitch.

72. A regular voice synthesizing apparatus according to claim 67, wherein said information indicating an attribute is any one of data on sex, age, a reference for voice pitch, clearness, and naturality, or a combination of two or more types of data described above.

73. A regular voice synthesizing apparatus according to claim 67, wherein said regular voice synthesizing apparatus further comprises a detachable storage medium with voice tone data stored therein, reads out voice tone data from said storage medium and stores the voice tone data in said voice tone data storing means.

74. A regular voice synthesizing apparatus according to claim 67, wherein said regular voice synthesizing apparatus receives voice tone data through a communication line from an external device and stores the voice tone data in said voice tone data storing means.

75. A regular voice synthesizing apparatus according to claim 67, wherein said regular voice synthesizing apparatus further comprises a detachable storage medium for storing therein voice-generating information, reads out voice-generating information from said storage medium and stores the voice-generating information in said voice-generating information storing medium.

76. A regular voice synthesizing apparatus according to claim 67, wherein said regular voice synthesizing apparatus receives voice-generating information through a communication line from an external device and stores the voice-generating information in said voice-generating information storing means.

77. A regular voice synthesizing method for synthesizing a voice, in which voice-generating information comprising discrete voice data for at least one of velocity and pitch of a voice correlated to a time lag between each discrete voice data, and made by outputting said discrete voice data so that the voice data is not dependent on a time lag between phonemes and at the same time is present at a level relative to a reference, is previously stored in a voice-generating information storing section, and in which voice tone data indicating sound parameters for each raw voice element is previously stored in a voice tone data storing section, and a voice is synthesized according to the voice-generating information stored in said voice-generating information storing section as well as to the voice tone data stored in said voice tone data storing section, said regular voice synthesizing method comprising the steps of:

selecting one voice tone data from a plurality types of voice tone data previously stored in said voice tone data storing section according to the voice-generating information previously stored in the voice-generating information storing section;

developing meter patterns successively in the direction of a time axis according to the voice data for either one of or both velocity and pitch of the voice included in the voice-generating information previously stored in said voice-generating information storing section as well as to the time lag; and reproducing a voice waveform according to the meter patterns developed in said developing step as well as to the voice tone data selected in said selecting step.

78. A regular voice synthesizing method according to claim 77, further comprising:

storing in said voice-generating information storing section first information indicating a reference for voice pitch in a state where the first information is included in the voice-generating information, storing in said voice tone data storing section second information indicating a reference for voice pitch in a state where the second information is included in the voice tone data, and selecting a reference for voice pitch when a voice is reproduced by shifting the reference for voice pitch based on the first information to the reference for voice pitch based on the second information in the voice reproducing step.

79. A regular voice synthesizing method according to claim 77, further comprising storing in said voice-generating information storing section first information indicating a reference for voice pitch in a state where a first information is included in the voice-generating information, and wherein said voice reproducing step includes an input step for inputting second information indicating a reference for voice pitch, and wherein a reference for voice pitch when a voice is reproduced is decided in the reproducing step by shifting the reference for voice pitch based on the first information to the reference for voice pitch based on the second information.

80. A regular voice synthesizing method for synthesizing a voice, in which voice-generating information comprising discrete voice data for either one of or both velocity or pitch of a voice correlated to a time lag and data for a type of voice tone inserted between each discrete voice data, and made by dispensing each discrete data for at least one of velocity and pitch of a voice so that the voice data is not dependent on a time lag between phonemes and at the same time present at a level relative to a reference is previously stored in a voice-generating information storing section, and in which voice tone data indicating sound parameters for each raw voice element is previously stored in a voice tone data storing section, and a voice is synthesized according to the voice-generating information stored in said voice-generating information storing section as well as to the voice tone data stored in the voice tone data storing section, said regular voice synthesizing method comprising the steps of:

selecting a type of voice tone data corresponding to each type of voice tone in the voice-generating information previously stored in said voice-generating information storing section from a plurality types of voice tone data previously stored in said voice tone data storing section;

developing meter patterns successively in the direction of a time axis according to voice data for either one of or both velocity and pitch of a voice included in the voice-generating information stored in said voice-generating information storing section as well as to the time lag; and reproducing a voice waveform according to the meter patterns developed in said developing step as well as to the voice tone data selected in said selecting step.

81. A regular voice synthesizing method according to claim 80, further comprising:

storing in said voice-generating information storing section first information indicating a reference for voice pitch in a state where the first information is included in the voice-generating information, storing in said voice tone data storing section second information indicating a reference for voice pitch in a state where the second information is included in the voice tone data, and selecting a reference for voice pitch when a voice is reproduced by shifting the reference for voice pitch based on the first information to the reference for voice pitch based on the second information in the voice reproducing step.

82. A regular voice synthesizing method according to claim 80, further comprising storing in said voice-generating information storing section first information indicating a reference for voice pitch in a state where a first information is included in the voice-generating information, and wherein said voice reproducing step includes an input step for inputting second information indicating a reference for voice pitch, and wherein a reference for voice pitch when a voice is reproduced is decided in the reproducing step by shifting the reference for voice pitch based on the first information to the reference for voice pitch based on the second information.

83. A regular voice synthesizing method for synthesizing a voice, in which voice-generating information comprising discrete voice data for at least one of velocity and pitch of a voice correlated to a time lag between each discrete voice data and data for attribute of the voice tone inserted between each discrete voice data, and made by oututting said discrete voice data for at least one or both velocity and pitch of a voice so that the voice data is not dependent on a time lag between phonemes and at the same time present at a level relative to the reference is previously stored in a voice-generating information storing section, voice tone data indicating sound parameters for each raw voice element with information indicating an attribute of the voice tone correlated thereto is previously stored in a voice tone data storing section, and a voice is synthesized according to the voice-generating information stored in said voice-generating information storing section as well as to the voice tone data stored in the voice tone data storing section, said regular voice synthesizing method comprising the steps of:

verifying information indicating attributes of a voice tone included in voice-generating information stored in said voice-generating information storing section to information indicating attributes of each type of voice tone stored in said voice tone data storing section to obtain a similarity of the voice tone;

selecting voice tone data having the highest similarity from a plurality of types of voice tone data stored in said voice tone data storing section according to the similarity obtained in said verifying step;

developing meter patterns successively in the direction of a time axis according to voice data for either one of or both velocity and pitch of a voice included in the voice-generating information stored in said voice-generating information storing section as well as to the time lag; and reproducing a voice waveform according to the meter patterns developed in said developing step as well as to the voice tone data selected in said selecting step.

84. A regular voice synthesizing method according to claim 83, further comprising:

storing in said voice-generating information storing section first information indicating a reference for voice pitch in a state where the first information is included in the voice-generating information, storing in said voice tone data storing section second information indicating a reference for voice pitch in a state where the second information is included in the voice tone data, and selecting a reference for voice pitch when a voice is reproduced by shifting the reference for voice pitch based on the first information to the reference for voice pitch based on the second information in the voice reproducing step.

85. A regular voice synthesizing method according to claim 83, further comprising storing in said voice-generating information storing section first information indicating a reference for voice pitch in a state where a first information is included in the voice-generating information, and wherein said voice reproducing step includes an input step for inputting second information indicating a reference for voice pitch, and wherein a reference for voice pitch when a voice is reproduced is decided in the reproducing step by shifting the reference for voice pitch based on the first information to the reference for voice pitch based on the second information.

86. A regular voice synthesizing method for synthesizing a voice, in which voice-generating information comprising discrete voice data for at least one of velocity and pitch of a voice correlated to a time lag between each discrete voice data, data on a type of the voice tone, and an attribute of the voice tone, and made by outputting said discrete voice data for at least one of velocity and pitch of a voice so that the voice data is not dependent on a time lag between phonemes and at the same time is present at a level relative to a reference, is previously stored in a voice-generating information storing section, voice tone data indicating sound parameters for each raw voice element correlated to information indicating an attribute of the voice tone is previously stored in a voice tone data storing section, and a voice is synthesized according to the voice-generating information stored in said voice-generating information storing section as well as to the voice tone data stored in the voice tone data storing section, said regular voice synthesizing method comprising the steps of:

retrieving a type of voice tone in the voice-generating information previously stored in said voice-generating information storing section from various types of voice tone previously stored in said voice tone data storing section;

firstly selecting, in a case where a type of voice tone in the voice-generating information was obtained through retrieval in said retrieving step, voice tone data corresponding to the retrieved type of voice tone from various types of voice tone data previously stored in said voice tone data storing section;

verifying, in a case where a type of voice tone in the voice-generating information was not obtained through retrieval in said retrieving step, information indicating an attribute of the voice tone in the voice-generating information previously stored in said voice-generating information storing section to information indicating attributes of various types of voice tone previously stored in said voice tone data storing section to a obtain similarity of the voice tone;

secondly selecting voice tone data with the highest similarity from a plurality types of voice tone data previously stored in said voice tone data storing section according to the similarity obtained in said verifying step;

developing meter patterns successively in the direction of a time axis according to voice data for at least one of velocity and pitch of a voice included in the voice-generating information previously stored in said voice-generating information storing section as well as to a time lag between each discrete voice data; and reproducing a voice waveform according to the meter patterns developed in said developing step as well as to the voice tone data selected in said first or second selecting step.

87. A regular voice synthesizing method according to claim 86, further comprising:

storing in said voice-generating information storing section first information indicating a reference for voice pitch in a state where the first information is included in the voice-generating information, storing in said voice tone data storing section second information indicating a reference for voice pitch in a state where the second information is included in the voice tone data, and selecting a reference for voice pitch when a voice is reproduced by shifting the reference for voice pitch based on the first information to the reference for voice pitch based on the second information in the voice reproducing step.

88. A regular voice synthesizing method according to claim 86, further comprising storing in said voice-generating information storing section first information indicating a reference for voice pitch in a state where a first information is included in the voice-generating information, and wherein said voice reproducing step includes an input step for inputting second information indicating a reference for voice pitch, and wherein a reference for voice pitch when a voice is reproduced is decided in the reproducing step by shifting the reference for voice pitch based on the first information to the reference for voice pitch based on the second information.

89. A regular voice synthesizing method for synthesizing a voice, in which voice-generating information including data for phoneme and meter as information is previously stored in a voice-generating information storing section, voice tone data indicating sound parameters for each raw voice element is previously stored in a voice tone data storing section, and a voice is synthesized according to the voice-generating information stored in said voice-generating information storing section as well as to the voice tone data stored in the voice tone data storing section, said regular voice synthesizing method comprising the steps of:

selecting one voice tone data from a plurality of types of voice tone data previously stored in said voice tone data storing section according to the voice-generating information previously stored in said voice-generating information storing section;

developing meter patterns successively in the direction of a time axis according to the voice-generating information previously stored in said voice-generating information storing section; and reproducing a voice waveform according to the meter patterns developed in said developing step as well as to the voice tone data selected in said selecting step.

90. A regular voice synthesizing method according to claim 89, further comprising:

storing in said voice-generating information storing section first information indicating a reference for voice pitch in a state where the first information is included in the voice-generating information, storing in said voice tone data storing section second information indicating a reference for voice pitch in a state where the second information is included in the voice tone data, and selecting a reference for voice pitch when a voice is reproduced by shifting the reference for voice pitch based on the first information to the reference for voice pitch based on the second information in the voice reproducing step.

91. A regular voice synthesizing method according to claim 89, further comprising storing in said voice-generating information storing section first information indicating a reference for voice pitch in a state where a first information is included in the voice-generating information, and wherein said voice reproducing step includes an input step for inputting second information indicating a reference for voice pitch, and wherein a reference for voice pitch when a voice is reproduced is decided in the reproducing step by shifting the reference for voice pitch based on the first information to the reference for voice pitch based on the second information.

92. A regular voice synthesizing method for synthesizing a voice, in which voice-generating information including data for phonemes, meters, and a type of voice tone as information is previously stored in a voice-generating information storing section, voice tone data indicating sound parameters for each raw voice element, phonemes for each type of voice tone, is previously stored in a voice tone data storing section, and a voice is synthesized according to the voice-generating information stored in said voice-generating information storing section as well as to the voice tone data stored in the voice tone data storing section, said regular voice synthesizing method comprising the steps of:

selecting voice tone data corresponding to a type of voice tone in the voice-generating information previously stored in said voice-generating information storing section from a plurality types of voice tone data previously stored in said voice tone data storing section;

developing meter patterns successively in the direction a of time axis according to voice-generating information stored in said voice-generating information storing section; and reproducing a voice waveform according to the meter patterns developed in said developing step as well as to the voice tone data selected in said selecting step.

93. A regular voice synthesizing method according to claim 92, further comprising:

storing in said voice-generating information storing section first information indicating a reference for voice pitch in a state where the first information is included in the voice-generating information, storing in said voice tone data storing section second information indicating a reference for voice pitch in a state where the second information is included in the voice tone data, and selecting a reference for voice pitch when a voice is reproduced by shifting the reference for voice pitch based on the first information to the reference for voice pitch based on the second information in the voice reproducing step.

94. A regular voice synthesizing method according to claim 92, further comprising storing in said voice-generating information storing section first information indicating a reference for voice pitch in a state where a first information is included in the voice-generating information, and wherein said voice reproducing step includes an input step for inputting second information indicating a reference for voice pitch, and wherein a reference for voice pitch when a voice is reproduced is decided in the reproducing step by shifting the reference for voice pitch based on the first information to the reference for voice pitch based on the second information.

95. A regular voice synthesizing method for synthesizing a voice, in which voice-generating information including data for phoneme, meter, and attribute of a voice as information is previously stored in a voice-generating information storing section, voice tone data indicating sound parameters for each raw voice element correlated to information indicating an attribute of the voice tone is previously stored in a voice tone data storing section, and a voice is synthesized according to the voice-generating information stored in said voice-generating information storing section as well as to the voice tone data stored in the voice tone data storing section, said regular voice synthesizing method comprising the steps of:

verifying information indicating an attribute of a voice tone in the voice-generating information stored in said voice-generating information storing section to the information indicating attributes of various types of voice tone stored in said voice tone data storing section to obtain a similarity of the voice tone;

selecting voice tone data having the high similarity from a plurality types of voice tone data stored in said voice tone storing section according to the similarity obtained in said verifying step;

developing meter patterns successively in the direction of a time axis according to the voice-generating information stored in said voice-generating information storing section; and reproducing a voice waveform according to the meter patterns developed in said developing step as well as to the voice tone data selected in said selecting step.

96. A regular voice synthesizing method according to claim 95, further comprising:

storing in said voice-generating information storing section first information indicating a reference for voice pitch in a state where the first information is included in the voice-generating information, storing in said voice tone data storing section second information indicating a reference for voice pitch in a state where the second information is included in the voice tone data, and selecting a reference for voice pitch when a voice is reproduced by shifting the reference for voice pitch based on the first information to the reference for voice pitch based on the second information in the voice reproducing step.

97. A regular voice synthesizing method according to claim 95, further comprising storing in said voice-generating information storing section first information indicating a reference for voice pitch in a state where a first information is included in the voice-generating information, and wherein said voice reproducing step includes an input step for inputting second information indicating a reference for voice pitch, and wherein a reference for voice pitch when a voice is reproduced is decided in the reproducing step by shifting the reference for voice pitch based on the first information to the reference for voice pitch based on the second information.

98. A regular voice synthesizing method for synthesizing a voice, in which voice-generating information including data for phoneme, meter, a type of voice tone, and an attribute of voice tone as information is previously stored in a voice-generating information storing section, voice tone data indicating sound parameters for each raw voice element correlated to the information indicating an attribute of the voice tone is previously stored in a voice tone storing section, and in which a voice is synthesized according to the voice-generating information stored in said voice-generating information storing section as well as to the voice tone data stored in the voice tone data storing section, said regular voice synthesizing method comprising the steps of:

retrieving a type of voice tone included in the voice-generating information previously stored in said voice-generating information storing section from various types of voice tone previously stored in said voice tone data storing section;

firstly selecting, in a case where a type of voice tone included in said voice-generating information was obtained through retrieval in said retrieving step, voice tone data corresponding to the retrieved voice tone from various types of voice tone data previously stored in said voice tone data storing section;

verifying, in a case where a type of voice tone in the voice-generating information could not be obtained through retrieval in said retrieving step, the information indicating an attribute of voice tone in the voice-generating information previously stored in said voice-generating information storing section to the information indicating attributes of various types of voice tone previously stored in said voice tone data storing section to obtain a similarity of the voice tone;

secondly selecting voice tone data having the highest similarity from a plurality types of voice tone data previously stored in said voice tone data storing section according to the similarity obtained in said verifying step;

developing meter patterns successively in the direction of a time axis according to the voice-generating information previously stored in said voice-generating information storing section; and reproducing a voice waveform according to the meter patterns developed in said developing step as well as to the voice tone data selected in said first or second selecting step.

99. A regular voice synthesizing method according to claim 98, further comprising:

storing in said voice-generating information storing section first information indicating a reference for voice pitch in a state where the first information is included in the voice-generating information, storing in said voice tone data storing section second information indicating a reference for voice pitch in a state where the second information is included in the voice tone data, and selecting a reference for voice pitch when a voice is reproduced by shifting the reference for voice pitch based on the first information to the reference for voice pitch based on the second information in the voice reproducing step.

100. A regular voice synthesizing method according to claim 98, further comprising storing in said voice-generating information storing section first information indicating a reference for voice pitch in a state where a first information is included in the voice-generating information, and wherein said voice reproducing step includes an input step for inputting second information indicating a reference for voice pitch, and wherein a reference for voice pitch when a voice is reproduced is decided in the reproducing step by shifting the reference for voice pitch based on the first information to the reference for voice pitch based on the second information.

101. A computer-readable medium from which a computer can read out a program enabling execution of a regular voice synthesizing sequence for synthesizing a voice, by previously storing voice-generating information comprising discrete voice data for at least one of velocity and pitch of a voice correlated to a time lag between each discrete voice data, and made by providing said voice data for at least one of velocity and pitch of a voice so that the voice data is not dependent on a time lag between phonemes and at the same time is present at a level relative against to a reference in a voice-generating information storing section, and also previously storing voice tone data indicating sound parameters for each raw voice element in a voice tone data storing section, and by reading out the voice-generating information stored in said voice-generating information storing section and the voice tone data stored in said voice tone data storing section, said voice program comprising:

a selecting sequence for selecting one voice tone data from a plurality of types of voice tone data previously stored in said voice tone data storing section according to the voice-generating information previously stored in said voice-generating information storing section;

a developing sequence for developing meter patterns successively in the direction of a time axis according to voice data for at least one of velocity and pitch of a voice included in the voice-generating information previously stored in said voice-generating information storing section as well as to the time lag; and a voice reproducing sequence for generating a voice waveform according to the meter patterns developed in said developing sequence as well as to the voice tone data selected in the selecting sequence.

102. A computer-readable medium from which a computer can read out a program according to claim 101, wherein said voice-generating information storing section stores therein first information indicating a reference for voice pitch in a state where the first information is included in the voice-generating information, said voice tone data storing section stores therein second information indicating a reference for voice pitch in a state where the second information is included in the voice tone data, and the voice program further comprises a sequence for deciding a reference for voice pitch when a voice is reproduced by shifting the reference for voice pitch based on the first information to the reference for voice pitch based on the second information in the voice reproducing sequence.

103. A computer-readable medium from which a computer can read out a program according to claim 101, wherein said voice-generating information storing section stores therein first information indicating a reference for voice pitch in the state where the first information is included in the voice-generating information, said voice reproducing sequence includes an input sequence for inputting second information indicating a reference for voice pitch, and a reference for voice pitch when a voice is reproduced is decided in the voice reproducing sequence by shifting the reference for voice pitch based on the first information to the reference for voice pitch based on the second information.

104. A computer-readable medium from which a computer can read out a program enabling execution of a regular voice synthesizing sequence for synthesizing a voice, by previously storing voice-generating information comprising discrete voice data for at least one of velocity or pitch of a voice correlated to a time lag and data for a type of voice tone inserted between each discrete voice data, and made by providing each discrete data for at least one of velocity and pitch of a voice so that the voice data is not dependent on a time lag between phonemes and at the same time present at a level relative to a the reference in a voice-generating information storing section, also previously storing voice tone data indicating sound parameters for each raw voice element in a voice tone data storing section and by reading out the voice-generating information stored in said voice-generating information storing section and the voice tone data stored in the voice tone data storing section, said voice program comprising:

a selecting sequence for selecting a type of voice tone data corresponding to each type of voice tone in the voice-generating information previously stored in said voice-generating information storing section from a plurality of types of voice tone data previously stored in said voice tone data storing section;

a developing sequence for developing meter patterns successively in the direction of a time axis according to voice data for at least one of velocity and pitch of a voice included in the voice-generating information stored in said voice-generating information storing section as well as to the time lag; and a voice reproducing sequence for generating a voice waveform according to the meter patterns developed in said developing sequence as well as to the voice tone data selected in said selecting sequence.

105. A computer-readable medium from which a computer can read out a program according to claim 104, wherein said voice-generating information storing section stores therein first information indicating a reference for voice pitch in a state where the first information is included in the voice-generating information, said voice tone data storing section stores therein second information indicating a reference for voice pitch in a state where the second information is included in the voice tone data, and the voice program further comprises a sequence for deciding a reference for voice pitch when a voice is reproduced by shifting the reference for voice pitch based on the first information to the reference for voice pitch based on the second information in the voice reproducing sequence.

106. A computer-readable medium from which a computer can read out a program according to claim 104, wherein said voice-generating information storing section stores therein first information indicating a reference for voice pitch in the state where the first information is included in the voice-generating information, said voice reproducing sequence includes an input sequence for inputting second information indicating a reference for voice pitch, and a reference for voice pitch when a voice is reproduced is decided in the voice reproducing sequence by shifting the reference for voice pitch based on the first information to the reference for voice pitch based on the second information.

107. A computer-readable medium from which a computer can read out a program enabling execution of a regular voice synthesizing sequence for synthesizing a voice, by previously storing voice-generating information comprising discrete voice data for at least one of velocity and pitch of a voice with a time lag between each discrete voice data and data for attributes of the voice tone inserted between each discrete voice data, and made by providing said discrete voice data for at least one of velocity and pitch of a voice so that the voice data is not dependent on a time lag between phonemes and at the same time is present at a level relative to a reference in a voice-generating information storing section, previously storing voice tone data indicating sound parameters for each raw voice element with information indicating an attribute of the voice tone correlated thereto in a voice tone data storing section, and by reading out the voice-generating information stored in said voice-generating information storing section and the voice tone data stored in the voice tone data storing section, said voice program comprising:

a verifying sequence for verifying information indicating attributes of a voice tone included in voice-generating information stored in said voice-generating information storing section to information indicating attributes of each type of voice tone stored in said voice tone data storing section to obtain a similarity of the voice tone;

a selecting sequence for selecting voice tone data having the highest similarity from a plurality types of voice tone data stored in said voice tone data storing section according to the similarity obtained in said verifying sequence;

a developing sequence for developing meter patterns successively in the direction of a time axis according to voice data for at least one of velocity and pitch of a voice included in the voice-generating information stored in said voice-generating information storing section as well as to the time lag; and a voice reproducing sequence for generating a voice waveform according to the meter patterns developed in said developing sequence as well as to the voice tone data selected in said selecting sequence.

108. A computer-readable medium from which a computer can read out a program according to claim 107, wherein said voice-generating information storing section stores therein first information indicating a reference for voice pitch in a state where the first information is included in the voice-generating information, said voice tone data storing section stores therein second information indicating a reference for voice pitch in a state where the second information is included in the voice tone data, and the voice program further comprises a sequence for deciding a reference for voice pitch when a voice is reproduced by shifting the reference for voice pitch based on the first information to the reference for voice pitch based on the second information in the voice reproducing sequence.

109. A computer-readable medium from which a computer can read out a program according to claim 107, wherein said voice-generating information storing section stores therein first information indicating a reference for voice pitch in the state where the first information is included in the voice-generating information, said voice reproducing sequence includes an input sequence for inputting second information indicating a reference for voice pitch, and a reference for voice pitch when a voice is reproduced is decided in the voice reproducing sequence by shifting the reference for voice pitch based on the first information to the reference for voice pitch based on the second information.

110. A computer-readable medium from which a computer can read out a program enabling execution of a regular voice synthesizing sequence for synthesizing a voice, by previously storing voice-generating information comprising discrete voice data for at least one of velocity and pitch of a voice correlated to a time lag between each discrete voice data, data on a type of the voice tone, and an attribute of the voice tone, and made by providing said discrete voice data for at least one of velocity and pitch of a voice so that the voice data is not dependent on a time lag between phonemes and at the same time is present at a level relative to a reference in a voice-generating information storing section, previously storing voice tone data indicating sound parameters for each raw voice element correlated to information indicating an attribute of the voice tone in a voice tone data storing section, and by reading out the voice-generating information stored, in said voice-generating information storing section and the voice tone data stored in the voice tone data storing section, said voice program comprising:

a retrieving sequence for retrieving a type of voice tone in the voice-generating information previously stored in said voice-generating information storing section from various types of voice tone previously stored in said voice tone data storing section;

a first selecting sequence for selecting, in a case where a type of voice tone in the voice-generating information was obtained through retrieval in said retrieving sequence, voice tone data corresponding to the retrieved type of voice tone from various types of voice tone data previously stored in said voice tone data storing section;

a verifying sequence for verifying, in a case where a type of voice tone in the voice-generating information was not obtained through retrieval in said retrieving sequence, information indicating an attribute of the voice tone in the voice-generating information previously stored in said voice-generating information storing section to information indicating attributes of various types of voice tone previously stored in said voice tone data storing section to obtain a similarity of the voice tone;

a second selecting sequence for selecting voice tone data with the highest similarity from a plurality types of voice tone data previously stored in said voice tone data storing section according to the similarity obtained in said verifying sequence;

a developing sequence for developing meter patterns successively in the direction of a time axis according to voice data for either one of or both velocity and pitch of a voice included in the voice-generating information stored in said voice-generating information storing section as well as to a time lag between each discrete voice data; and a voice reproducing sequence for generating a voice waveform according to the meter patterns developed in said developing sequence as well as to the voice tone data selected in at least one of said first or second selecting sequence.

111. A computer-readable medium from which a computer can read out a program according to claim 110, wherein said voice-generating information storing section stores therein first information indicating a reference for voice pitch in a state where the first information is included in the voice-generating information, said voice tone data storing section stores therein second information indicating a reference for voice pitch in a state where the second information is included in the voice tone data, and the voice program further comprises a sequence for deciding a reference for voice pitch when a voice is reproduced by shifting the reference for voice pitch based on the first information to the reference for voice pitch based on the second information in the voice reproducing sequence.

112. A computer-readable medium from which a computer can read out a program according to claim 110, wherein said voice-generating information storing section stores therein first information indicating a reference for voice pitch in the state where the first information is included in the voice-generating information, said voice reproducing sequence includes an input sequence for inputting second information indicating a reference for voice pitch, and a reference for voice pitch when a voice is reproduced is decided in the voice reproducing sequence by shifting the reference for voice pitch based on the first information to the reference for voice pitch based on the second information.

113. A computer-readable medium from which a computer can read out a program enabling execution of a regular voice synthesizing sequence for synthesizing a voice, by previously storing voice-generating information including data for phoneme and meter as information in a voice-generating information storing section, previously storing voice tone data indicating sound parameters for each raw voice element in a voice tone data storing section, and by reading out the voice-generating information stored in said voice-generating information storing section and the voice tone data stored in the voice tone data storing section, said voice program comprising:

a selecting sequence for selecting one voice tone data from a plurality of types of voice tone data previously stored in said voice tone data storing section according to the voice-generating information previously stored in said voice-generating information storing section;

a developing sequence for developing meter patterns successively in the direction of a time axis according to the voice-generating information previously stored in said voice-generating information storing section; and a voice reproducing sequence for generating a voice waveform according to the meter patterns developed in said developing sequence as well as to the voice tone data selected in said selecting sequence.

114. A computer-readable medium from which a computer can read out a program according to claim 113, wherein said voice-generating information storing section stores therein first information indicating a reference for voice pitch in a state where the first information is included in the voice-generating information, said voice tone data storing section stores therein second information indicating a reference for voice pitch in a state where the second information is included in the voice tone data, and the voice program further comprises a sequence for deciding a reference for voice pitch when a voice is reproduced by shifting the reference for voice pitch based on the first information to the reference for voice pitch based on the second information in the voice reproducing sequence.

115. A computer-readable medium from which a computer can read out a program according to claim 113, wherein said voice-generating information storing section stores therein first information indicating a reference for voice pitch in the state where the first information is included in the voice-generating information, said voice reproducing sequence includes an input sequence for inputting second information indicating a reference for voice pitch, and a reference for voice pitch when a voice is reproduced is decided in the voice reproducing sequence by shifting the reference for voice pitch based on the first information to the reference for voice pitch based on the second information.

116. A computer-readable medium from which a computer can read out a program enabling execution of a regular voice synthesizing sequence for synthesizing a voice, by previously storing voice-generating information including data for phonemes, meters, and a type of voice tone as information in a voice-generating information storing section, previously storing voice tone data indicating sound parameters for each raw voice element in a voice tone data storing section, and by reading out the voice-generating information stored in said voice-generating information storing section and the voice tone data stored in the voice tone data storing section, said voice program comprising:

a selecting sequence for selecting voice tone data corresponding to a type of voice tone in the voice-generating information previously stored in said voice-generating information storing section from a plurality of types of voice tone data previously stored in said voice tone data storing section;

a developing sequence for developing meter patterns successively in the direction of a time axis according to voice-generating information stored in said voice-generating information storing section; and a voice reproducing sequence for generating a voice waveform according to the meter patterns developed in said developing sequence as well as to the voice tone data selected in said selecting sequence.

117. A computer-readable medium from which a computer can read out a program according to claim 116, wherein said voice-generating information storing section stores therein first information indicating a reference for voice pitch in a state where the first information is included in the voice-generating information, said voice tone data storing section stores therein second information indicating a reference for voice pitch in a state where the second information is included in the voice tone data, and the voice program further comprises a sequence for deciding a reference for voice pitch when a voice is reproduced by shifting the reference for voice pitch based on the first information to the reference for voice pitch based on the second information in the voice reproducing sequence.

118. A computer-readable medium from which a computer can read out a program according to claim 116, wherein said voice-generating information storing section stores therein first information indicating a reference for voice pitch in the state where the first information is included in the voice-generating information, said voice reproducing sequence includes an input sequence for inputting second information indicating a reference for voice pitch, and a reference for voice pitch when a voice is reproduced is decided in the voice reproducing sequence by shifting the reference for voice pitch based on the first information to the reference for voice pitch based on the second information.

119. A computer-readable medium from which a computer can read out a program enabling execution of a regular voice synthesizing sequence for synthesizing a voice, by previously storing voice-generating information including data for phoneme, meter, and attribute of a voice as information in a voice-generating information storing section, previously storing voice tone data indicating sound parameters for each raw voice element correlated to information indicating an attribute of the voice tone in a voice tone data storing section, and by reading out the voice-generating information stored in said voice-generating information storing section and the voice tone data stored in the voice tone data storing section, said voice program comprising:

a verifying sequence for verifying information indicating an attribute of a voice tone in the voice-generating information stored in said voice-generating information storing section to the information indicating attributes of various types of voice tone stored in said voice tone data storing section to obtain a similarity of the voice tones;

a selecting sequence for selecting voice tone data having a high similarity from a plurality types of voice tone data stored in said voice tone storing section according to the similarity obtained in said verifying sequence;

a developing sequence for developing meter patterns successively in the direction of a time axis according to the voice-generating information stored in said voice-generating information storing section; and a voice reproducing sequence for generating a voice waveform according to the meter patterns developed in said developing sequence as well as to the voice tone data selected in said selecting sequence.

120. A computer-readable medium from which a computer can read out a program according to claim 119, wherein said voice-generating information storing section stores therein first information indicating a reference for voice pitch in a state where the first information is included in the voice-generating information, said voice tone data storing section stores therein second information indicating a reference for voice pitch in a state where the second information is included in the voice tone data, and the voice program further comprises a sequence for deciding a reference for voice pitch when a voice is reproduced by shifting the reference for voice pitch based on the first information to the reference for voice pitch based on the second information in the voice reproducing sequence.

121. A computer-readable medium from which a computer can read out a program according to claim 119, wherein said voice-generating information storing section stores therein first information indicating a reference for voice pitch in the state where the first information is included in the voice-generating information, said voice reproducing sequence includes an input sequence for inputting second information indicating a reference for voice pitch, and a reference for voice pitch when a voice is reproduced is decided in the voice reproducing sequence by shifting the reference for voice pitch based on the first information to the reference for voice pitch based on the second information.

122. A computer-readable medium from which a computer can read out a program enabling execution of a regular voice synthesizing sequence for synthesizing a voice, by previously storing voice-generating information including data for phoneme, meter, a type of voice tone, and an attribute of voice tone as information in a voice-generating information storing section, previously storing voice tone data indicating sound parameters for each raw voice element correlated to the information indicating an attribute of the voice tone in a voice tone storing section, and by reading out the voice-generating information stored in said voice-generating information storing section and the voice tone data stored in the voice tone data storing section, said voice program comprising:

a retrieving sequence for retrieving a type of voice tone included in the voice-generating information previously stored in said voice-generating information storing section from a plurality of types of voice tone previously stored in said voice tone data storing section;

a first selecting sequence for selecting, in a case where a type of voice tone including in said voice-generating information was obtained through retrieval in said retrieving sequence, voice tone data corresponding to the retrieved voice tone from a plurality of types of voice tone data previously stored in said voice tone data storing section;

a verifying sequence for verifying, in a case where a type of voice tone in the voice-generating information could not be obtained through retrieval in said retrieving sequence, the information indicating an attribute of voice tone in the voice-generating information previously stored in said voice-generating information storing section to the information indicating attributes of various types of voice tone previously stored in said voice tone data storing section to obtain a similarity of the voice tone;

a second selecting sequence for selecting voice tone data having the highest similarity from a plurality types of voice tone data previously stored in said voice tone data storing section according to the similarity obtained in said verifying sequence;

a developing sequence for developing meter patterns successively in the direction of a time axis according to the voice-generating information previously stored in said voice-generating information storing section; and a voice reproducing sequence for generating a voice waveform according to the meter patterns developed in said developing sequence as well as to the voice tone data selected in said first or second selecting sequence.

123. A computer-readable medium from which a computer can read out a program according to claim 122, wherein said voice-generating information storing section stores therein first information indicating a reference for voice pitch in a state where the first information is included in the voice-generating information, said voice tone data storing section stores therein second information indicating a reference for voice pitch in a state where the second information is included in the voice tone data, and the voice program further comprises a sequence for deciding a reference for voice pitch when a voice is reproduced by shifting the reference for voice pitch based on the first information to the reference for voice pitch based on the second information in the voice reproducing sequence.

124. A computer-readable medium from which a computer can read out a program according to claim 122, wherein said voice-generating information storing section stores therein first information indicating a reference for voice pitch in the state where the first information is included in the voice-generating information, said voice reproducing sequence includes an input sequence for inputting second information indicating a reference for voice pitch, and a reference for voice pitch when a voice is reproduced is decided in the voice reproducing sequence by shifting the reference for voice pitch based on the first information to the reference for voice pitch based on the second information.

125. A voice synthesizing apparatus comprising:

a storage for first voice data comprising at least one of pitch data and velocity data, said first voice data being independent of phonemes, second voice data comprising at least one of voice tone data and pitch shift data, and third voice data comprising language-based phoneme data;

a first processing means responsive to said first voice data for developing time sequential meter patterns;

a second processing means responsive to said time sequential meter patterns and to said second voice data for generating a synthesized speech waveform, including pitch frequency.

126. The voice synthesizing apparatus as set forth in claim 125 wherein said second processing means is responsive to said third voice data.

127. The voice synthesizing apparatus as set forth in claim 126 further comprising a third processing means for providing said pitch shift data to said second processing means on the basis of reference pitch data stored in said storage.

128. The voice synthesizing apparatus as set forth in claim 125 wherein said second voice data is based on an inputted natural voice.

129. The voice synthesizing apparatus as set forth in claim 128 further comprising a fourth processing means for receiving a natural voice and storing a first voice data representation of said natural voice in said store.

130. The voice synthesizing apparatus as set forth in claim 126 further comprising an edit processing means for editing any of said first, second or third voice data.

131. The voice synthesizing apparatus as set forth in claim 126 further comprising a third processing means for providing said tone data to said second processing means on the basis of information indicating voice tone attributes.

132. A voice synthesizing method comprising:

storing first voice data comprising at least one of pitch data and velocity data, said first voice data being independent of phonemes, second voice data comprising at least one of voice tone data and pitch shift data, and third voice data comprising language-based phoneme data;

conducting a first processing of said first voice data for developing time sequential meter patterns;

conducting a second processing of said time sequential meter patterns and said second voice data for generating a synthesized speech waveform; and outputting said speech waveform to a sound reproduction device.

133. The voice synthesizing method as set forth in claim 132 wherein said second processing is conducted in response to said third voice data.

134. The voice synthesizing method as set forth in claim 133 further comprising conducting a third processing for providing said pitch shift data for purposes of said second processing on the basis of stored reference pitch data.

135. The voice synthesizing method as set forth in claim 133 further comprising edit processing of any of said first, second or third voice data.

136. The voice synthesizing method as set forth in claim 133 further comprising performing a third processing for providing said tone data for performance of said second processing on the basis of information indicating voice tone attributes.

137. The voice synthesizing method as set forth in claim 132 wherein said second voice data is based on an inputted natural voice.

138. The voice synthesizing method as set forth in claim 137 further comprising conducting a fourth processing for receiving a natural voice and storing a first data representation of said natural voice, said representation comprising voice tone data not dependent on time lag between phonemes and attributees of voice tone.

139. A computer readable medium for storing a program for execution by a computer, the program being operative in connection with a storage for storing first voice data comprising at least one of pitch data and velocity data, said first voice data being independent of phonemes, second voice data comprising at least one of voice tone data and pitch shift data, and third voice data comprising language-based phoneme data, said program comprising:

a sequence for controlling the processing said first voice data for developing time sequential meter patterns; and a sequence for controlling the processing of said time sequential meter patterns and both said second voice data and said third voice data for generating a synthesized speech waveform, including pitch frequency; and a sequence for controlling the outputting of said speech waveform to a sound reproduction device.

140. The computer readable medium as set forth in claim 139 wherein said program further comprises a sequence for conducting a third processing for providing said pitch shift data for purposes of said second processing on the basis of stored reference pitch data.

141. The computer readable medium as set forth in claim 140 wherein said program further comprises a sequence for conducting a fourth processing for receiving a natural voice and storing a first data representation of said natural voice.

142. The computer readable medium as set forth in claim 141 wherein said program further comprises a sequence for edit processing of any of said first, second or third voice data.

143. The computer readable medium as set forth in claim 142 wherein said program further comprises a sequence for performing a third processing for providing said tone data for performance of said second processing on the basis of information indicating voice tone attributes.

* * * * *